US005908268A

United States Patent [19]

Yabuuchi

[11] Patent Number: 5,908,268

[45] **Date of Patent: *Jun. 1, 1999**

[54] METHOD OF MAKING A HOLE FOR A FOUNDATION PILE

[75] Inventor: Sadao Yabuuchi, Hyogo, Japan

[73] Assignee: Takechi Engineering Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/756,836

[22] Filed: Nov. 26, 1996

Related U.S. Application Data

[63] Continuation of application No. 08/532,381, Sep. 22, 1995, abandoned, which is a continuation of application No. 08/056,802, Dec. 30, 1992, abandoned, which is a continuation of application No. 07/591,331, Oct. 1, 1990, abandoned, which is a division of application No. 07/457,206, Dec. 26, 1989, Pat. No. 5,099,696.

[30] Foreign Application Priority Data

| | | | |
|---|---|---|---|
| Dec. 29, 1988 | [JP] | Japan | 63-334698 |
| Aug. 4, 1989 | [JP] | Japan | 1-203635 |

[51] Int. Cl.[6] ..... E02D 5/30; E21B 7/20

[52] U.S. Cl. ..... 405/233; 175/57; 405/252; 405/237

[58] Field of Search ..... 405/237, 238, 405/247, 239, 232, 233; 175/57, 99, 98

[56] References Cited

U.S. PATENT DOCUMENTS

| | | | |
|---|---|---|---|
| 1,951,643 | 3/1934 | Bald | 405/233 |
| 3,164,964 | 1/1965 | Josephson | 405/237 X |
| 4,488,606 | 12/1984 | Inoue | 405/237 X |
| 4,547,106 | 10/1985 | Lipsker | 405/262 X |
| 4,770,256 | 9/1988 | Lipsker et al. | 175/57 |

FOREIGN PATENT DOCUMENTS

| | | | |
|---|---|---|---|
| 1238773 | 7/1960 | France | 405/237 |
| 676088 | 5/1939 | Germany | 405/237 |
| 0007417 | 1/1988 | Japan | 405/237 |
| 0184612 | 7/1988 | Japan | 405/237 |
| 1102682 | 2/1968 | United Kingdom | 405/237 |

*Primary Examiner*—Dennis L. Taylor
*Attorney, Agent, or Firm*—Jordan and Hamburg

[57] ABSTRACT

A method of constructing foundation piles provides improved hole stability and bearing characteristics. A boring a hole is initially formed by drilling. A horizontal pressure is then applied to the inner walls of the hole over a vertical portion of predetermined height until a desired degree of compression is attained. Horizontal pressure is then applied over a subsequent vertical portion of an inner circumferential surface of the hole vertically adjacent to a vertical portion pressed in a preceding step of applying horizontal pressure. The steps of compression are continued until a contiguous vertical expanse of the hole is compressed to a desired degree. Alternatively, the depth of the hole may be increased sequentially following a compression operation, and the subsequently formed hole depth then horizontally compressed. In a further embodiment, vertical pressure is applied over a circumferential annular surface area at a bottom of the hole, and also over a central circular area surrounded by, and adjacent to, the circumferential annular surface area.

9 Claims, 44 Drawing Sheets

THEORETICAL EQUATIONS (VERTICAL BEARING FORCE AND DEFORMATION OF PILE)

DIFFERENTIAL EQUATION OF FRICTION STRESS AND DEFORMATION OF PILE (RELATION FORMAULA)

$$\frac{d^2u}{dz^2} - \frac{f\psi}{AE} = 0$$

f : FRICTION STRESS
ψ : CIRCUMFERENTIAL LENGTH
Z : DEPTH
u : DEFORMATION AT DEPTH Z
A : CROSS-SECTIONAL AREA
E : ELASTIC COEFFICIENT

FORMULA OF BEARING FORCE AND DEFORMATION AT BOTTOM $$k = Qp/Ap\,\mu p(Kg/cm^2)$$

K : BOTTOM GROUND COEFFICIENT
Q : BOTTOM BEARING FORCE
SUFFIX p MEANS LOWERMOST END OF PILE

FORMULA FOR CALCULATING DEFORMATION (1) f EXISTS IN ELASTIC DEFORMATION AREA $$\frac{\mu}{\mu_o} = \cos hd1 - \frac{d_1 \sin h + dp \cos hd_1}{d_1 \cos hd_1 + dp \sin hd_1} \sinh\alpha_1 \frac{z}{\ell}$$

$$d_1 = \sqrt{\frac{\beta c \psi \ell}{AE/\ell}} \quad dp = Apkl/AE$$

ℓ : DEPTH OF SUPPORTING LAYER
βc : SLOPE OF f–u RELATIONSHIP
Uo : DISPLACEMENT AMOUNT OF PILE HEAD (2) f EXISTS IN ELASTIC/PLASTIC DEFORMATION AREA (a) PLASTIC AREA (Z ≤ Zy, U ≥ Uy)

$$\frac{\mu}{\mu_o} = 1 + \frac{1}{2} d_{1y} \left(\frac{L}{\ell}\right)^2 \left(\frac{\ell}{\mu_o}\right) - \frac{\varepsilon_o \ell}{\mu_o}\left(\frac{z}{\ell}\right)$$

Zy : DEPTH OF SUPPORTING LAYER
Uy : DISPLACEMENT AMOUNT AT Z=Zy
εo : DISTORTION AT PILE HEAD (b) ELASTIC AREA (Z ≥ Zy, U ≤ Uy)

$$U_o = U_y - \frac{1}{2} d_{1y}\left(\frac{Zy}{\ell}\right)^2 \ell + \varepsilon_o \ell\left(\frac{Zy}{\ell}\right)$$

$$d_{1y} = f_y\,\psi\,\ell/AE$$

(3) f EXISTS IN PLASTIC AREA (a) WHEN BOTTOM END OF PILE BECOMES PLASTIC (Zy=1, Up=Uy)

$$\mu_o = U_y(1+dp) + d_{1y}\,\ell/2$$

(b) AFTER BOTTOM END OF PILE BECOMES PLASTIC (Up>Uy)

$$\mu_o = \varepsilon_o \ell\left(1 + \frac{l}{ap}\right) - d_{1y}\, l\left(\frac{1}{2} + \frac{1}{ap}\right)$$

$$\frac{\mu}{U_o} = 1 + \frac{1}{2} d_{1y}\left(\frac{L}{l}\right)^2 \left(\frac{l}{\mu_o}\right) - \frac{\varepsilon_o \ell}{U_o}\left(\frac{z}{\ell}\right)$$

FIG. 28

STANDARD EQUATIONS IN SPECIFICATIONS AND COMMENTARIES OF ROAD BRIDGES (BOTTOM STRUCTURE SECTION)

ALLOWABLE COMPRESSION BEARING LOAD AT PILE HEAD IN AXIAL DIRECTION $$Ra - \frac{1}{n}(Ru - \overline{W}s) + \overline{W}s - \overline{W}$$

WHERE

Ra : ALLOWABLE COMPRESSION BEARING LOAD (t) AT PILE HEAD IN AXIAL DIRECTION n : SAFTEY FACTOR DESCRIBED IN THE FOLLOWING TABLE

Ru : MAXIMUM BEARING LOAD (t) DEPENDING ON GROUND

Ws : EFFECTIVE WEIGHT (t) OF GROUND PORTION WHICH IS REPLACED WITH PILE

W : EFFECTIVE WEIGHT (t) OF PILE AND SEDIMENT THEREIN

WHERE Ra DOES NOT EXCEED THE ALLOWABLE COMPRESSION BEARING LOAD IN THE AXIAL DIRECTION DETERMINED WITH ALLOWABLE COMPRESSION LOAD IN THE AXIAL DIRECTION AND ALLOWABLE DEFORMATION OF PILE.

FOR LIGHT PILES SUCH AS STRIKE-IN PILES, THE FOLLOWING FORMULA MAY BE USED.

$$Ra - \frac{1}{n} Ru$$

SAFTEY FACTORS

| KIND OF PILE / LOAD CONDITION | SUPPORTING PILE | FRICTION PILE |
|---|---|---|
| ALWAYS | 3 | 4 |
| EARTHQUAKE | 2 | 3 |

HORIZONTAL BEARING LOAD AND DEFORMATION

BURIED PORTION OF PILE $$Ha = \frac{kD}{\beta}\delta a$$

PROTRUDE PORTION OF PILE $$Ha = \frac{4EI\beta^3}{1+\beta k}\delta a$$

WHERE

Ha : BEARING LOAD (kg) IN RADIAL DIRECTION DETERMINED WITH STANDARD DEFORMATION AMOUNT k : REACTION FORCE COEFFICIENT OF GROUND IN LATERAL DIRECTION

D : PILE DIAMETER (cm)

EI : FLEXURAL RIGIDITY (kg.cm2) OF PILE $\beta$ : CHRACTERISTIC VALUE OF PILE $\beta = \sqrt[4]{\frac{kD}{4EI}}$ $(cm^{-1})$ h : LEGNTH OF PROTRUDING PORTION OF PILE $\delta a$ : STANDARD DEFORMATION AMOUNT (cm)

FIG.29

STANDARD EQUATIONS IN RECOMMENDATIONS FOR BUILDING FOUNDATION DESIGN

ALLOWABLE BEARING VERTICAL LOAD FOR LONG PERIOD *LRa*

$$LRa + \frac{1}{3}\left\{ a \cdot 15\overline{N}\ Ap + \left( \frac{\overline{N}s}{3} Ls + \frac{\overline{g}\mu}{2} Lc \right) \right\} \psi - \overline{W}'$$

WHERE $\underline{d}$ : 0.5 AS CORRECTION FACTOR IN CASE OF NO LOAD TEST $\overline{N}$ : AVERAGE OF N VALUE BETWEEN 1d BELOW AND 1d ABOVE THE PILE HEAD (d IS PILE DIAMETER), WHERE THE UPPER LIMIT OF THE N VALUE IS 60, AND THE UPPER LIMIT OF $\overline{N}$ IS 50

Ap: AREA OF PILE HEAD $\overline{N}$s: AVERAGE OF N VALUE IN SAND PORTION OF THE PILE-SURROUNDING PORTION OF THE GROUND Ls: LENGTH OF THE PORTION OF THE PILE IN SAND PORTION OF THE PILE-SURROUNDING PORTION OF THE GROUND $\overline{g}$u: AVERAGE ONE-AXIS PRESSURE RESISTANCE IN A VISCOUS SOIL PORTION IN THE PILE-SURROUNDING PORTION, WHERE THE UPPER LIMIT OF THE RESISTANCE IS 16 t/m2

Lc: LENGTH OF THE PILE PORTION IN A VISCOUS SOIL PORTION IN THE PILE-SURROUNDING PORTION $\psi$: CIRCUMFERENTIAL LENGTH W: EFFECTIVE WEIGHT OF A CAST-IN-SITU CONCRETE PILE - EFFECTIVE WEIGHT OF EXCAVATED SOIL

HORIZONTAL SUPPORTING FORCE AND STRESS AND DEFORMATION OF PILE $$\frac{d}{dx^2}\left\{ EI\frac{d^2y}{dx^2} + p(x) \right\} = 0$$

WHERE x: DEPTH FROM THE GROUND SURFACE (m, cm)

y: DEFORMATION OF PILE AT DEPTH x (m, cm)

E: YOUNG'S MODULUS OF PILE ($t/m^2$, $kg/cm^2$)

I: GEOMETRICAL MOMENT OF INERTIA OF PILE ($m^4$,$cm^4$)

p(x): LATERAL GROUND REACTION FORCE AT DEPTH x (t/m, kg/cm)

$$p(x) = k\,n\,By$$

B: WIDTH OF PILE (m, cm)

kh: COEFFICIENT OF LATERAL GROUND REACTION FORCE ($t/m^3$, $kg/cm^3$)

FIG.30

STRESS AND DEFORMATION OF LONG PILE

| PILE HEAD CONDITION | | FREE | RESTRICTED-IN-ROTATION |
|---|---|---|---|
| $\beta = \sqrt[4]{\frac{k_h B}{4EI}}$ $\{p(x)=kn\ By\}$<br>$n = \sqrt[5]{\frac{N_h}{EI}}$ $\{p(x)=N_n xy\}$<br>kh,nh: COEFFICIENT OF LATERAL GROUND REACTION FORCE<br>B : PILE WIDTH<br>E I : FLEXURAL RIGIDITY | | 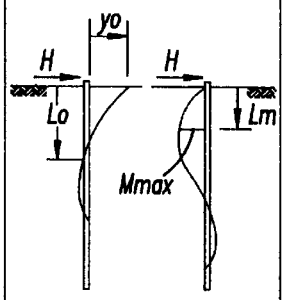 | 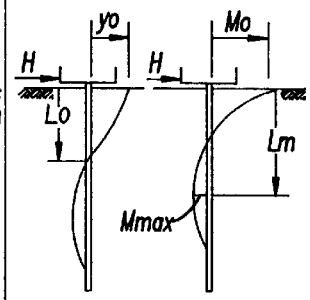 |
| $p(x)=k_h By$ | FLEXURAL MOMENT OF PILE HEAD $Mo$ | $0$ | $\frac{H}{2\beta}$ |
| | MAXIMUM FLEXURAL MOMENT OF PORTION IN GROUND $Mmax$ | $-0.3224\frac{H}{\beta}$ | $-0.104\frac{H}{\beta}$ |
| | DEPTH WHERE Mmax OCCURS $Lm$ | $\frac{\pi}{4\beta}=\frac{0.785}{\beta}$ | $\frac{\pi}{2\beta}=\frac{1.571}{\beta}$ |
| | DEFORMATION OF PILE HEAD $yo$ | $\frac{H}{2EI\beta^3}=\frac{2H\beta}{k_h B}$ | $\frac{H}{4EI\beta^3}=\frac{H\beta}{k_h B}$ |
| | DEPTH OF FIRST STEADY POINT $Lo$ | $\frac{\pi}{2\beta}=\frac{1.571}{\beta}$ | $\frac{3\pi}{4\beta}=\frac{2.356}{\beta}$ |
| $p(x)=N_h xy$ | FLEXURAL MOMENT OF PILE HEAD $Mo$ | $0$ | $0.92\frac{H}{n}$ |
| | MAXIMUM FLEXURAL MOMENT OF PORTION IN GROUND $Mmax$ | $0.78\frac{H}{n}$ | $0.26\frac{H}{n}$ |
| | DEPTH WHERE Mmax OCCURS $Lm$ | $\frac{1.32}{n}$ | $\frac{2.15}{n}$ |
| | DEFORMATION OF PILE HEAD $yo$ | $\frac{2.4H}{EIn^3}=\frac{2.4Hn^3}{n_h}$ | $\frac{0.93H}{EIn^3}=\frac{0.93Hn^3}{n_h}$ |
| | DEPTH OF FIRST STEADY POINT $Lo$ | $\frac{2.42}{n}$ | $\frac{3.10}{n}$ |

PILE BEARING FORCE AND SHORT-TERM ALLOWABLE FLEXURAL MOMENT $$-fb \leqq \frac{N}{Ae} + \frac{M}{Ie}y \leqq fc$$

WHERE $\delta e$ : EFFECTIVE PRE-STRESS $\delta e = 100(kg/cm^2)$
$fb$ : SHORT-TERM ALLOWABLE FLEXURAL TENSILE STRESS OF CONCRETE $fb=100/2=50(kg/cm^2)$
$fc$ : SHORT-TERM ALLOWABLE COMPRESSIVE STRESS OF CONCRETE $fc=800/2=400(kg/cm^2)$
$y$ : PILE RADIUS (+ WHEN COMPRESSED,- WHEN EXPANDED) $y=\pm 20(cm)$
$M$ : SHORT-TERM ALLOWABLE FLEXURAL MOMENT OF PILE SECTION
$N$ : AXIAL FORCE OF PILE
$Ae$ : CROSS-SECTIONAL AREA OF PILE
$Ie$ : GEOMETRICAL MOMENT OF INERTIA OF PILE

FIG.30(cont.)

METHOD OF MAKING A HOLE FOR A FOUNDATION PILE

This application is a continuation, of application Ser. No. 08/532,381, filed Sep. 22, 1995, now abandoned, which is a continuation of application Ser. No. 08/056,802, filed Dec. 30, 1992, now abandoned, which is a continuation of application Ser. No. 07/591,331, filed Oct. 1, 1990, now abandoned, which is a divisional of application Ser. No. 07/457,206, filed Dec. 26, 1989, now U.S. Pat. No. 5,099,696.

BACKGROUND OF THE INVENTION

1. Field of the Invention

An aspect of the present invention relates to a method of determining capability and quality of foundation piles and a method of designing foundation piles and an apparatus which is applies to the methods for measuring characteristics of the ground. Another aspect of the present invention relates to a method of drilling a hole for the foundation piles such as cast-in-situ piles, which shape is made as designed, to support a structure and an apparatus for the method.

2. Background Art

There are earth drill methods, overall casing methods, reverse circulation drill methods, etc. as cast-in-situ pile methods. In each method, a drilling machine drills a hole in a predetermined ground of a predetermined diameter by a predetermined depth. After the drilling machine is pulled out of the ground, a suspended tremie is put in the borehole to remove slime at the bottom of the borehole. Then, a suspended rebar cage is moved down to the bottom of the borehole, and ready-mixed concrete is injected to the hole to fill the hole, while the tremie is being lifted up. Hardening of the concrete results in a cast-in-situ pile. Meanwhile, the foundation pile may be made with a prefabricated pile by filling the borehole with bottom consolidation cement slurry and inserting the prefabricated pile such as a concrete pile, instead of using the raber cage. However, there has been some problems described below.

The supporting capability of the foundation piles, which may be the cast-in-situ pile or the prefabricated pile, for a structure is ordinarily determined by the way as follows.

As a size, a shape, etc. of the structure on the predetermined site are designed, the vertical load, the lateral force by an earthquake or a wind, and the bending moment applied to the foundation pile are accordingly determined. A geological survey in the predetermined site is performed, the foundation piles having endurance of the above-mentioned forces is sought, and the kind of the foundation piles (the cast-in-situ pile or the prefabricated pile), the diameter of the pile, the length (depth) of the pile, the way of construction and the design bearing capacity are determined. According to the kind of structures constructed, the allowable settlement and the allowable lateral displacement, namely, the design deformation, after construction of the structure are also taken into consideration to determine the foundation pile and the way of construction.

However, the bearing capacity and deformation of the foundation piles considerably depend on the soil condition of the ground in which the foundation pile is to be placed, and they are not known until the foundation pile is placed in the predetermined ground and load is practically applied to the pile (i.e., a. loading test): It takes lots of days to carry out the loading test, considering the entire term of works necessary for constructing the structure, and it is impossible to perform the loading test to every one of the piles, considering the term of works and the costs necessary for the construction. The cast-in-situ pile has in general a large bearing capacity, so that the loading test costs for the cast-in-situ pile become prohibitive.

Accordingly, the foundation pile is designed by an indirect method where its bearing capacity and deformation are determined from empirical formulae which have been obtained by analyzing data of existing loading tests based upon geological survey data such as SPT-N values in the ground at the site.

However, with regard to application of the aforementioned indirect method, there is the disadvantage that when the cite-in-situ pile is made, namely, a hole for the pile is drilled by a drilling machine such as an earth drill, the wall of the borehole may crumble due to the vertical movement of the drilling machine, or the bearing capacity of the ground is reduced due to the decompaction and disturbance of the bottom of the borehole, so that the cast-in-situ pile can not be made as expected and specified in design.

The geological survey itself is restricted by time and cost and carried out only for a few parts of the vast site, where its soil condition may be heterogeneous, to be provided with lots of foundation piles. The bearing capacity of each of the many unsurveyed foundation piles is found by applying the above-mentioned soil condition data to the entire site, so that obtained values for the bearing capacity are inaccurate, and applying those values to practical construction is dangerous.

The empirical formula itself has the disadvantage explained hereinafter. In general, the loading test is performed in the condition that the foundation pile provided in the actual ground is loaded on its top with a yield load Py (the pile or the ground varies from an elasto-plastic state to a plastic state) or with an ultimate load Pu (the pile or the ground fails), as shown in FIG. 26. For the design bearing capacity, the deformation of the foundation pile is taken into consideration, and a smaller value, (½) Py or (⅓) Pu, is employed for practical provision of the foundation pile. In other words, the construction is uneconomically performed, taking an excessive safety factor.

The empirical formula is given by analyzing several loading tests as stated above. FIG. 27 shows a graph in which the axis of abscissa represents the bearing capacity data of the pile obtained by the practical loading test and the axis of ordinate represents the bearing capacity of the pile calculated with empirical formulae based upon the geological survey data in respective grounds for the loading tests. Several data are plotted in the graph. Empirical Formulae:

$$Pa=1/n(\alpha Ap+\beta_1 Af_1+\beta_2 Af_2)$$

$$Pu=(\alpha Ap+\beta_1 Af_1+\beta Af_2)$$

n=safety factor

In this case, if the bearing capacity of the pile obtained by the loading test corresponded to the bearing capacity of the pile calculated with the empirical formulae, the data should be plotted on a line inclined at an angle of 45° (Pu) shown in FIG. 27. However, since the empirical formulae themselves have been practically given by analyzing the aforementioned such data, so few data are plotted on the line. A data group plotted above the Pu line shows that the bearing capacity of the pile calculated with the empirical formulae is larger than the bearing capacity of the pile obtained by the practical loading test, and if the design bearing capacity is determined with those empirical formulae, it will apparently be extremely dangerous to employ them. On the other hand, a data group plotted below the Pu line proves that employing the design bearing capacity determined from empirical formulae is too deliberate and becomes uneconomical. Taking a more safety factor for the latter cases is excessively deliberate.

As has been described, after the design bearing capacity is determined for a single foundation pile with empirical formulae and the data such as the geological survey, allocation and disposition of the foundation piles to footings (i.e., foundation bases) for transferring the load of a structure to the foundation pile are carried out. The practical bearing capacity of each of the foundation piles is not known, and hence problems occur as follows:

Generally, the design bearing capacity of each of the foundation piles supporting a single structure is set to have a certain value (e.g. Pa=100 ton/pile). In allocating those foundation piles to the footings, the basic loads applied to the foundation bases in the footings are different from each other depending upon the shape of the structure and the variation in height of the structure. For example, assuming that the basic load in a footing F1 is 420 ton and the basic load in a footing F2 is 180 ton, allocation of the foundation piles to the footings are performed as follows:

| | | |
|---|---|---|
| F1 | 420/100 = 4.2 | five foundation piles |
| F2 | 180/100 = 1.8 | two foundation piles |

Accordingly, the loads applied to a single foundation pile in the footings F1, F2 are different as follows:

| | | |
|---|---|---|
| F1 | 420/5 = 84 | ton/pile |
| F2 | 180/2 = 90 | ton/pile |

As a result, the safety factors are also different between the footings F1 and F2. Thus, there is a difference in the loads which the piles support, and the depression and deformation after construction are different between the footings F1, F2. This result leads to an extremely uneconomical and dangerous setting of the design bearing capacity.

The execution of construction includes steps of (1) designing a structure, (2) determining the basic load, the settlement and the deformation, (3) performing a geological survey and (4) determining the bearing capacity of a pile with empirical formulae based upon the survey data (the diameter and length of the pile), the number of the piles and the construction method. Originally, this way of construction where the unknown bearing capacity for each of the piles is determined without practical experiments is very dangerous, and also uneconomical because a large safety factor must be employed to avoid danger.

As stated above, the practical bearing capacity of the cast-in-situ pile highly depends upon the soil condition of the ground to be provided with piles, the way of executing construction, etc. When the cast-in-situ pile is made, namely, when a hole is made by a drilling machine such as an earth drill, the wall of the borehole is loosened and crumbled due to the vertical movement of the drilling machine within the borehole, the bottom of the borehole is decompacted and disturbed, or the durability of the ground is reduced to result in the deposition of slime at the bottom of the borehole. These all cause the reduction of the bearing capacity of the pile, so that it is diffifult to make the cast-in-situ pile as designed.

As mentioned above, the bearing capacity of the castin-situ pile depends upon the ground condition. The most part of the load of the structure is generally supported by the shaft bearing capacity of the pile under working load. However, there have been no attempt of pressing the borehole wall to make a compact ground, making a tapered borehole with regard to the depthwise direction, or making a inversely tapered borehole to increase pull-out resistance, so as to enhance the shaft bearing capacity. In the case where the hole is tapered, the degree of taper is very small (e.g. 1 to 2%) through it depends on the soil condition of the ground. Although it is advantageous, judging from the shaft bearing capacity of the pile, that the hole for the pile is tapered, there has been no way of practicing it.

Further, there may be employed a cast-in-situ pile having projections such as nodals on its peripheral surface so as to increase the shaft bearing capacity. However, it is difficult to make a hole having a required shape by simply using the drilling machine because the borehole wall crumbles. There are some ways of eliminating the decompaction and disturbance of the bottom of the borehole; a heavy deadweight is dropped in advance down to a hole made, an inside sub-pile is put in and pressed, or a device for pressing the ground is inserted to the hole, so as to make the bottom of the hole compacted. However, there is also the disadvantage that the wall of the borehole crumbles, or the wall and the bottom of the borehole are decompacted during the work of putting the pressing device into the borehole, so that the pile can not have enough end bearing capacity. There is another disadvantage that even when the inside sub-pile and the pressing device are inserted to press the bottom of the borehole, it is difficult to obtain enough reaction force to make the bottom compacted.

As has been described, the design bearing capacity of the foundation pile such as the cast-in-situ pile can merely be determined extremely uneconomically, inaccurately and dangerously, because there is no uniformity in respective practical bearing capacities of many piles for a structure due to the difference of the ground condition or the way of construction, or because there is no way of confirming the capability of the piles in supporting a structure. The present invention solves these problems and provides an appratus for the solution. The present invention also provides a method of executing construction sufficiently suitable for using a bearing capacity characteristic of a cast-in-situ pile and a apparatus for the method.

SUMMARY OF THE INVENTION

According to an aspect of the invention corresponding to claims 1 to 5, a method of constructing foundation piles comprises the steps of setting an appratus in a hole where a foundation pile is to be constructed for measuring ground characteristics; and applying force to the ground around the hole and measuring the force and deformation given to the ground, whereby the characteristics of the ground and the foundation pile is analyzed during the construction of the foundation pile.

The procedure of selecting the foundation pile having the designed characteristics may be carried out during the construction through simultaneous analyses of the characteristics of the ground and the pile.

Otherwise, designing the foundation pile may be carried out during the cnstruction by simultaneously analyzing the ground and the pile.

Further, providing the certification of characteristics and quality of the pile may be carried out during the construction by simultaneously analyzing the ground and the pile.

In the above-mentioned methods of determining and designing the characteristics and the quality of the foundation pile, a ground characteristic analyzer may be used which comprises a horizontal presser extending from the apparatus body to transform the inner wall of the hole in the ground and a downward presser projecting downwards from the apparatus body to transform the bottom of the hole in the ground.

Since the method of constructing foundation piles according to the present invention comprises the steps of setting a ground characteristics measuring apparatus in a hole where a foundation pile is to be constructed; and measuring force given to the ground in the hole and the deformation of the ground, whereby the characteristics of the ground and the foundation pile are analyzed during the construction of the foundation pile, the actual bearing capacity and the deformation of each constructed foundation pile can be analyzed simultaneously during construction so that the foundation piles can be constructed safely and appropriately.

Since the step of selecting the foundation pile having the designed specification may be carried out through analysis of the characteristics of the ground and the pile simultaneously with the construction, the foundation piles can be constructed in conformity with the designed data.

Since designing the foundation pile may be carried out by analyzing the ground and the pile simultaneously with the construction, the foundation piles can be designed and constructed which is safe and most suitable to the ground characteristics.

Since providing the certification of characteristics and quality of the pile may be carried out by analyzing the ground and the pile simultaneously with the construction, the precise data of the pile characteristics can be presented for all the foundation piles constructed, and certifyting that all the foundation piles are safe and have appropriate quality can be carried out simultaneously with the construction site.

Furthermore, since a ground characteristic analyzer S (FIG. 1) may be used which comprises a horizontal presser extending from the apparatus body to transform the inner wall of the hole in the ground and a downward presser projecting downwards from the apparatus body to transform the bottom of the hole in the ground, the simple device can press and transform the surrounding ground of the hole in the ground at any depth, and the simple device can press and transform the bottom of the hole in the ground making use of the friction force generated by pressing the surrounding ground at some depth mentioned above as the reaction force.

According to another aspect of the present invention corresponding to claims 6 to 10, a method of making a hole to be used for a foundation pile such as a cast-in-situ pile comprises inserting with pressure a casing having a horizontal presser at the outer portion into a hole in the ground made by a drilling machine; and pressing by the horizontal presser the surrounding ground of the hole in the ground to have an arbitrary configuration.

The configuration of the surrounding ground of the hole made by the press may be tapered toward the deeper direction, or it may have one or more irregular portions in the surrounding ground.

The casing may have a vertical presser at the bottom outer portion. The casing is inserted into the hole made by the drilling machine. When the casing reaches the planned depth, the vertical presser and the bottom surface of the drilling machine may press the bottom of the hole.

The drilling machine for a foundation pile such as a cast-in-situ pile according to the present invention comprises a casing having a vertical presser at the bottom outer portion; a drilling device for drilling the ground; and a connecting means, which allows the casing and the drilling device to move in the casing axis direction, were arranged between the casing and the drilling machine.

According to the method of making a hole to be used for a foundation pile such as a cast-in-situ pile of this aspect, the wall of the hole in the ground is pressed to have a planned shape while the drilling device drills the ground, so that the surrounding ground of the hole in the ground is enforced.

If the hole made by press is tapered toward the deeper direction, or it has one or more irregular surface portion, the skin friction of the pile and the pull-out resistance of the pile can be increased.

Since the drilling method for a foundation pile such as a cast-in-situ pile in accordance with the present invention comprises the step of pressing the bottom of the hole by the vertical presser and the bottom surface of the drilling device, the ground at the bottom portion of the hole is also enforced as follows.

The drilling apparatus of the present invention comprises the casing having the vertical presser at the bottom outer portion, the drilling machine for drilling the ground, and the connecting means, which allows the casing and the drilling machine to move in the direction of the casing axis, provided between the casing and the drilling machine. Therefore, the apparatus can press the whole bottom surface of the hole in the ground under the condition of connecting the casing and the drilling machine.

EFFECTS OF THE INVENTION

According to the former aspect of the present invention, a method of constructing foundation piles comprises the steps of setting an appratus for measuring ground characteristics in a hole where a foundation pile is to be constructed; and measuring force given to the ground in the hole and the deformation of the ground, whereby the characteristics of the ground and the foundation pile are analyzed during the construction of the foundation pile. Therefore, without the loading test which is carried out in the conventional method, the actual bearing capacity and the deformation of each constructed foundation pile can be analyzed simultaneously with the construction so that the foundation piles can be constructed safely and appropriately. Further, as a result of the above-mentioned analyzation, the bearing characteristics of the pile; namely, the vertical bearing capacity and deformation (the rates of the bearing capacity and deformation at the end of the pile and of those at the shaft surface), the horizontal bearing capacity and deformation, etc; are individually confirmed, whereby a more reliable foundation pile than that designed based on the bearing capacity and deformation of the pile obtained by the empirical formulae can be constructed.

Further according to the present invention, the step of selecting the foundation pile having the designed characteristics may be carried out through analysis of the characteristics of the ground and the pile simultaneously with the construction. In this case, a foundation pile can be constructed according to the design specifications determined based upon the load of a structure, the external force applied to the structure, the geological survey, etc., so that all the foundation piles can be constructed safely and well-balanced enough to support the structure. Even if the results of the measuring and analysis indicate that the bearing capacity, deformation, etc. of the pile are unsatisfactory, the pile having appropriate design specifications can be constructed by simply varying the length, the diameter, the material, the arrangement of reinforcement, etc. of the pile, without any change of the specified design values, namely the values of the bearing capacity and deformation of the pile.

According to the present invention, designing the foundation pile may be carried out by analyzing the data of the ground and the pile simultaneously with the construction. The ground in the hole is displaced, and the force required to displace the ground and the deformation is measured analyzed and calculated with various formulae such as theoretical formulae, whereby the optimum and reliable foundation pile suitable for the characteristics of the ground can be designed.

Further according to the present invention, providing the certification of capability and quality of the pile may be carried out by analyzing the data of the ground and the pile simultaneously with the construction. Undoubted data about the pile capability for all the piles to be constructed are presented, whereby it can be certified just at the construction site that all the foundation pile are safe and satisfactory in quality.

A ground characteristic analyzer according to the present invention comprises a horizontal presser extending from the apparatus body to press the inner wall of the hole in the ground and a downward presser projecting downwards from the apparatus body to press the bottom of the hole in the ground, whereby the simple device can press and displace the surrounding ground of the hole in the ground at any depth, and the simple device can press and displace the of the hole in the ground making use of the friction force generated by pressing the surrounding ground at some depth as the reaction force.

According to another aspect of the present invention, a method of making a hole to be used for a foundation pile such as a cast-in-situ pile comprises inserting with pressure a casing having a horizontal presser at the outer portion into a hole in the ground made by a drilling machine; and pressing with the horizontal presser the surrounding ground of the hole in the ground while the casing is kept in the hole, for example, when the casing is inserted with pressure or when the casing is lifted up thereafter, whereby a foundation pile, such as a cast-in-situ pile, having a high shaft bearing capacity can be constructed without crumbling and decompaction of the surrounding ground. The surrounding ground of the hole may have an arbitrary configuration, such as a tapered configuration and irregular surface, by pressing the surrounding ground. Accordingly, the optimum cast-in-situ pile can be freely and easily constructed in accordance with the required capability of the cast-in-situ pile, namely, the friction of its shaft surface and the pull-out resistance, the bending moment applied to the upper portion of the pile. The deformation of the surrounding wall due to the pressing the surrounding ground of the hole is measured, whereby a cast-in-situ pile whose taper is only a few percent can be constructed by pressing the surrounding ground with high accuracy. Moreover, the pressing surface itself of the horizontal presser can be tapered or be provided with irregular portions, whereby an arbitoray configuration of the surrounding ground can be easily constructed.

Further, enforced pressing of the bottom of the hole can be performed just after the drilling machine and the vertical presser provided at the peripheral end portion of the casing reach the bottom of the hole, whereby the bottom of the hole can be assuredly compacted.

The drilling apparatus of the present invention comprising the casing having the vertical presser at the bottom and outer portion, the drilling machine for drilling the ground, and the connecting means, which allows the casing and the drilling machine to move in the direction of the casing axis, provided between the casing and the drilling machine can press the whole bottom surface of the hole in the ground under the condition of connecting the casing and the drilling machine. The reaction force for bottom pressing can be simply obtained making use of the friction force generated by horizontal pressure, which is mentioned above.

BRIEF DESCRIPTION OF THE DRAWINGS

FIG. 28 is a diagram showing storage means in a pile bearing capacity analyzing/operating unit, for storing theoretical formulae;

FIG. 29 is a diagram showing storage means in a pile bearing capacity analyzing/operating unit, for storing equations in a specification;

FIG. 30 is a diagram showing storage means in a pile bearing capacity analyzing/operating unit, for storing other equations in a specification;

DETAILED DESCRIPTION OF THE PREFERRED EMBODIMENT

An embodiment of a ground characteristic analyzer according to the present invention will be described with reference to FIGS. 1 to 12.

Figure 1:
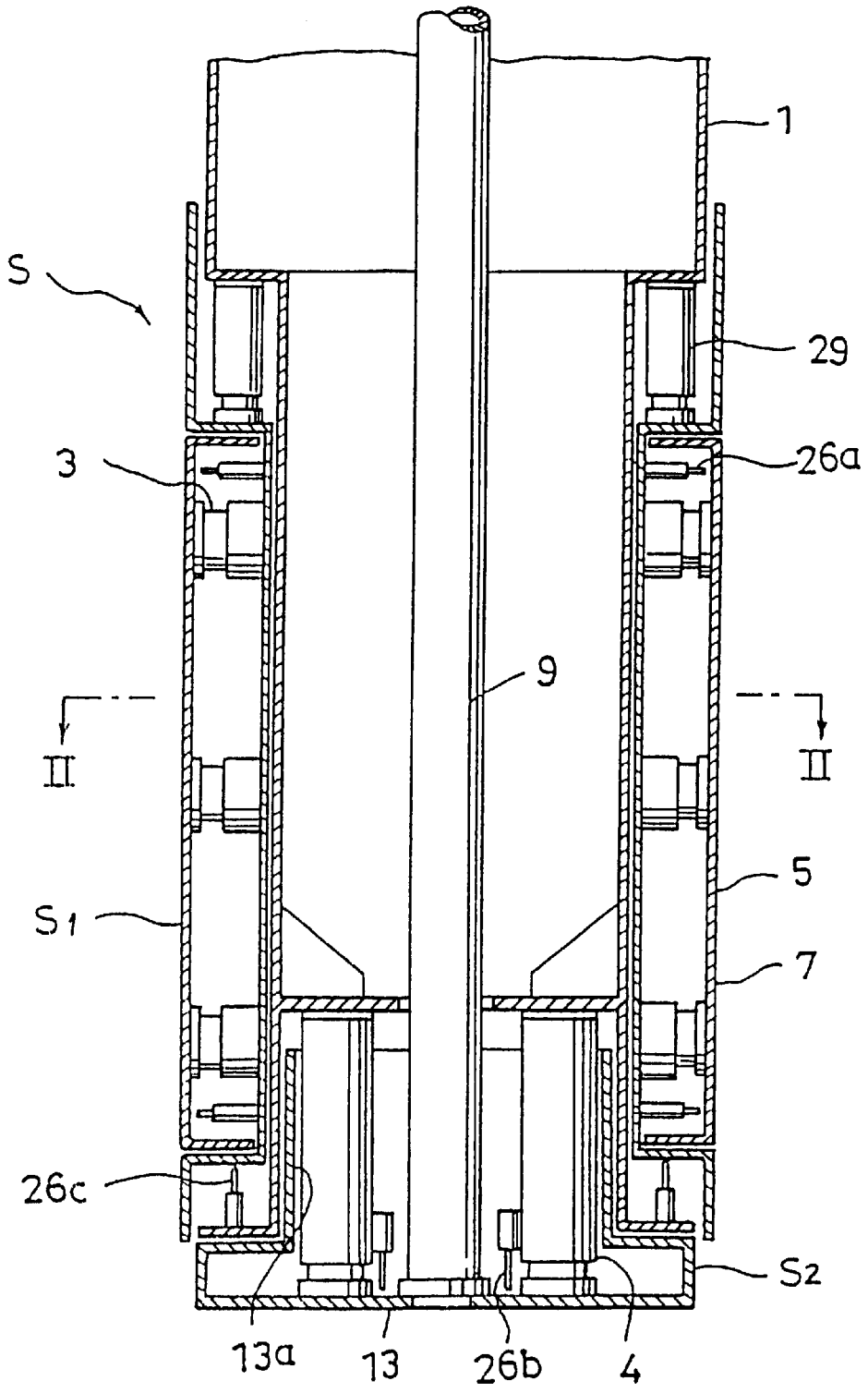
FIG. 1 is a sectional view showing an embodiment of a ground characteristics analyzer according to the present invention.
Figure 2:
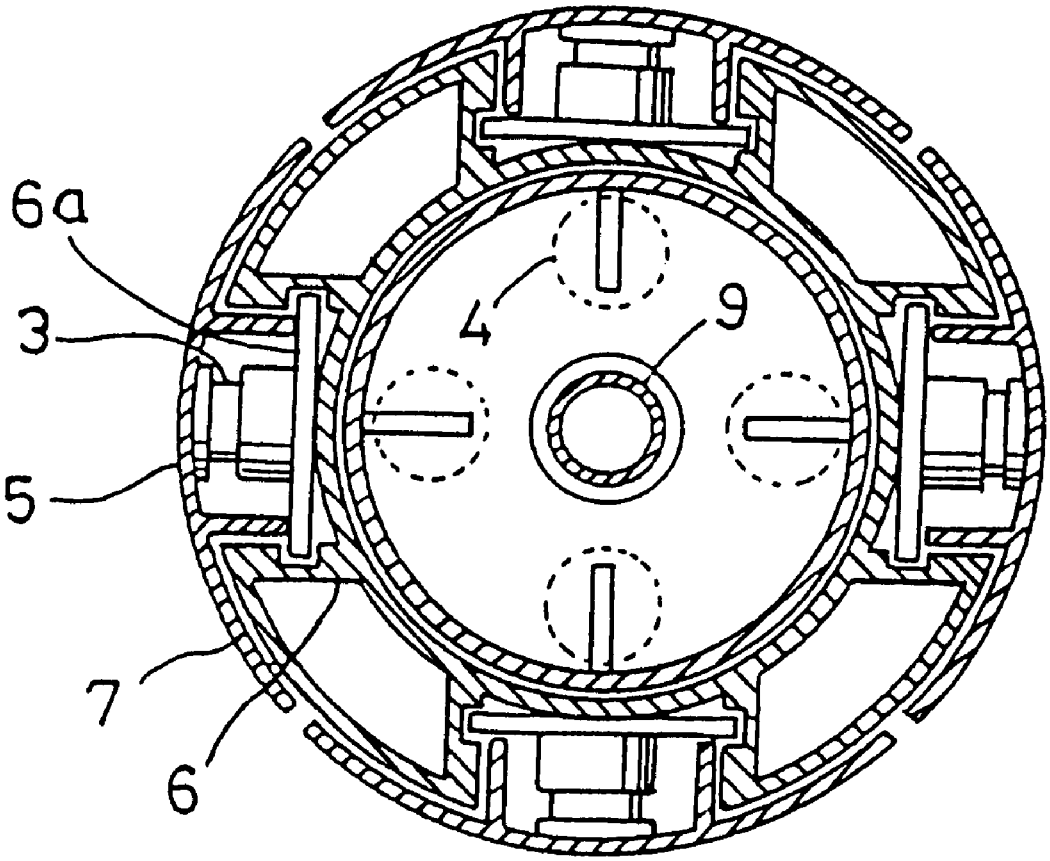
FIG. 2 is a sectional view about the line II—II of FIG. 1.
Figure 3:
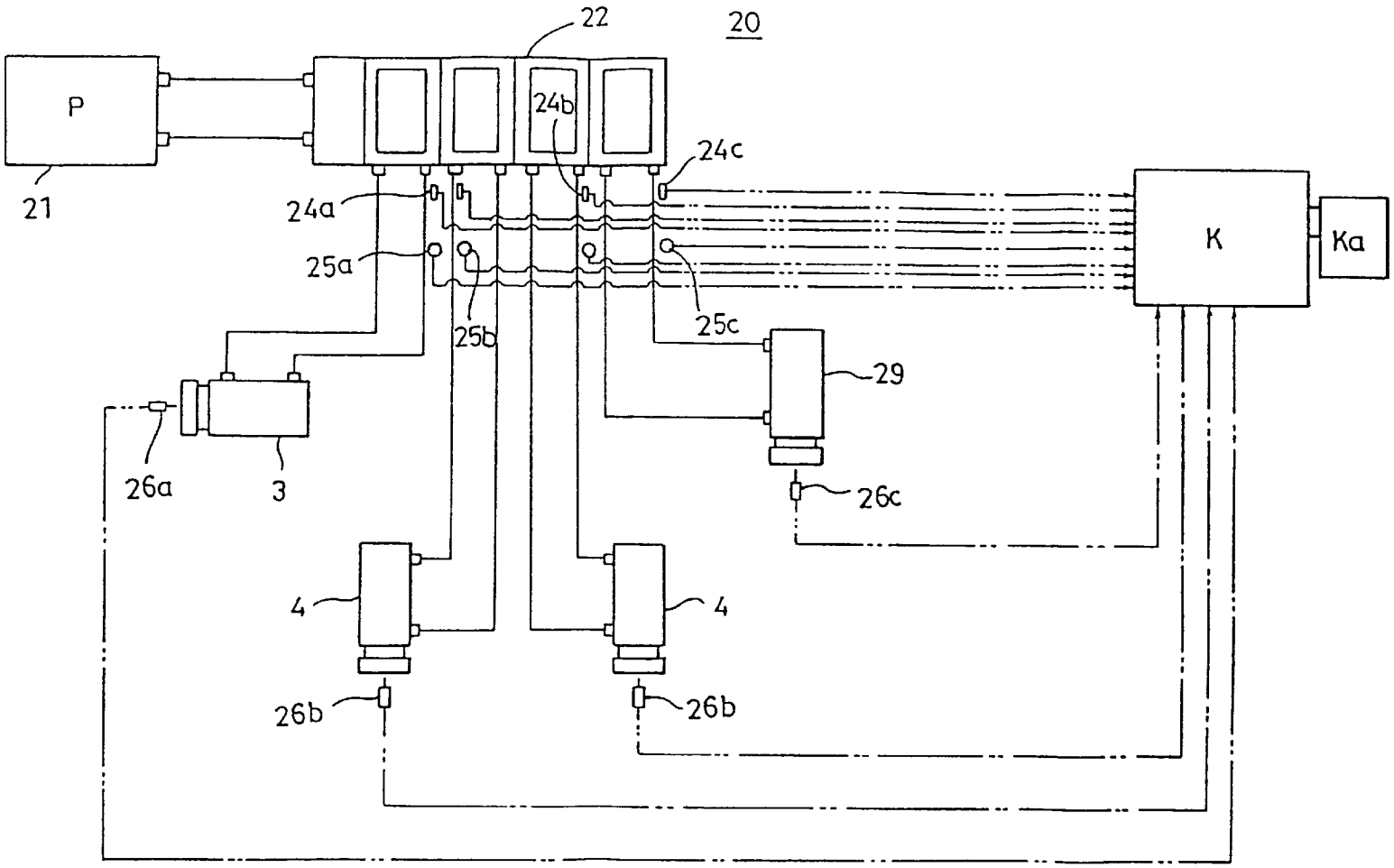
FIG. 3 is a diagram presented for explaining a hydraulic circuit of the ground characteristics analyzer and a transmission circuit of values measured by a sensor.

FIGS. 1 to 3 show the embodiment of a ground characteristics analyzer S. A casing 1 is approximately the same in diameter across its entire length as the diameter of a hole. The casing 1 may be the same as the hole only in its bottom and the upper portion therefrom may be small in diameter.

Reference numeral S denotes a ground characteristics analyzer provided in the bottom portion of the casing. The ground characteristics analyzer S includes a horizontal presser S1 for pressing the surrounding ground of the hole and a vertical presser S2 for pressing the bottom ground of the hole.

The horizontal presser S1 has a double-pipe structure consisting of multisections (four sections) at the outer peripheral portion of the ground characteristics analyzer S. Box-shaped divided pressing frames 5 are radially moved by the operation of horizontal cylinders 3 along guide plates 6 in the divided sections. Slide plates 6*a* to which the root of each of the horizontal cylinders 3 is fixed are supported by the guide plates 6 for vertical movement. A pressing face 7 which is an outer face of the frame is formed as an arc having the same diameter as that of the casing, and a plurality of which make up the almost circular pressing face. The horizontal cylinder 3 is disposed at vertical intervals from each other in the horizontal presser S1. The outer surface of each of the pressing frames 5 may be a rough surface similar to the outer peripheral surface of a cast-in-situ pile to be constructed.

An upper cylinder 13*a* which is a part of a vertical. pressing board 13 is fitted in the inner pipe of the horizontal presser S1 to slide up and down. One or more vertical cylinders 4 are provided within the chamber of the vertical presser along the vertical direction. The vertical pressing board 13 is connected to the lower portion of each of the vertical cylinders 4 and moved up and down in accordance with the movement of the vertical cylinders 4. The pressing face of the vertical pressing board 13 is the same in outer diameter as the diameter of the hole.

Figures 4A, 4B, 4C, 4D, 4E, 4F:
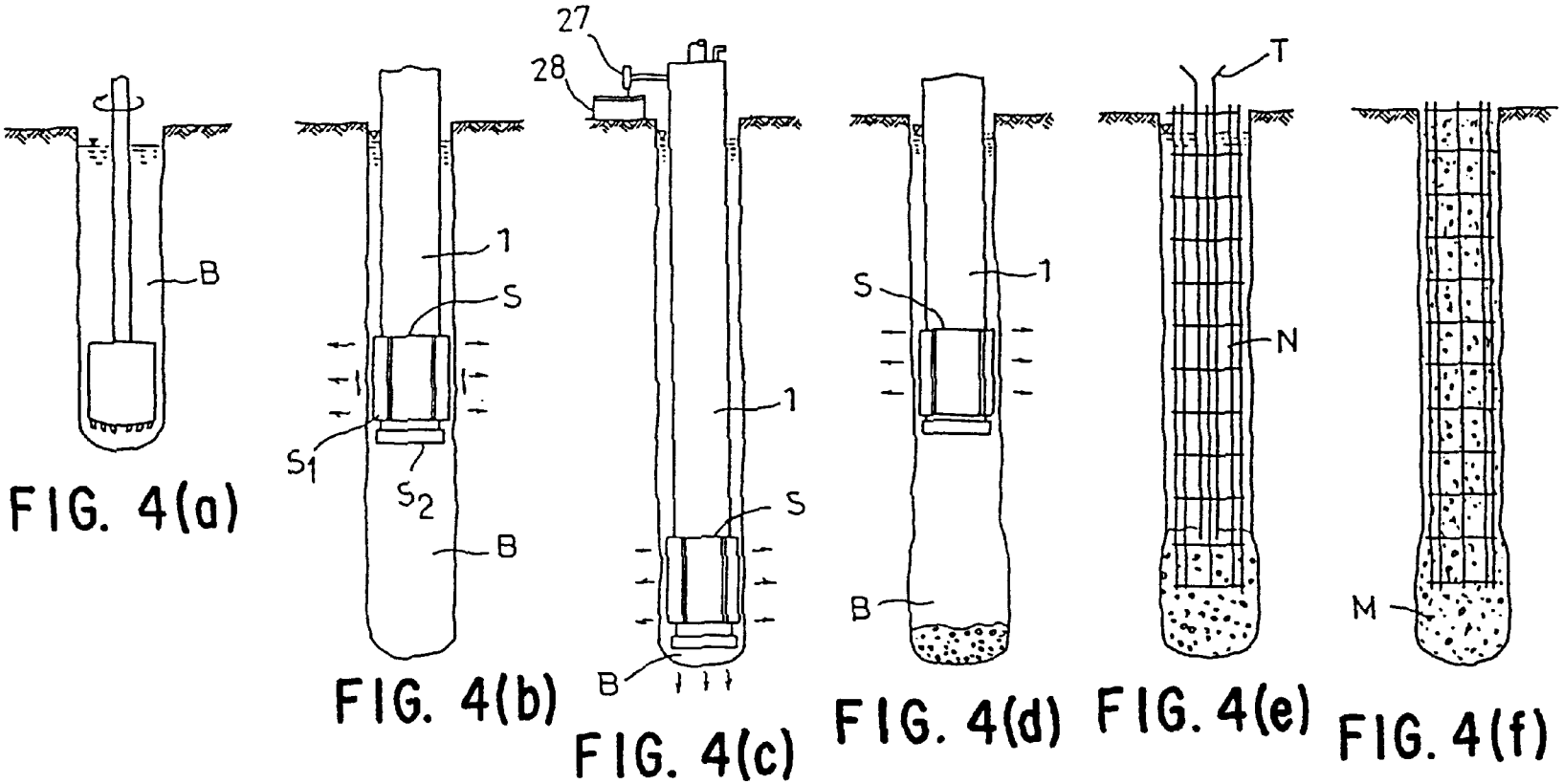
FIGS. 4(*a–f*) is a diagram presented for explaining a method of executing the construction using the ground characteristics analyzer of FIG. 1.

Reference numeral 9 denotes a suction/drain pipe. With the pipe 9, when the casing 1 and the ground characteristics analyzer S are suspended in the hole, mud water can be drained from the hole or water can be supplied thereto. If required, ready-mixed concrete for bottom consolidation can be injected to fill the bottom ground of the hole through the pipe 9 as shown in FIG. 4(*d*). The pipe 9 is provided with an automatic opening/closing valve at its end. A hose may be substituted for the pipe 9, and sometimes the pipe 9 is not employed.

Reference numeral 29 denotes a cylinder attached to the ground characteristics analyzer S and moving in the axial direction. The cylinder 29 makes the pressing frames 5 slide along the body in the direction corresponding to the vertical axis. When the cylinder 29 is moved with the pressing frames 5 in the horizontal presser S1 protruding in the horizontal direction to press the surrounding ground of the hole, the pressing frames 5 move up and down, so that the frictional resistance of the surrounding ground of the hole can be determined. The frictional resistance may be determined by connecting the upper portion of the body of the casing 1 to a power jack or the like on the ground to move the portion up and down instead of the cylinder 29. The frictional resistance may also be determined by connecting the upper portion of the casing 1 to a rotating or pivoting device such as a casing driver provided on the ground to rotate the casing 1 and move it in the radial direction.

A hydraulic control unit 20 includes a manifold 22, a electromagnetic valve 23, etc. and is positioned surrounded by a hydraulic pump 21, the horizontal cylinders 3, the vertical cylinders 4 and the axially moving cylinders 29. Although the hydraulic control unit 20 is positioned close to the pump 21 on the ground, a plurality of hoses or pipes should connect the manifold 22 to each of the cylinders. When the hydraulic control unit 20 is positioned close to the ground characteristics analyzer S, the apparatus is simplified because only two main hoses or pipes communicate the long distance between the pump 21 and the manifold 22. A plurality of hoses or pipes are provided to communicate the short distance from the manifold 22 to each of the cylinders.

Reference numerals 24*a*, 24*b* and 24*c* denote pressure meters or pressure sensors for determining the pressure of the oil (fluid) delivered to each of the horizontal cylinders 3, the vertical cylinders 4 and the axially moving cylinders 29. These meters or sensors are placed on the ground or mounted in the ground characteristics analyzer S. The measurement by each of the pressure sensors is converted into an electric signal and transmitted to a pile bearing capacity analyzing/operating unit K described hereinafter.

A position sensor 26*a* protrudes in the radial direction from the outer peripheral surface of the ground characteristics analyzer S in the horizontal direction to determine the displacement of each of the pressing frames 5, namely, the deformation of the surrounding ground of the hole in accordance with the stretch and compression of the horizontal cylinder 3. A plurality of the position sensors 26*a* are provided so that the displacement of each of the pressing frames 5 corresponding to the multisections divided in the radial direction can be determined. Also, when pressing portions are disposed at intervals in the radial direction as will be explained hereinafter, each of the pressing portions is provided with the position sensor 26*a*.

A position sensor 26*b* protrudes downwards from the body of the ground characteristics analyzer S to determine the displacement of the vertical pressing board 13 pressing the bottom ground of the hole, namely, the deformation of the bottom ground of the hole in accordance with the stretch and compression of the horizontal cylinder 3.

A position sensor 26*c* determines the vertical displacement of each of the pressing frame 5 of the ground characteristics analyzer S, namely the displacement along the body of the ground characteristics analyzer S. Also, a plurality of the position sensors 26*c* are provided to determine the displacement of each of the pressing frames 5 which are the multisections divided in the radial direction. Displacement gages such as a LVDT type sensor, a linear-gage type sensor and a strain-gage type sensor may be employed for those position sensors 26*a*, 26*b*, 26*c*, for example.

A displacement gage 27 determines on the ground the vertical displacement of the casing 1 provided with the ground characteristics analyzer S at its end portion. In other words, it determines the radial displacement of a pipe of the casing 1 from a stable point 28 on the ground. The displacement gage 27 is used for determining the vertical displacement of the pressing frame 5 and for checking whether or not the casing 1, or the ground characteristics analyzer S, moves upward, in pressing the bottom ground of the hole while the surrounding ground of the hole is being pressed (i.e. in the case where the portion pressed in the side wall of the hole is slippery).

The pile bearing capacity analyzing/operating unit K is a device including a microcomputer, for storing, analyzing and operating data about the surrounding ground of the hole and the bottom ground thereof which are determined and inputted by the above mentioned sensors so as to analyze the shaft bearing capacity and the end bearing capacity of the pile, namely the vertical bearing capacity and deformation of the pile and the horizontal bearing capacity and the deformation thereof. The unit K stores the design bearing capacity and deformation, various theoretical formulae, various standards in various countries, etc. (specified in FIGS. 28 to 30), analyzes and operates ground information using the above-mentioned formulae and standards to decide safe and accurate pile capability related to the bearing capacity of the pile. A unit Ka certifies the capability and quality of the pile. The unit Ka is connected to the pile bearing capacity analyzing/operating unit K to electrically communicate to each other, so that it can certify the bearing capacity and deformation of the pile to which the pile bearing capacity analyzing/operating unit K decides based upon the analysis and operation that it is satisfactory, namely, it can certify the capability and quality of the pile. With the unit Ka, the certification of all the foundation piles to be constructed can be outputted just at the construction site. This unit Ka is comprised of a recorder, a printer, a monitor, etc., and it may also be incorporated to the pile bearing capacity analyzing/operating unit K.

Flow meters 25*a*, 25*b* and 25*c* may be substituted for the position sensors 26*a*, 26*b* and 26*c* for determining the emotion of oil (fluid) delivered to the horizontal cylinder 3, the vertical cylinder 4 and the axially moving cylinder 29. These flow meters are positioned close to the manifold 22 and the electromagnetic valve 23 to determine the amount of the stretch and compression of each of the cylinders 3, 4, 29, or the displacement of the pressed portion, or further the deformation of the ground, based upon the amount of the fluid delivered.

Figure 5:
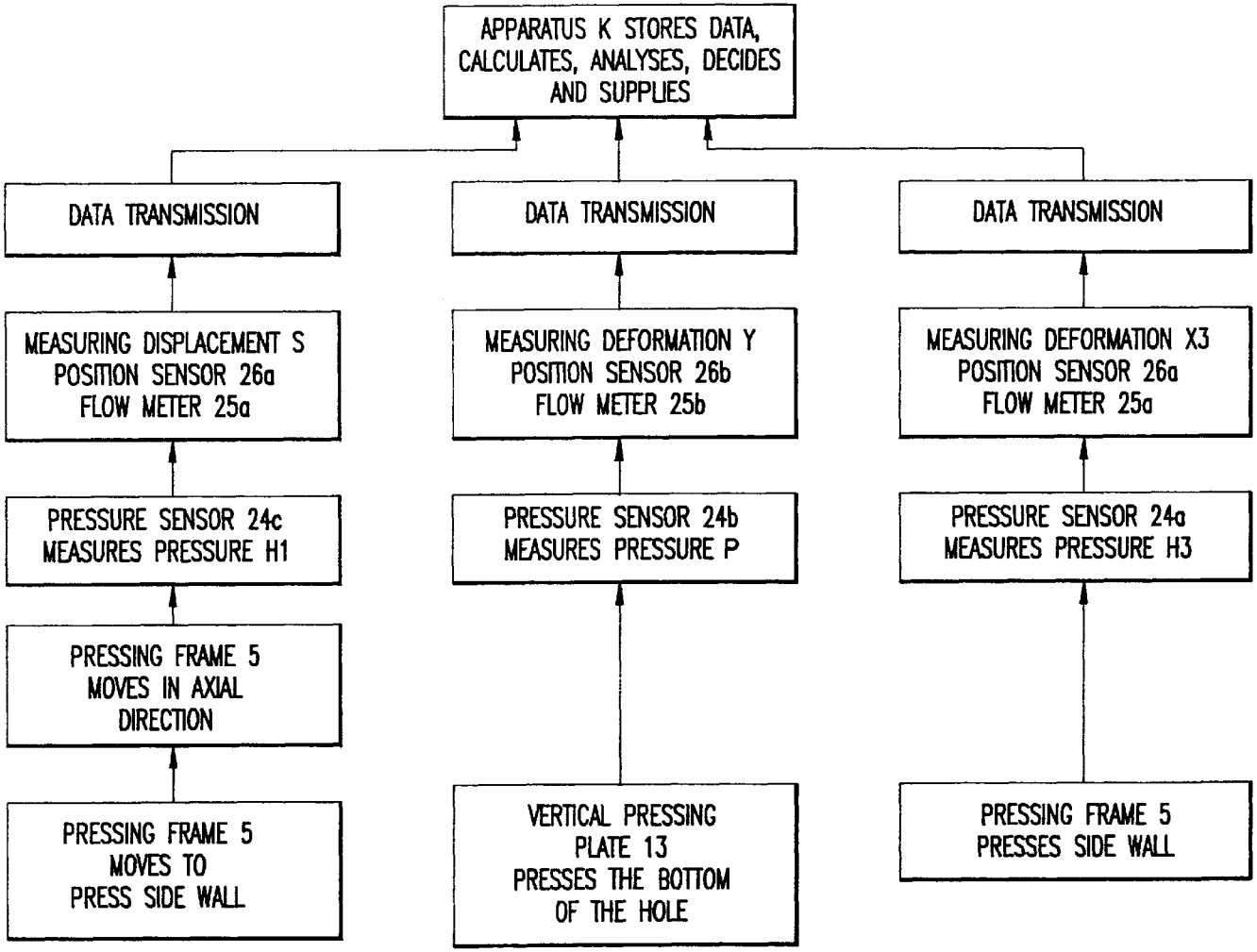
FIG. 5 is a block diagram of the ground characteristics analyzer of FIG. 1.

Then, the manipulation of the ground characteristic analyzer S and the determination of the pile bearing capacity and the like will be described with reference to FIGS. 4 and 5.

First, a hole is made by a drilling machine such an earth drilling machine and an overall casing machine in a predetermined ground with a predetermined diameter, at a predetermined depth in a conventional drilling way, and then the drilling machine is pulled out of the ground (FIG. 4(*a*)).

Determination of Shaft Bearing Capacity and Deformation of Pile (FIG. 4(*b*))

The casing 1 is suspended for keeping the ground characteristics unit S (details are shown in FIG. 1) at a predetermined depthwise position in a hole B. The horizontal cylinder 3 is moved to make the pressing frames 5 protrude in the radial direction from the outer surface of the ground characteristic unit S. The pressing frames 5 press the surrounding ground in the hole, or the wall of the hole, to deform the surrounding ground. In pressing the surrounding ground, the pressing force produced by the horizontal cylinder 3 is determined by the pressure sensor 24*a*.

The axially moving cylinder 29 is moved when the pressing force of the horizontal cylinder 3 reaches a predetermined value, and the pressing frame 5 is moved in the direction corresponding to the axis of the hole B while the pressing frames 5 is pressing the surrounding ground. The transfer force by the axially moving cylinder 29, namely, the reaction force of hydraulic force, is canceled by keeping the dead load of the casing 1 equal to it or by fixedly supporting the upper portion of the casing 1 using a machine on the ground.

The pressing force of the axially moving cylinder 29, namely, the transfer force, is determined by the pressure sensor 24*c*. Further, the displacement of the pressing frame 5 in the axial direction is determined by the position sensor 26*c* or the like, transmitted to the pile bearing capacity analyzing/operating unit K on the ground, and stored as data of the ground and analyzed. The pressing and determining of the surrounding ground is performed for each of specified depth of the hole. When the pressing frame 5 in the ground characteristic analyzer S is long, the number of times of pressing is reduced. On the other hand, when the ground characteristics analyzer S extends across the entire length of the casing 1, the pressing is performed only once.

Determination of End Bearing Capacity and Deformation of Pile (FIG. 4(*c*))

The ground characteristic analyzer S (FIG. 1) is suspended down to the bottom of the hole B and placed therein. Then, the horizontal cylinder 3 is moved so that the pressing frames 5 protrude in the radial direction from the outer peripheral surface of the ground characteristic analyzer S, and press the surrounding ground of the bottom portion of the hole. While the pressing frames 5 are pressing the surrounding ground (using the frictional resistance caused by the pressing as the reaction force), the vertical cylinder 4 is moved so that the vertical pressing board 13 protrudes downward from the ground characteristics analyzer S and press the bottom of the hole to deform the bottom ground.

The pressing force of the vertical cylinder 4 is determined by the pressure sensor 24*b*, and the displacement of the vertical pressing board 13 in the axial direction, or the deformation of the bottom ground is determined by the position sensor 26*b*. The determined values are transmitted to the pile bearing capacity analyzing/operating unit K on the ground, stored as data of the ground and analyzed. In pressing the bottom ground of the hole, pressing and releasing may sometimes be repeated several times as stated hereinafter.

Determination of the Horizontal Bearing Capacity and Deformation (FIG. 4(*d*))

The ground characteristic analyzer S is positioned in the hole B close to the ground surface to which the lateral force is mainly applied. In this case, the surrounding ground of the hole is pressed similar to the way by which the surrounding ground of the hole is pressed to determine the shaft bearing capacity and the deformation of the pile. Specifically, the horizontal cylinder 3 is moved so that the pressing frames 5 protrude in the radial direction from the outer peripheral surface of the ground characteristics analyzer S to press the surrounding ground in the hole, or the wall of the hole, and deform the surrounding ground.

In pressing the surrounding ground, the pressing force of the horizontal cylinder 3 is determined by the pressure sensor 24*a*, transmitted to the pile bearing capacity analyzing/operating unit K on the ground and stored as data of the ground and analyzed.

When the pressing of the ground of the hole, the determining and analyzing of the bearing capacity and deformation of the pile are finished and the results are satisfactory, the bearing capacity analyzer S is pulled out of the hole and, thereafter, a rebar cage N and a tremie T are suspended down to the bottom portion of the hole and ready-mixed concrete is injected in the hole. Hardening of the concrete results in a cast-in-situ pile M as designed, or a cast-in-situ pile M suitable for the characteristics of the ground (FIGS. 4(*e*) and 4(*f*)). After the determination, as shown in FIG. 4(*d*), the hole may be filled with bottom consolidation cement slurry through the suction/drain pipe 9 in the casing 1.

As another method, after the above-mentioned determination and analysis, the hole is filled with curing agent such as bottom consolidation mortar and periphery consolidation mortar, and a concrete pile, steel pipe or the like is inserted in the hole. In this way, a foundation pile is constructed using a prefabricated pile.

Figure 6:
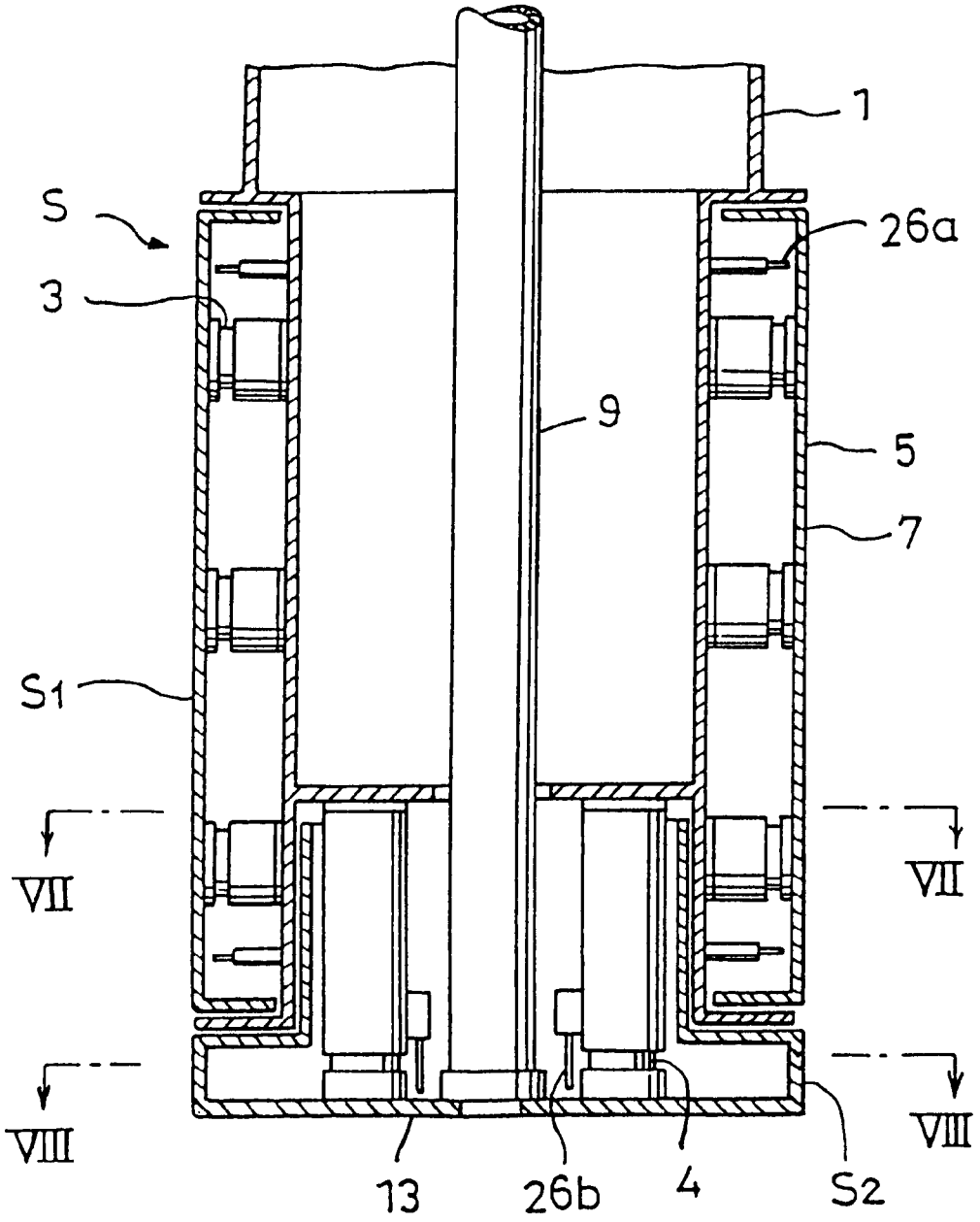
FIG. 6 is a sectional view of a ground characteristics analyzer of another embodiment of the present invention.
Figure 7:
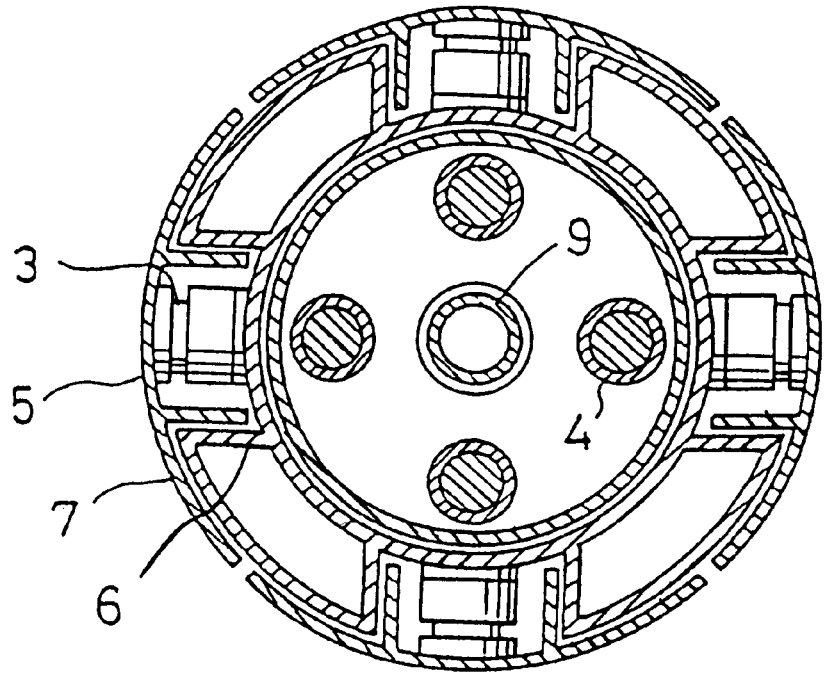
FIG. 7 is a sectional view about the line VII—VII of FIG. 6.
Figure 8:
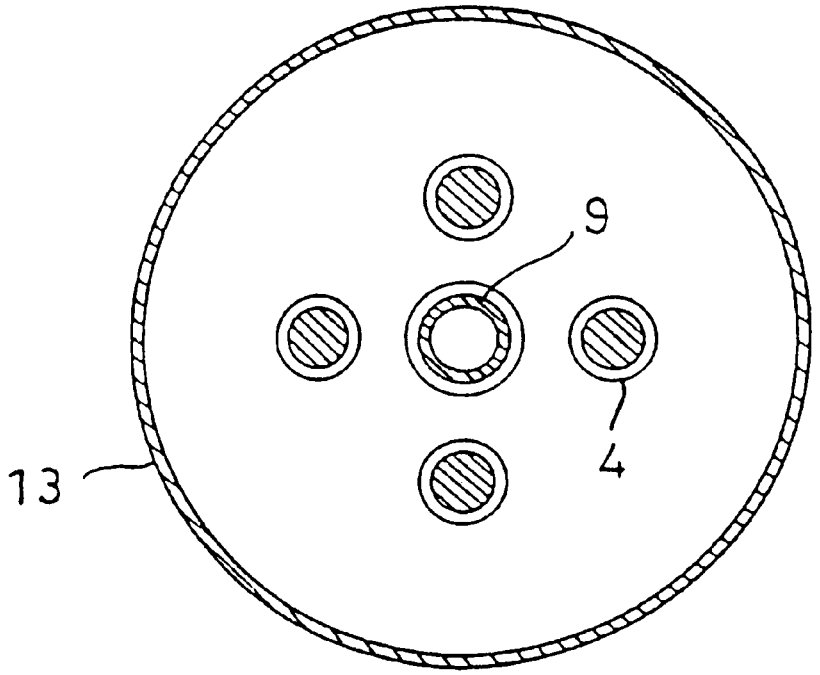
FIG. 8 is a sectional view about the line VIII—VIII of FIG. 6.

FIGS. 6 to 8 show another embodiment of the ground characteristic analyzer S, which is similar to the aforementioned embodiment shown in FIG. 1 except that no axial moving cylinder 29 is provided. In this embodiment, the upper portion of the body of the casing 1 is connected to a power jack or the like on the ground to move up and down so that the pressing frames 5 are moved in the axial direction pressing the surrounding ground of the hole. The movement of the pressing frames 5 may be performed by connecting the upper portion of the casing 1 to a rotating or pivoting device such as a casing driver placed on the ground so as to rotate the casing 1 to move in the radial direction.

Figure 9:
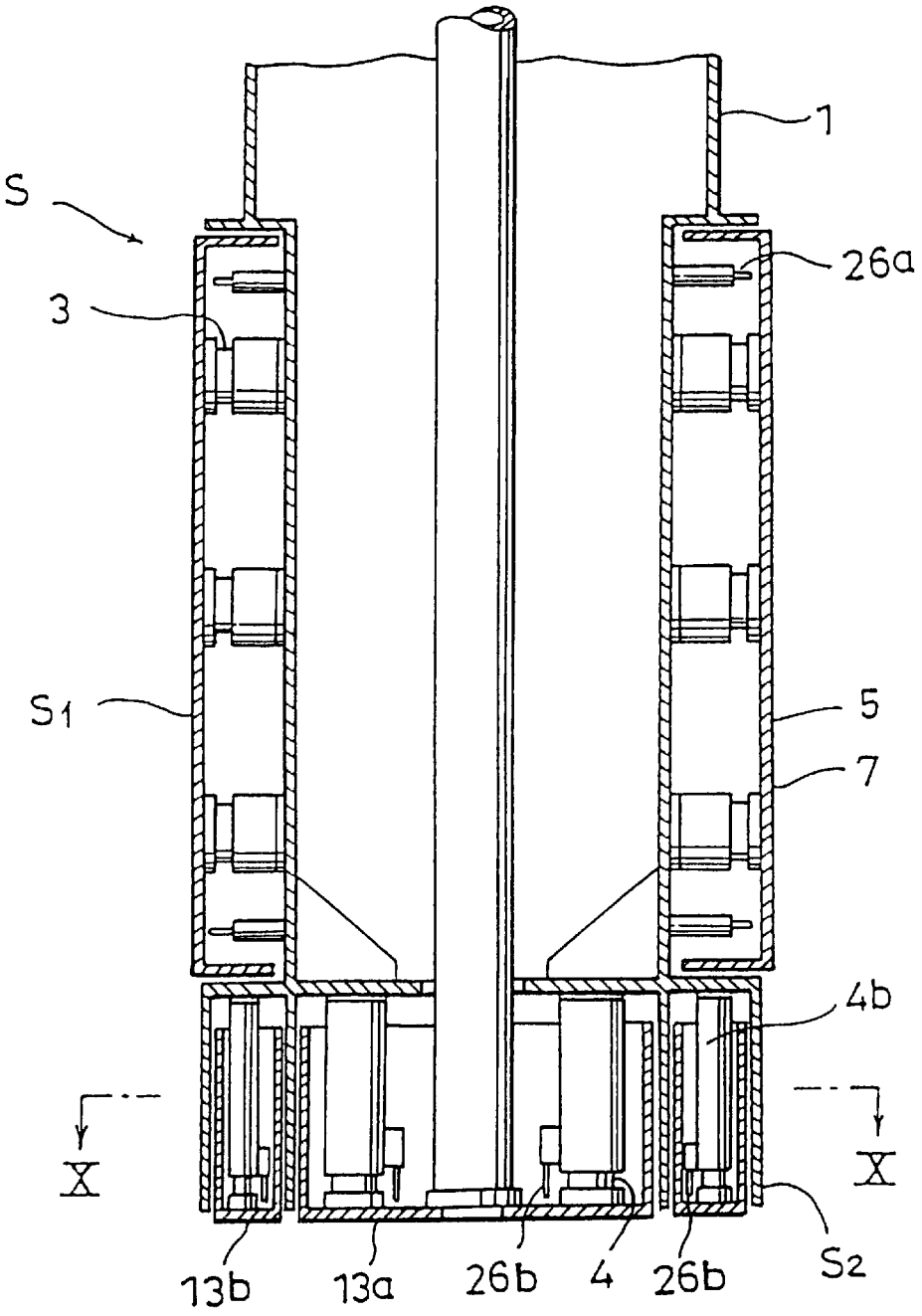
FIG. 9 is a sectional view of a ground characteristics analyzer of still another embodiment of the present invention.
Figure 10:
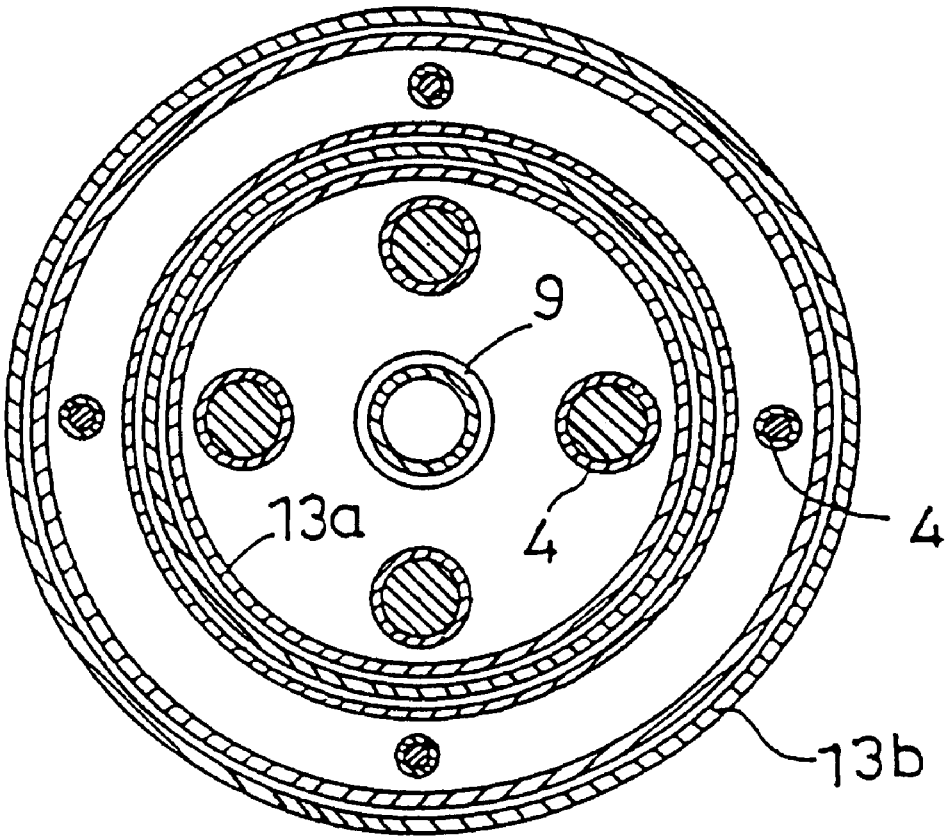
FIG. 10 is a sectional view about the line X—X of FIG. 9.

FIGS. 9 and 10 show another (i.e., the second type) embodiment of a vertical presser S2. The vertical presser S2 has a vertical pressing board 13 at its end divided into a pressing board 13*a* and a ring-shaped pressing board 13*b*. The pressing board 13*a* at the center portion is connected to the vertical cylinder 4 similar to the above while the ring-shaped pressing board 13*b* is connected to a vertical cylinder 4*b*. The pressing boards 13*a* and 13*b* works individually.

Thus, when the vertical pressing board is divided into sections, each of the sections is provided with a position sensor 26*b* so that the displacement of each section can be determined.

In this embodiment, in determining the shaft bearing capacity and deformation of the pile, the ring-shaped pressing board 13*b* and the pressing board 13*a* at the center portion can work individually, whereby it is possible that after the center portion of the bottom ground of the hole is pressed, the peripheral portion of the hole is pressed (while the bottom ground of the hole is kept pressed, or after the pressing is released). The order of pressing can be reversed. In this way, the pressing is selectively performed in accordance with the type of soil or hardness of the the bottom ground of the hole. Even if the bottom ground is pressed by either of the ring-shaped pressing board 13*b* or the pressing board 13*a* at the center, the stress of the bottom ground can be determined and analyzed.

In pressing the bottom ground of the hole, the pressing force applied by the horizontal cylinder 3 to the peripheral ground, or reaction force of the friction force caused by the pressing face 7 and the peripheral ground is used as reaction force. When the friction force is insufficient, the horizontal presser S1 should be made longer or a plurality of the horizontal pressers S1 should be disposed at intervals across the entire length of the casing. The pressing face is divided into the peripheral portion and the center portion so that effective pressing against the bottom ground of the hole can be attained. When the friction force is insufficient at the peripheral ground, or when the bottom ground of the hole is hard, for example, the reaction force becomes sufficient by pressing individually the peripheral portion and the center portion one after another, so that the determination of the pressing can be performed.

Figure 11:
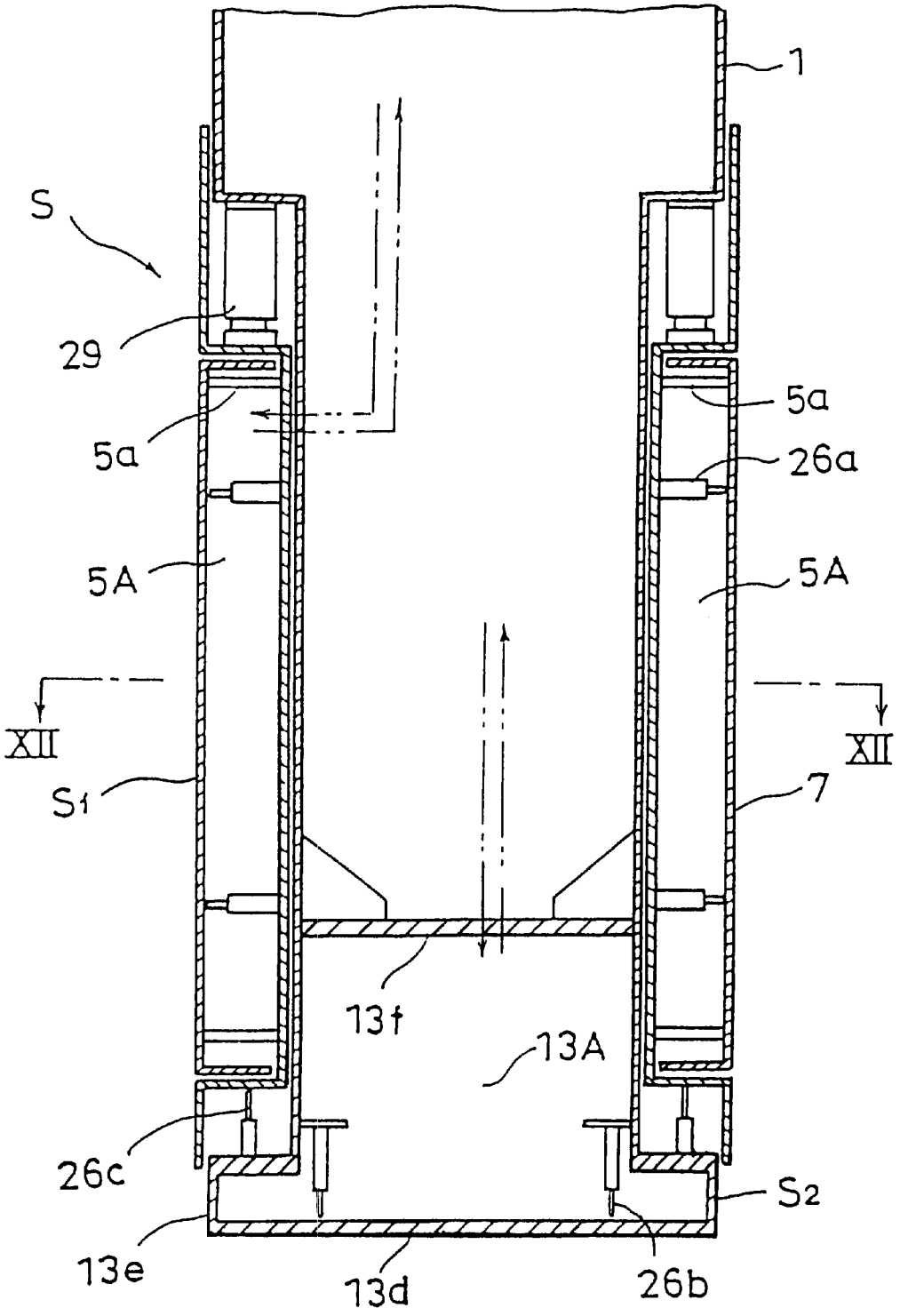
FIG. 11 is a sectional view of a ground characteristics analyzer of yet another embodiment of the present invention.

FIG. 11 shows still another (i.e., the third type) embodiment of the vertical presser S2. A tightly sealed pressing chamber 13A is formed of a cylindrical member 13*e* connected to the bottom frame of the ground characteristics analyzer S, a vertical pressing face 13*d*, a body frame and a lid plate 13*f* at the end of the ground characteristics analyzer S. In this case, the vertical pressing face 13*d* is made of elastic materials such as rubber, plastic and thin iron plate, or the cylindrical member 13*e* is formed of elastic material. A pressure supply hose is connected to the pressing chamber 13A. When oil or the like is supplied from above the ground, the pressing face 13*d* swells and protrudes due to the hydraulic pressure to press the bottom ground of the hole. In this cases the degree of swelling or protruding of the pressing face 13*d* is determined by the amount of oil delivered or by the position sensors.

Figure 12:
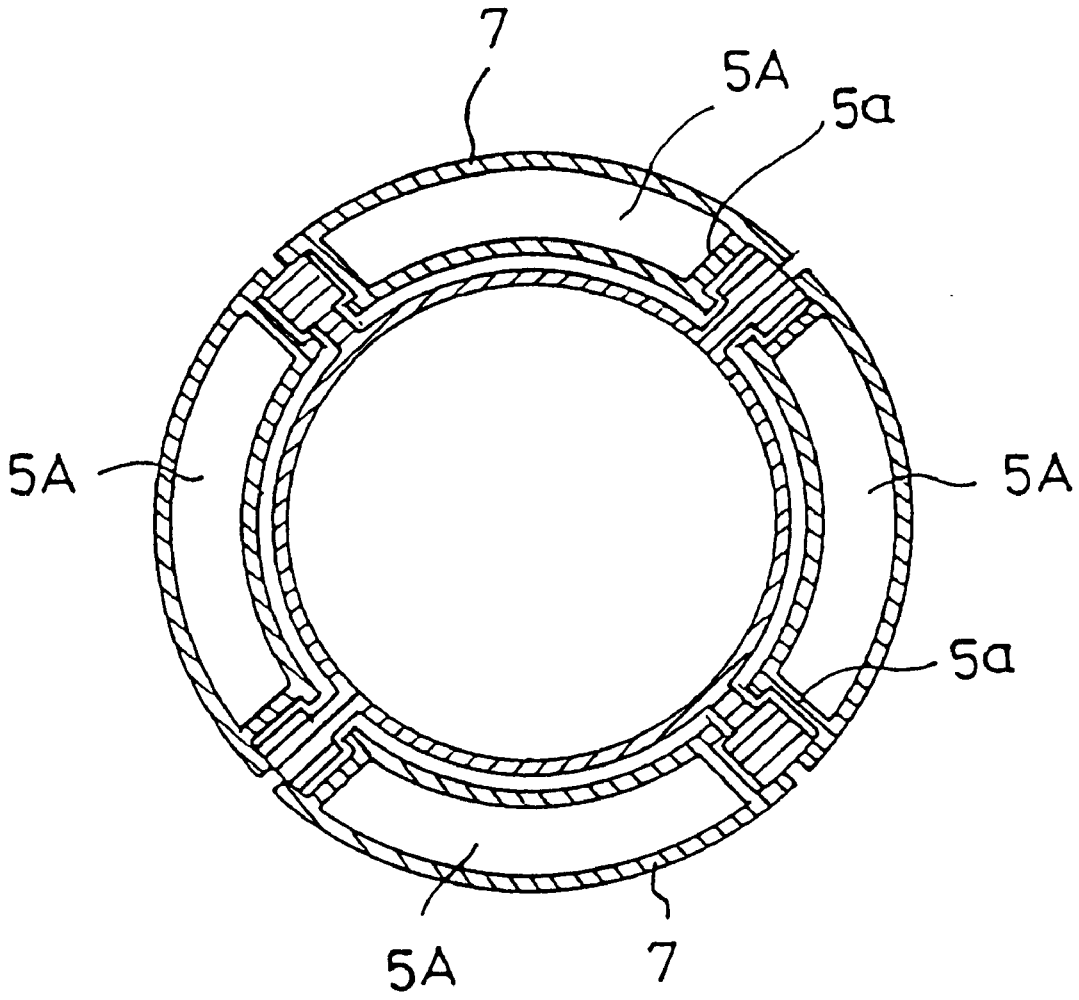
FIG. 12 is a sectional view about the line XII—XII of FIG. 11.

FIGS. 11 and 12 show another (i.e., the second type) embodiment of the horizontal presser S1. Multisections (four sections) are disposed on the outer peripheral surface of the ground characteristics analyzer S, each of the sections is a tightly sealed chamber 5A having a double-pipe structure. Each pressing face 7 of the chambers 5A is made of elastic materials such as rubber, plastic and a thin iron plate, or frames 5*a* connecting inner and outer ring members are formed of elastic materials. A pressure supply hose is connected to each chamber, so that when oil or the like is supplied from above the ground, the pressing faces 7 protrudes and expands due to the hydraulic pressure to press the surrounding ground of the hole. In this case, the degree of the protrusion and expansion is determined by the amount of oil delivered or by the position sensor.

Then, methods of analyzing characteristics of soil and piles, determining capability and quality of the piles and of designing foundation piles using the ground characteristics analyzer by deforming the ground within the hole simultaneously with executing the construction will be described in detail with reference to flow diagrams shown in FIGS. 13 to 21 in accordance with the practical steps of the methods.

The present invention includes a method A including the steps of analyzing the characteristics of soil and a pile, and decide whether the pile is suitable for the design simultaneously with executing the construction, and a method B including the steps of analyzing the characteristics of soil and a pile simultaneously with executing the construction to design the pile. The present invention further includes presenting certification of capability and quality of a designed pile.

(1) Method A (FIGS. 13 to 16)

Figure 13:
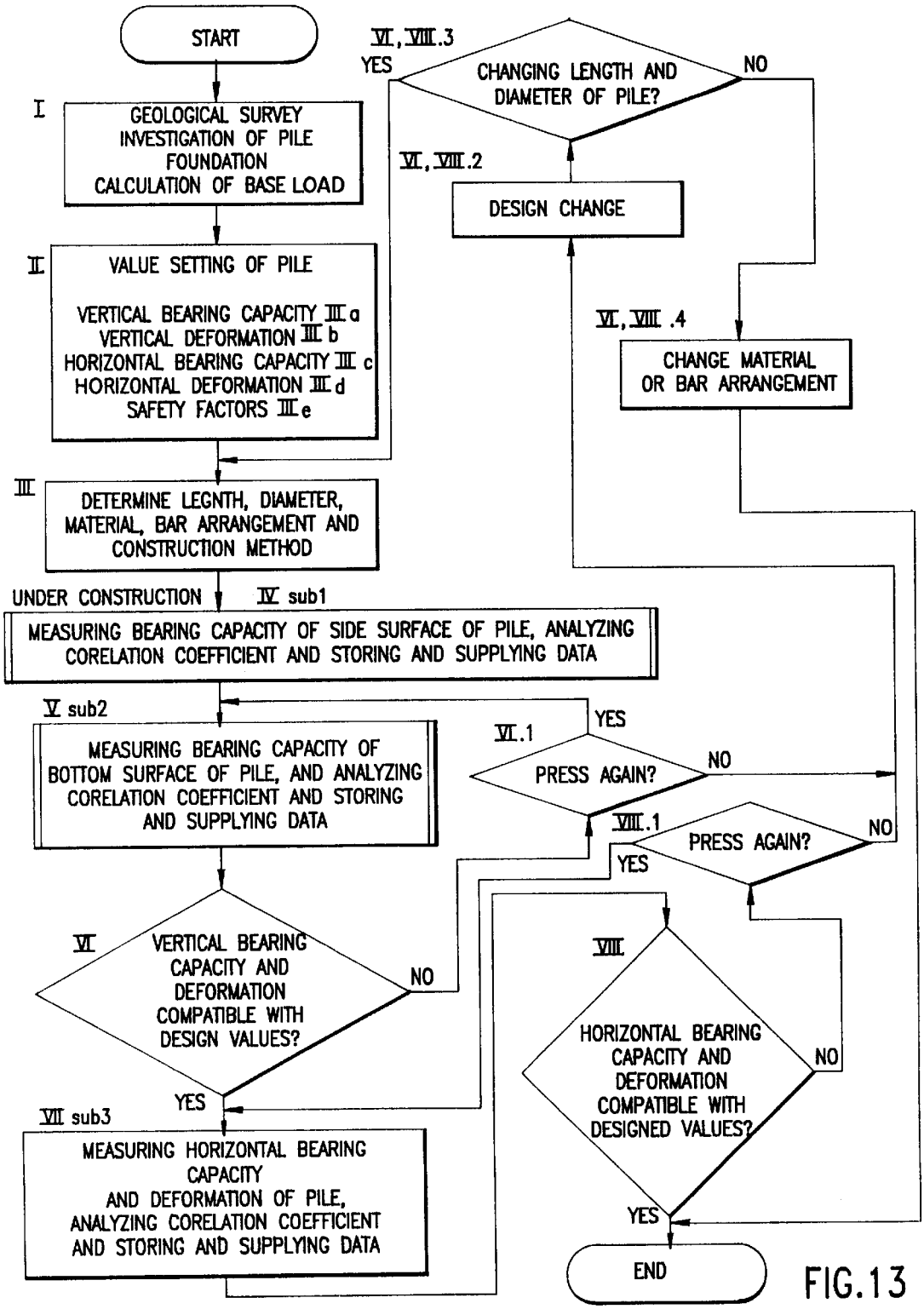
FIG. 13 is a main flow diagram showing an embodiment of the method of determining capability and quality of foundation piles and the method of designing foundation piles according to the present invention.
Figure 14:
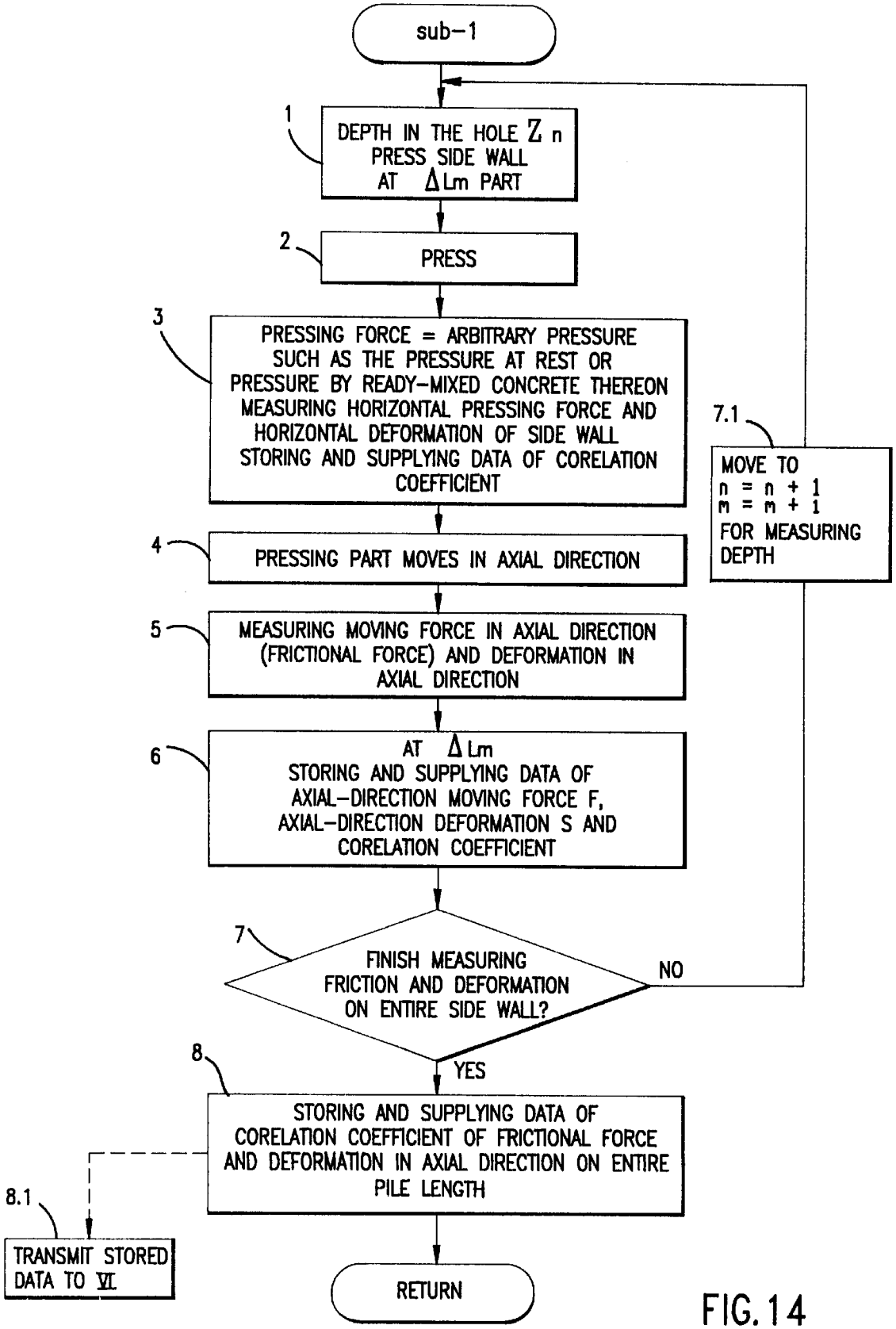
FIG. 14 is a flow diagram of a subroutine Sub1 in FIG. 13.
Figure 15:
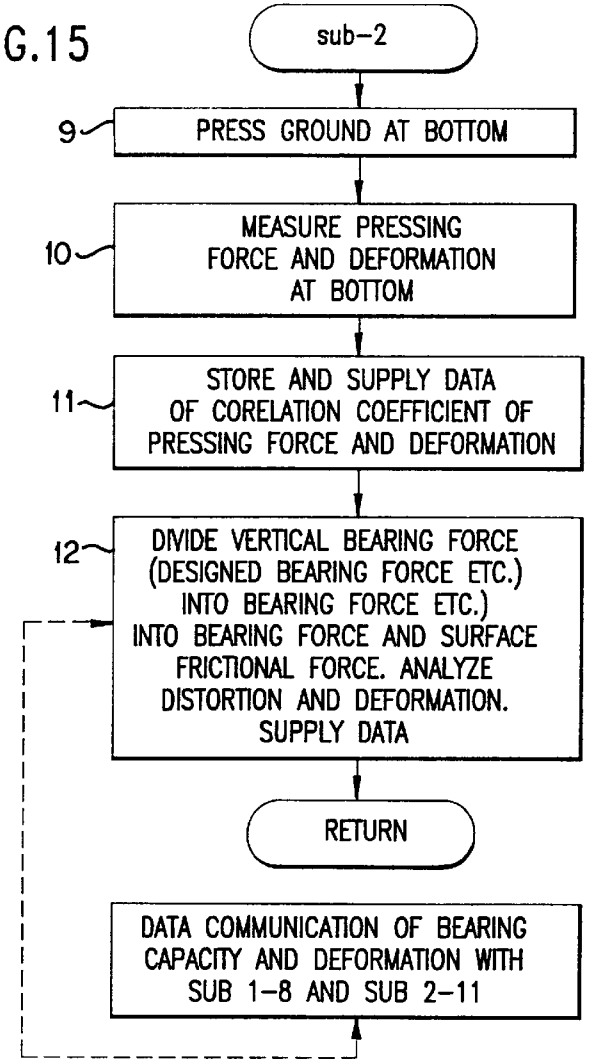
FIG. 15 is a flow diagram of a subroutine Sub2 in FIG. 13.
Figure 16:
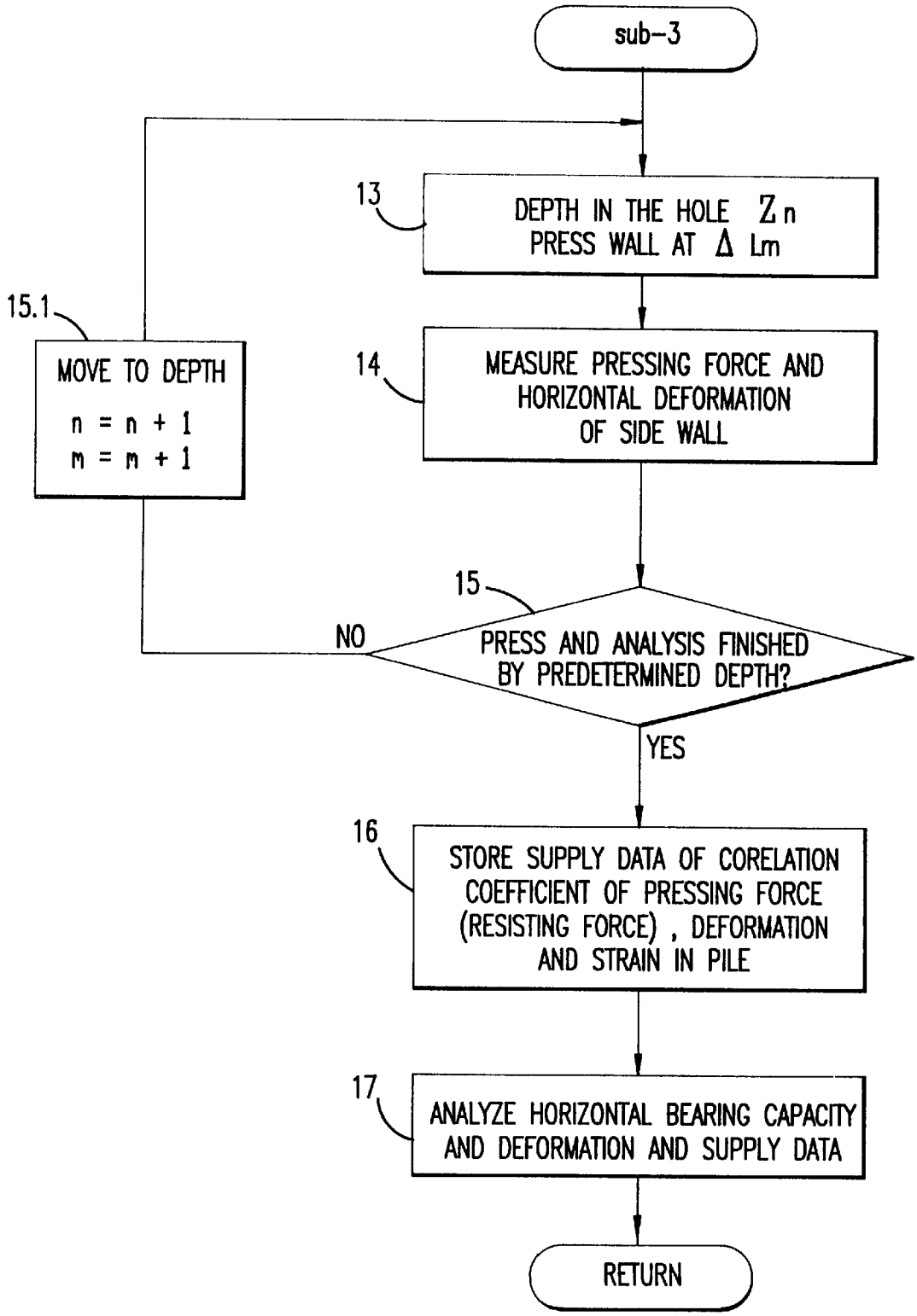
FIG. 16 is a flow diagram of a subroutine Sub3 in FIG. 13.

FIG. 13 shows the main flow of a method A, and FIGS. 14 to 16 show subflows thereof.

Step I The load for each foundation is calculated from loads applied to a structure, external forces applied to the structure, and the like. In addition, a geological survey is made, to investigate the foundation of a pile.

Step II As a result, the vertical bearing capacity, the horizontal bearing capacity, the allowable deformation, the safety factor and the like of the pile are set as design values.

Step III Simultaneously, the length of the pile, the diameter of the pile, methods of construction and the like are investigated.

This method is used for measuring, analyzing and determining the pile adaptable to the design values set in the step II during construction by the following method as well as for ensuring the capability and the quality of the pile.

Step IV—subroutine Sub1 The shaft bearing capacity of the pile and the deformation thereof are measured, the correlation therebetween is analyzed, and data thereof are stored and provided. The details thereof is shown in FIG. 14.

Step 1 A casing 1 is suspended in a hole in the ground, to be stopped such that a ground characteristics analyzer S is in the position at a constant depth of Zn. A horizontal cylinder 3 is then operated. A pressing frame 5 is extended to the periphery from the ground characteristics analyzer S, to press a surrounding ground in the hole; that is, a surrounding ground of the hole (a portion of $\Delta Lm$); to slightly deform it. When the above described surrounding ground of the hole is pressed, the pressing force exerted by the horizontal cylinder 3 is measured by a pressure sensor 24*a* (measured value= H1), and the amount of extension (deformation) of the horizontal cylinder 3 or the deformation in the horizontal direction of the pressing frame 5; that is, the displacement of the ground; is measured by a position sensor 26*a* (measured value X1). The amount of extension (deformation) of the horizontal cylinder 3 may be measured by a flow meter 25*a*. The measured values H1 and X1 are converted into electrical signals and transmitted to a pile bearing capacity analyzing/operating unit K installed on the ground, to be stored and provided as data on correlation between H1 and X1, respectively.

Step 2 The pressing force exerted by the horizontal cylinder 3 is then gradually increased.

Step 3 The increase is continued up to the pressing force H1 takes a value corresponding to an arbitrary pressure such as the earth pressure at rest or pressure of ready-mixed concrete filled later.

Step 4 A shaft moving cylinder 29 is operated, to move the pressing frame 5 axially in the hole with the surrounding ground of the hole being pressed.

Step 5 The pressing force of the above described shaft moving cylinder 29; that is, the moving force F; is measured by a pressure sensor 24*c* (measured value=F), and the amount of extension (deformation) of the cylinder 29 or the amount of axial movement of the pressing frame 3 or deformation is measured by a position sensor 26*c* (measured value S). The amount of extension (deformation) of the cylinder 29 may be measured by a flow meter 25*c*.

Figure 22:
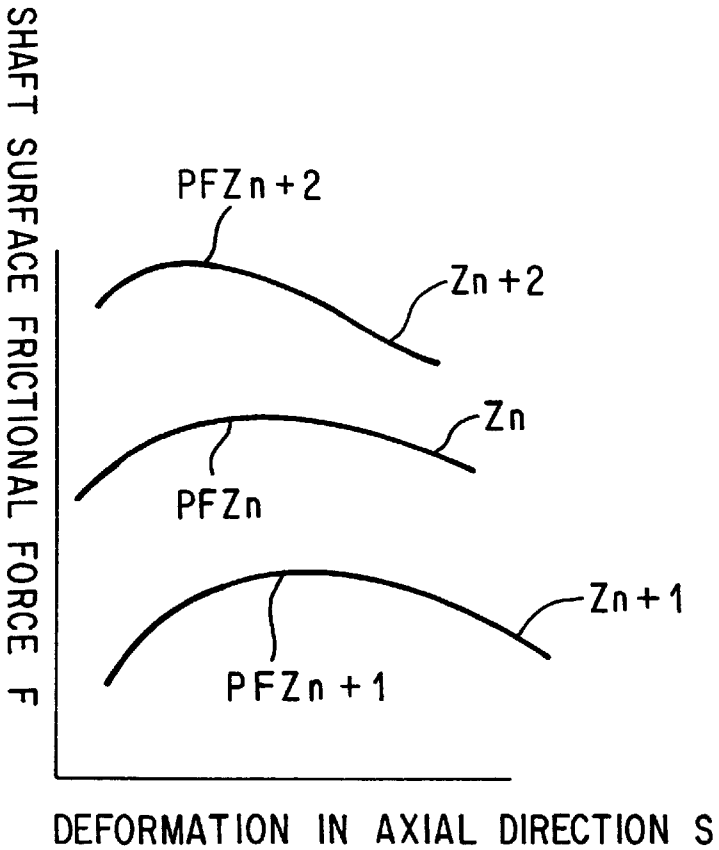
FIG. 22 is a diagram showing correlations between the deformation S in the axial direction and the friction force F on the shaft surface measured by the methods of determining capability and quality of foundation piles and of designing foundation piles according to the present invention.

Step 6 The respective measured values F and S are converted into electric signals and transmitted to the pile bearing capacity analyzing/operating unit K on the ground to be analyzed and stored as data on the correlation between the axial moving force F and the axial deformation S as shown in FIG. 22. In this case, the measured value F is measured by axially moving the pressing force of the horizontal cylinder 3 when it corresponds to the earth pressure at rest or the like. Accordingly, the measured value corresponds to a frictional force Fzn of the pile shaft surface, whose settlement is Szn, at a measured depth of Zn. A peak value Fzn,p of the frictional force of the shaft surface is, therefore, also obtained.

Step 7, 7.1 When predetermined pressing, measurement and transmission are terminated, ground characteristics analyzer S is moved to a further downward position at a depth of Z (n+1). Pressing, measurement and transmission of a portion of ΔL (m+1) are repeated in the above described manner up to the ground characteristics analyzer S reaches the bottom of the hole.

Step 8 After pressing, detecting and transmitting with regard to the entire length of the side wall of the hole, stored are data of correlation coefficient between moving force F in the direction of the axis at each ΔL, or shaft friction force F, and axial-direction deformation S. The data are analyzed with the vertical bearing capacity and deformation in the determining timing of press in the flow diagram 12. In FIG. 22, Z(n+1) and Z(n+2) mean the data of correlation coefficients of the axial deformation and the circumferential friction force at the depth Z(n+1) and Z(n+2).

The data of correlation coefficients of the shaft friction force F and the axial deformation S stored at steps 6 and 8 are immediately outputted to a printer or the like just at the construction site.

Step V—Subroutine 2 End bearing capacity and pile tip settlement are detected, and the data of correlation coefficients are stored and presented. Referring to FIG. 15, the details are described in the following:

Step 9 After the apparatus arrived at the bottom of the hole, the horizontal cylinder 3 is performed to expand the pressing flames 5 outward from the ground characteristics analyzer S, so that the peripheral ground at the hole bottom is pressed. Then, keeping the above pressing condition, the vertical cylinders 4 are actuated to put down the vertical pressing board 13, so that the bottom ground in the hole is pressed to deform.

Step 10 The pressing force of the vertical cylinders 4 is detected by the pressure sensor 24*b* (detected value P1). The expansion (deformation) of the vertical cylinders 4 and downward deformation in the axial direction of the vertical pressing board 13, or the deformation of the bottom ground, are detected by the position sensor 26*b* (detected value Y1). The expansion (deformation) of the vertical cylinders 4 may be detected by the flow meter 25*b*.

Figure 23:
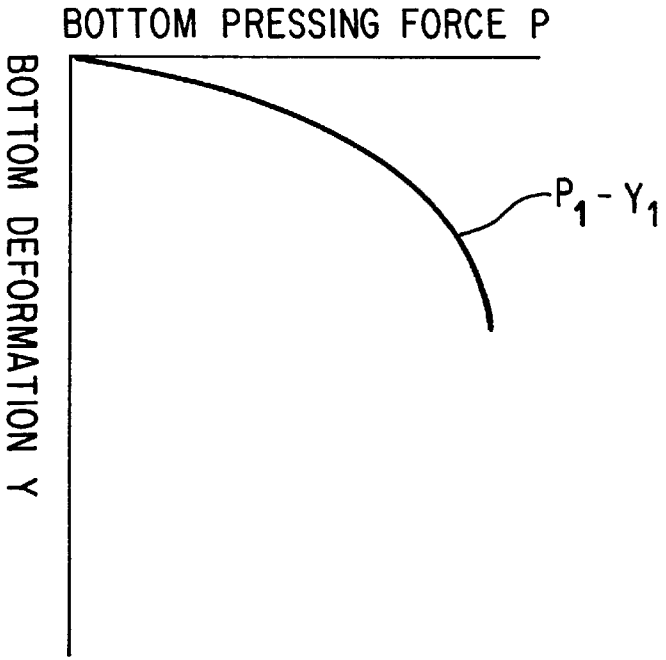
FIG. 23 is a diagram showing correlations between the pressing force P1 to the bottom of a hole and the deformation Y1 measured by the methods of determining capability and quality of foundation piles and of designing foundation piles according to the present invention.

Step 11 The measured values P1,Y1 are converted into electric signals, transmitted to the pile bearing capacity analyzing/operating devise K located on the ground. The measured values are stored and presented as the data of the PY correlation coefficients of the bottom pressing force, as shown in FIG. 23.

Step 12 The stored data of the correlation coefficients of the bottom pressing force and the bottom deformation are analyzed together with the data of the correlation coefficients of the axial-direction friction force and the axial-direction deformation. Dividing a vertical bearing capacity such as the designed vertical bearing capacity into the end bearing capacity and the shaft bearing capacity, the pile strain and deformation are analyzed. The data obtained through the analysis are printed out together with the data of correlation coefficients.

Step VI If the vertical bearing capacity and the deformation as results from the analysis are in conformation with designed values, it is immediately printed out at the construction sight that the values are in conformation with the designed values, so that the sufficient capability and quality of the pile are certified. Then, the horizontal supporting capacity and deformation are investigated.

Step VI.1 If the obtained data are not sufficient comparing with the designed values, the bottom ground is pressed again as in the following, and the measurement and the analysis are similarly carried out. First, the return valve (electromagnetic valve) is opened so that the pressure at the bottom is released. In this way, the bottom ground tends to rebound due to its elasto-plasticity. The rebounding force of the ground is detected by the pressure sensor 24*b* as a load on the cylinder 4 (detected value=P2). The rebounding amount of the ground, corresponding to the compression, or the travel distance of the vertical pressing board, is detected by the position sensor 26*b* (detected value=Y2). These detected values P2 and Y2 are converted into electric signals and transmitted to the pile bearing capacity analyzing/operating devise K.

Figure 24:
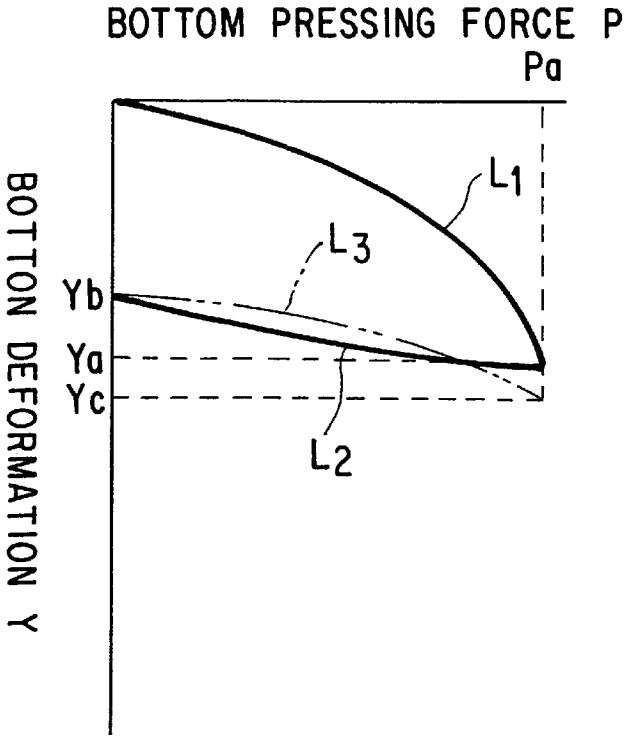
FIG. 24 is a diagram showing correlations between the pressing force P2 to the bottom of a hole and the deformation Y2 in re-pressing of the ground, measured by the methods of determining capability and quality of foundation piles and of designing foundation piles according to the present invention.
Figure 27:
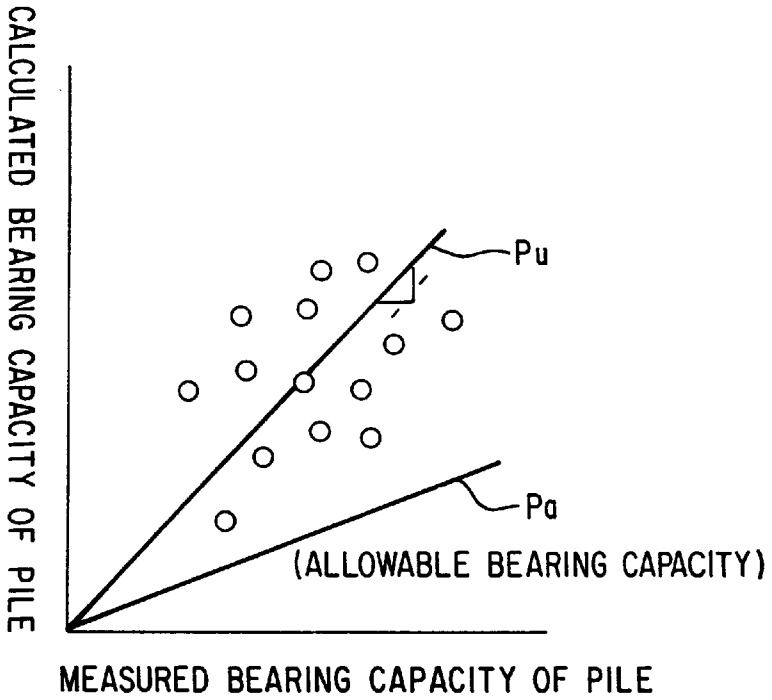
FIG. 27 is a diagram presented for explaining the relations between the value of the ground characteristics for a pile constructed in the actual ground, obtained by the loading test using a conventional method, and the value of the ground characteristics for a pile, obtained by empirical formulae.
Figure 26:
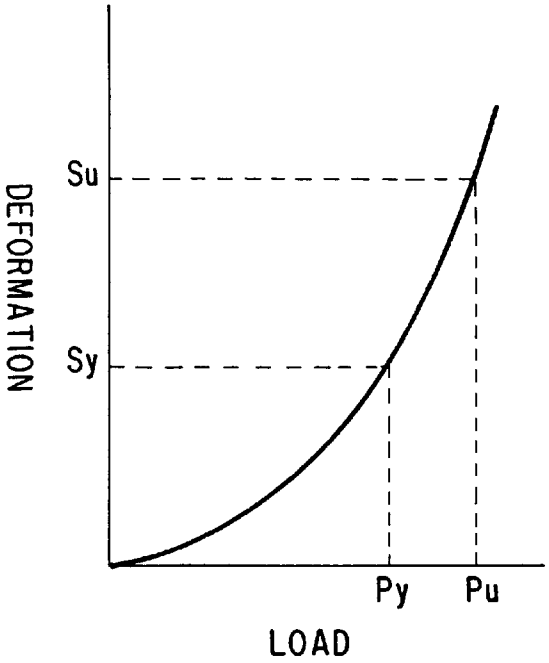
FIG. 26 is a diagram presented for explaining the relations between the load and the deformation of a foundation pile constructed in the actual ground in the loading test using a conventional method.

Step V The measured values and data about the end pressing force and deformation when the ground is pressed again are analyzed and stored as follows. The data about the correlations are shown in FIG. 24. The L1 curve shows the relations between the pressing force and the deformation in pressing, and the L2 curve shows the relations between the rebounding force and the deformation. Pa is a end pressing force when an arbitrary vertical bearing capacity such as design bearing capacity is analyzed, and Ya is the deformation at that time. Yb is the deformation when the ground rebounds because of release from the pressing force and the rebounding force becomes 0. The deformation Yb is generally smaller than the deformation Ya, and complete rebounding can not be attained because the ground is elasto-plastic. The L3 curve shows the relations between the pressing force and deformation when the pressing is repeated in this state (deformation 0). The deformation (Yc−Yb) when the end pressing force is Pa is smaller than the deformation Ya, because the ground is compacted by the first pressing. Further, the repetition of the pressing and release operation makes the deformation much smaller.

The data about the correlations between the end pressing force and end deformation stored above are analyzed together with the data about the correlations between the axial direction fiction force and the axial direction deformation. Since the deformation is smaller than that in the first analysis, the analyzed end bearing capacity, the shaft friction force, strains and the deformation of a pile are varied. As a result the values of the analyzed vertical bearing capacity and the deformation satisfy the design values, and then the analysis data, etc. are printed out for presentation.

Step VI.2 If the vertical bearing capacity or the deformation is not in agreement with the design value even by the aforementioned repetition of the pressing, the design is changed to satisfy the vertical bearing capacity and the deformation set in the preliminary design.

Step VI.3 The design such as the diameter and length of the pile is changed using the data obtained by measuring and analyzing at the above steps.

Step VI.4 The material of the pile and the arrangement of bar are also changed.

Step VII—subroutine Sub3 The measurement of the horizontal bearing capacity and deformation of the pile and the storage of data about the correlation about them are performed. In this case, the horizontal force and the bending moment are mainly applied to the upper portion of the pile, and therefore the operation is carried out at the upper part of bored hole. The details are shown in FIG. 16.

Step 13 After the measurement and decision of the vertical bearing capacity and deformation are completed, the ground characteristics analyzer S is pulled up, and positioned at a specific depth An in the hole close to the ground. Then the horizontal cylinder 3 works so that the pressing frame 5 protrudes in the radial direction from the outer peripheral surface of the ground characteristics analyzer S to press the surrounding ground (ΔLm portion) so as to apply slight deformation to the surrounding ground.

Figure 25:
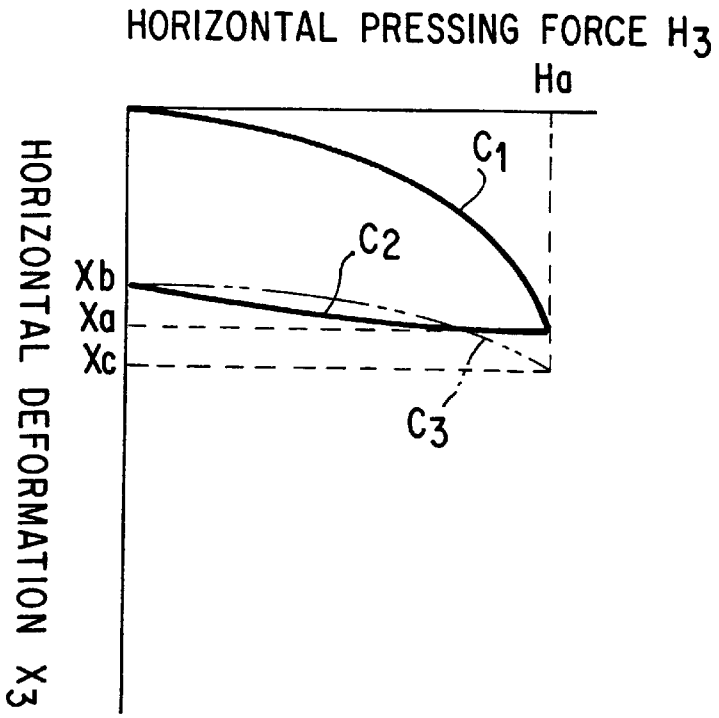
FIG. 25 is a diagram showing correlations between the horizontal pressing force H3 and the deformation X3 measured by the methods of determining capability and quality of foundation piles and of designing foundation piles according to the present invention.

Step 14 In the aforementioned pressing, the pressing force of the horizontal cylinder 3 is measured by the pressure sensor 24*a* (measured value=H3), the expansion (deformation) of the horizontal cylinder 3, or the horizontal deformation of the pressing frame 5, namely, the deformation of the surrounding ground, are measured by the position sensor 26*a* (measured value=X3). The expansion of the horizontal cylinder 3 (deformation) may be measured by the flow meter 25*a*. The measured values H3, X3 are converted into electric signals and transmitted to the pile bearing capacity analyzing/operating unit K on the ground. Each of the values are stored as the data about the correlations between the horizontal pressing force (resistance force) and the deformations H3 and X3, as shown by the curve C1 in FIG. 25.

In this figure, Xa shows the deformation of the surrounding ground when the horizontal pressing force H3 reaches a predetermined pressing force Ha corresponding to the design horizontal bearing capacity, etc. The curve C2 shows the correlations between the rebounding force and the deformation of the surrounding ground when the ground is released from the pressing of the horizontal cylinder 3, and the deformation when the rebounding force becomes 0 is shown by Xb.

Step 15 After the pressing, the measuring and the signal transmission are completed, the ground characteristics analyzer S suspended is put down to the position Z (n+1). Similar to the above, ΔL (m+1) portion is pressed, measured and the data are transmitted. This operation is repeated until the ground characteristics analyzer S reaches a predetermined depth, or a predetermined depth where the horizontal force and the bending moment are mainly applied.

Step 16 After the predetermined pressing, measuring and signal transmission are completed, the data about the correlations among the pressing force (resistance force), deformation and strains of the pile material in ΔLm are stored.

Step 17 Based upon the above correlation data, the horizontal bearing capacity and deformation are analyzed. The data about the correlations at the step 16, and the analysis data at the step 17 are printed out for presentation.

Step VIII As a result of the above measuring and analysis, if it is judged that the values of the analyzed horizontal bearing capacity and the deformation are in agreement with the design values, the result is immediately printed out just at the construction site, and the certification of the capability and quality of the pile is presented. Thus, the decision in this system is completed.

Step VIII.1 If the measured values do not satisfy the design standard, the surrounding ground is pressed, measured and analyzed again as in the case of the bottom ground. In this case, the relationship between the pressing force and the deformation is represented with the curve C3. Similar to the case of the pressing of the bottom ground, the deformation (Xc−Xb) of the surrounding ground when the horizontal pressing force is Ha is smaller than the deformation Xa at the first pressing. The repetition of the pressing—release makes the deformation much smaller.

The data about the correlations between the pressing force and the deformation are analyzed similar to the analysis at the step 17. However, since the deformation is smaller than that in the first release, the analyzed horizontal bearing capacity and deformation and the strains of the pile material are varied.

Step VIII When the values of the analyzed horizontal bearing capacity and deformation is judged to be in agreement with the design values, the result is printed out to certificate the capability and quality of the pile. Thus, the pressing measurement in this method is completed.

Step VIII.2 When the horizontal bearing capacity or deformation is not in agreement with the design value in the repetition of the pressing, the design is changed so as to satisfy the horizontal bearing capacity and deformation set in the preliminary design.

Step VIII.3 Based upon the data of the above analysis, the design of the length, diameter, etc. of the pile is changed.

Step VIII.4 The material of the pile, the arrangement of bar, etc. are also changed. In the design change at the step VIII.3 and VIII.4, only the upper portion of the pile to which the horizontal force is mainly applied may be changed.

(2) Method B (FIGS. 17 to 21)

Figure 17:
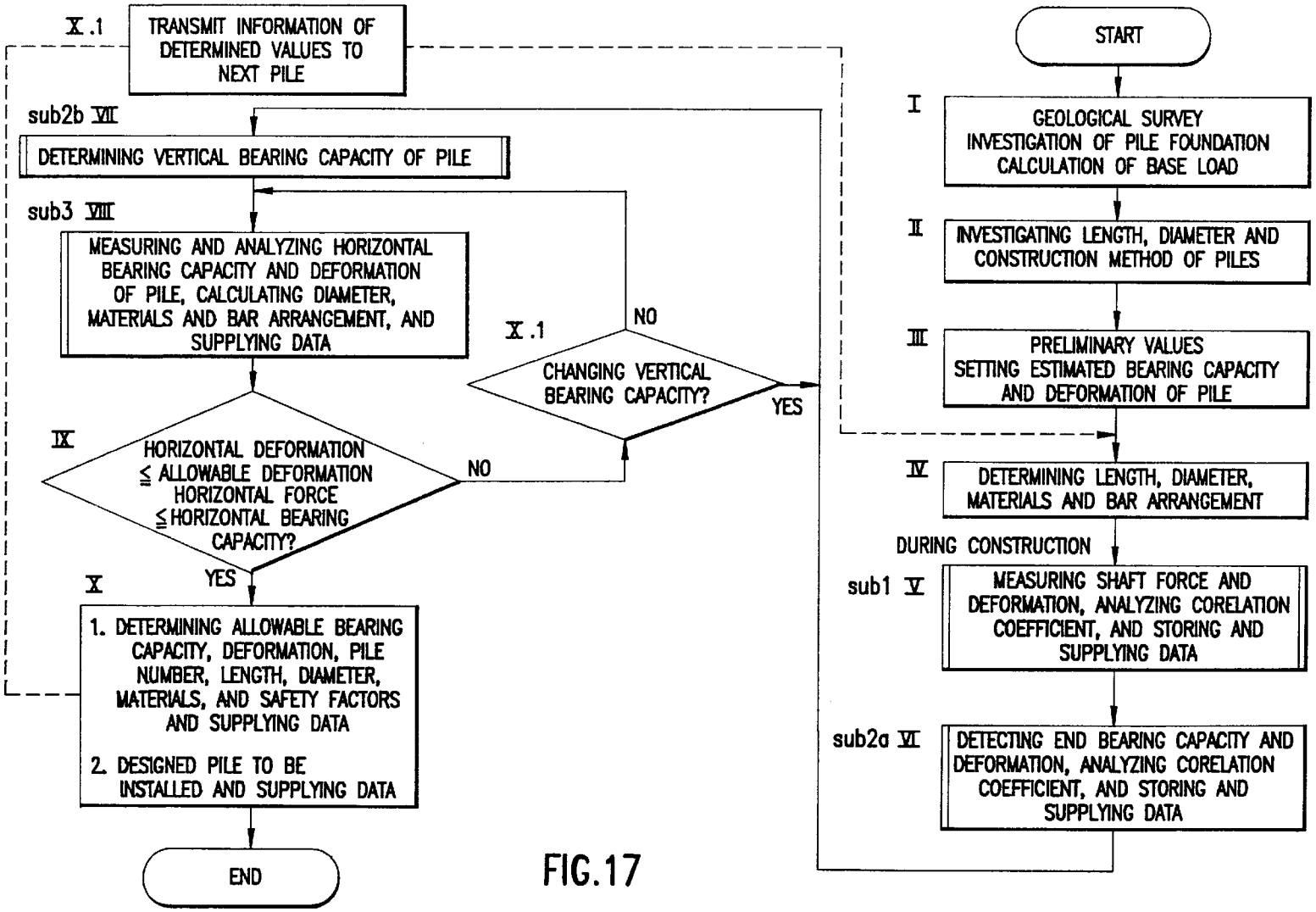
FIG. 17 is a main flow diagram showing another embodiment of methods of determining capability and quality of foundation piles and of designing foundation piles according to the present invention.

Unlike the method A, the method B is for analyzing the characteristics of soil and a pile simultaneously with executing the construction to design a pile suitable to the ground in which the pile is constructed. FIG. 17 is a main flow diagram, and FIGS. 18 to 21 are sub flow diagrams.

Step I Similar to the method A, the load for each foundation base is calculated based upon the load of a structure, external force applied to the structure, etc., geological survey is carried out, and the foundation piles are decided.

Step II The length, the diameter of the pile and the method of the construction are investigated.

Step III As a result, the bearing capacity of the pile and the deformation thereof are temporarily set.

Step IV The length, the diameter and the material of the pile and the arrangement of bar are determined.

The present invention is to provide a method of analyzing the characteristics of a pile, such as the length and the diameter, which are temporarily determined at step IV, simultaneously with executing the construction to design piles suitable to the ground.

Figure 18:
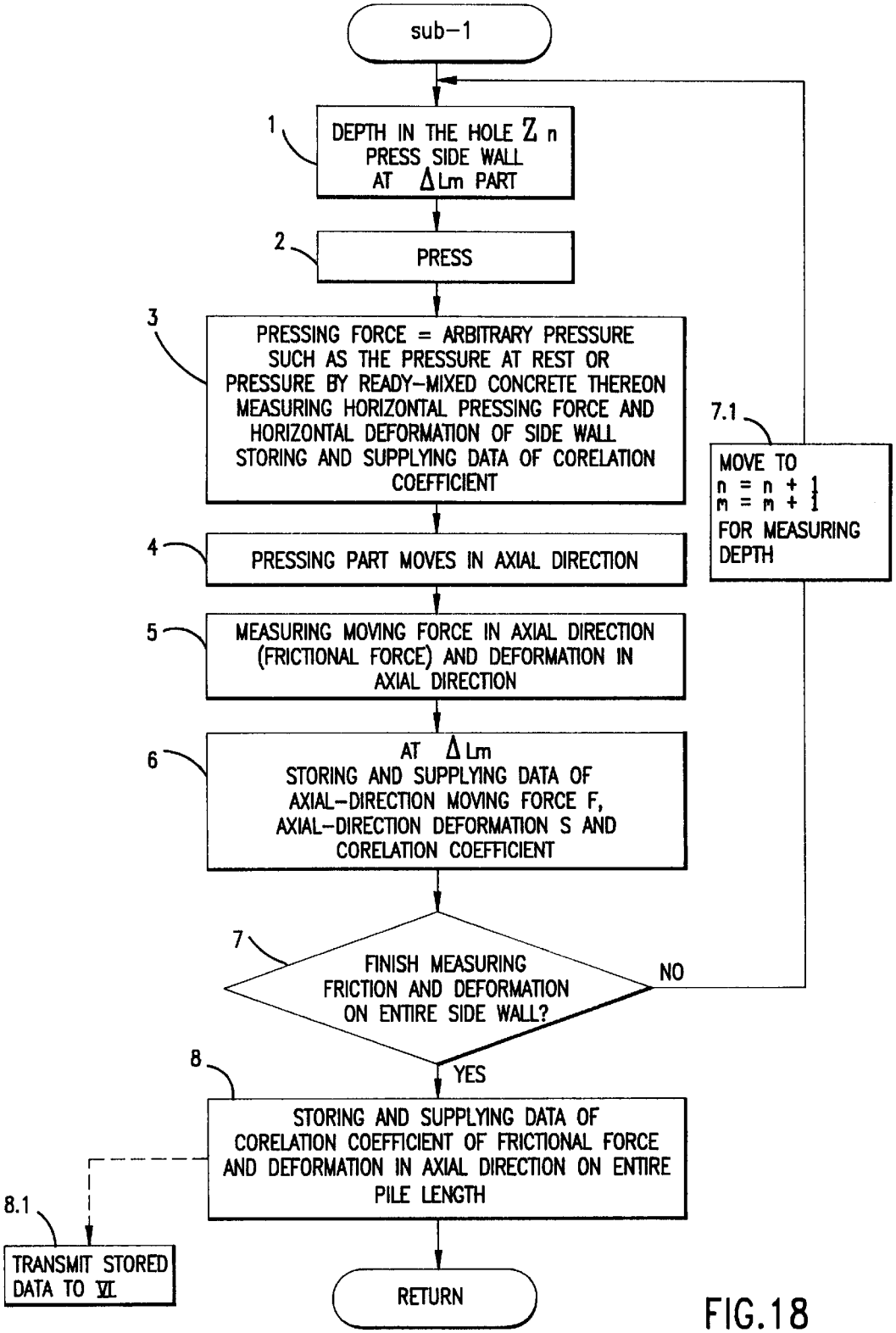
FIG. 18 is a flow diagram of a subroutine Sub1 in FIG. 17.

Step V—subroutine Sub1 First, the shaft bearing capacity and deformation of the pile are determined, the relations between them are analyzed and data about them are stored (FIG. 18). Since this step is similar to the steps 1 to 8 of the method A, the explanation is omitted.

Figure 19:
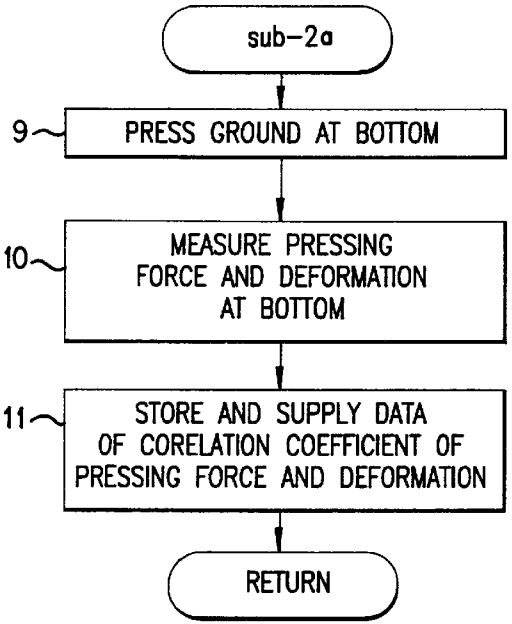
FIG. 19 is a flow diagram of a subroutine Sub2*a* in FIG. 17.

Step VI—subroutine Sub2*a* Then, the end bearing capacity and deformation of the pile is determined, the relations between them are analyzed and the data about them are stored. The details are shown in FIG. 19.

Step 9 The bottom ground of the hole is pressed and deformed as previously determined.

Step 10 The pressing force, or the stress and deformation of the bottom ground are determined.

Step 11 The data about the relations between the end pressing force (stress) and deformation are stored and presented.

The procedure in the steps 9 to 11 is similar to that in the method A.

Figure 20:
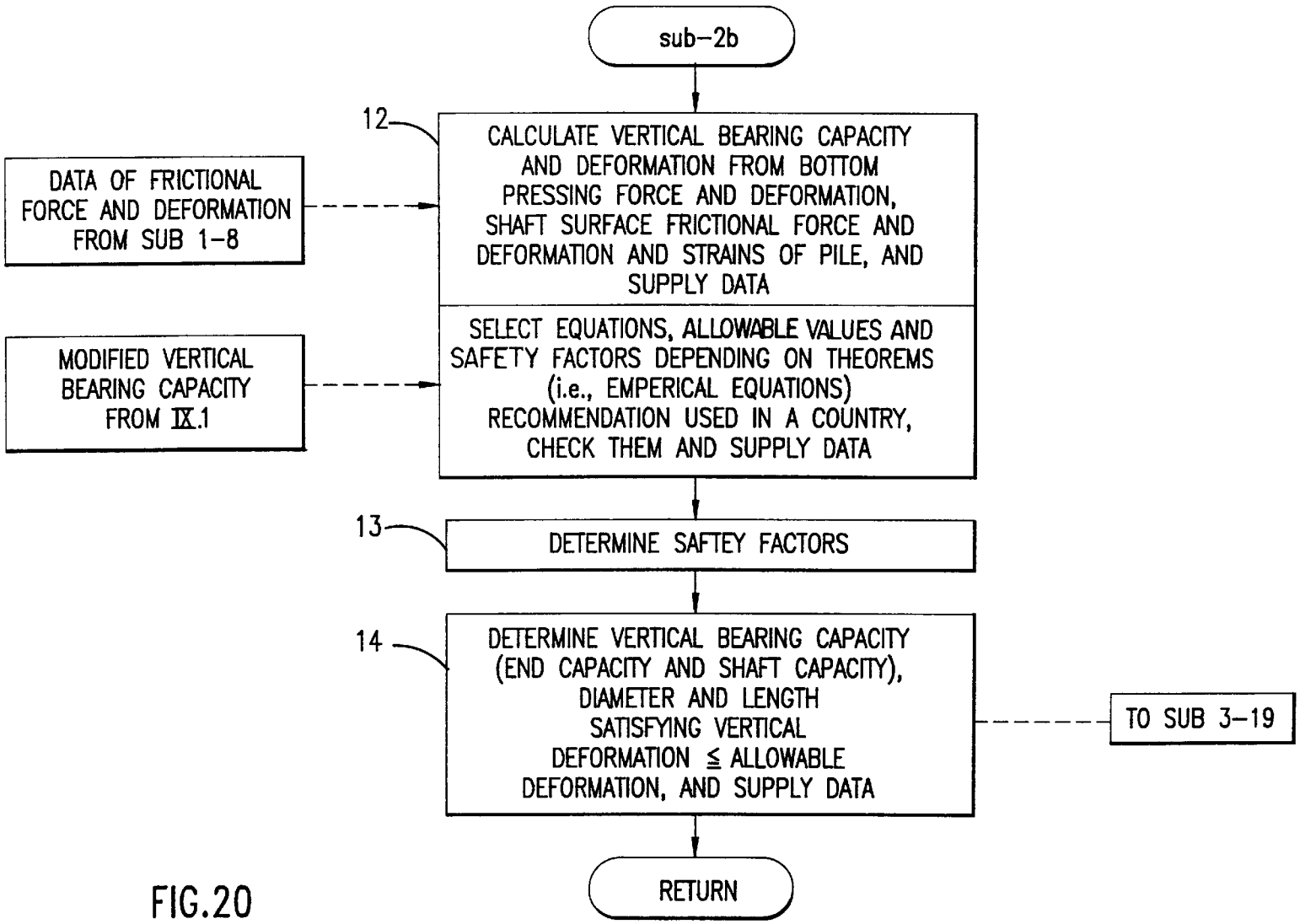
FIG. 20 is a flow diagram of a subroutine Sub2*b* in FIG. 17.

Step VII—subroutine Sub2*b* The vertical bearing capacity of the pile is determined. The details are shown in FIG. 20.

Step 12 The stored data about the relations between the end pressing force and the end deformation are analyzed together with the data stored at the step 8, about the relations between the shaft friction force and the deformation in the axial direction and the strain of the pile material, and various calculation about the vertical bearing capacity and the deformation are performed. In this case, the calculation formulae and the like are selected from the inputted and stored various theoretical formulae and various standards used in various countries. Analysis and operation to check allowable values of the bearing capacity and deformation of the pile and the degree of safety are carried out. The various calculation, operation, analysis results and data are immediately outputted through printer or the like just at the construction site.

Step 13 As a result, factor of safety is determined.

Step 14 The vertical deformation determines the vertical bearing capacity smaller than the allowable deformation acceptable to a structure, namely the end bearing capacity and the shaft bearing capacity, and further the length, diameter and material of the pile are determined. The values determined are printed out together with the factor of safety obtained at the step 13, and are used as data for analyzing the horizontal bearing capacity and deformation at the steps Sub 3 to 19.

Figure 21:
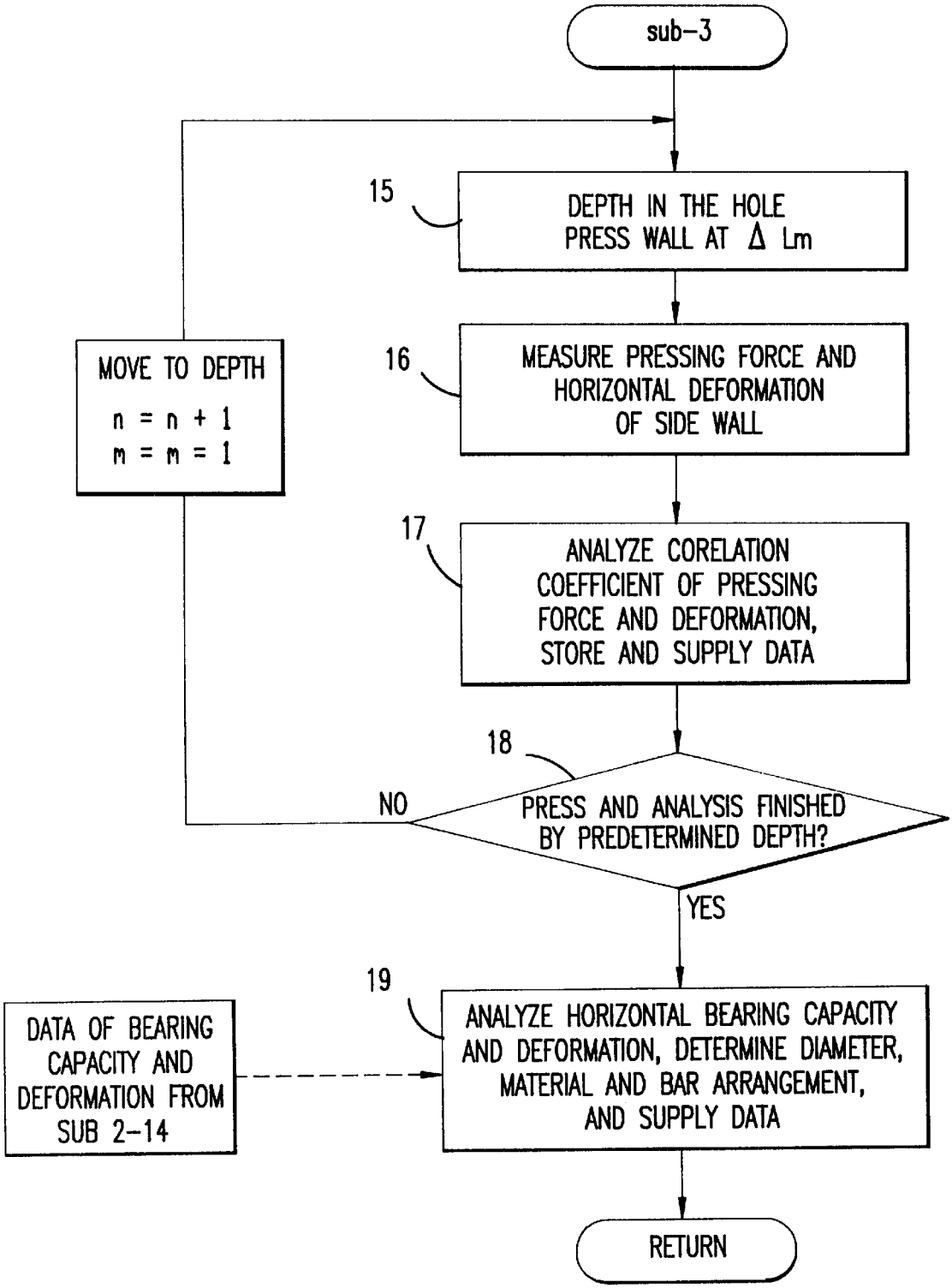
FIG. 21 is a flow diagram of a subroutine Sub3 in FIG. 17.

Step VIII—subroutine Sub3 Then, the horizontal bearing capacity and deformation of the pile are determined and analyzed, and the diameter and material of the pile and the arrangement of bar are calculated. At this time, similar to the method A, the pressing and determination are performed at the part in the hole close to the ground since the horizontal force and bending moment are mainly applied to the upper portion of the pile. The details are shown in FIG. 21.

Step 15 A part ΔLm of the surrounding ground is pressed and deformed.

Step 16 The pressing force, namely, the stress and horizontal deformation of the surrounding ground are determined.

Step 17 The correlations between the pressing force (stress) and the deformation are analyzed, and the data about them are stored and presented.

Step 18 The above steps are repeated up to a predetermined depth of the surrounding ground of the hole to which the horizontal force and bending moment are mainly applied. When the pressing, measurement and transmission are completed to the predetermined depth, the correlations between the pressing force and deformation at each ΔLm part and the strains of the pile material have been stored as data.

Step 19 Based upon the aforementioned data, the horizontal bearing force and deformation are analyzed, and the diameter and material of the pile and the arrangement of bar are calculated. At this time, values determined at the step 14 such as the vertical bearing capacity, namely, the end bearing capacity and shaft bearing capacity, and further the length and diameter of the pile are used as data. The above analysis is performed because of the following: When the bending moment due to the horizontal force and the vertical load (axial tension) are simultaneously loaded to the part of the pile close to the ground, the resistance and deformation of the pile material at a predetermined depth are determined in accordance with the correlations between the horizontal force and the axial tension.

Step IX As a result of the above analysis, if it is decided that the horizontal deformation is smaller than the allowable deformation of a structure and that the horizontal bearing capacity is larger than the horizontal force applied to the structure, the following step is executed.

Step X The allowable bearing capacity and deformation of the pile, the number, length, diameter, material and safety factor of the pile, etc. are set as design values, and the values are immediately printed out together with the calculation and analysis data used at the step 19 at the construction site to certify the capability and quality of the pile.

Step X.1 The information about the data values are transmitted as the data values for a next pile, and similar measurement and analysis is performed to design the next pile.

Step IX.1 When the horizontal baring capacity and deformation are unsatisfactory at the step IX, the diameter and material of the pile and the arrangement of bar are modified, and the calculation, analysis and decision are performed similar to the steps VIII, IX. If the result of the decision is satisfactory, step X explained hereinafter are performed.

Step X The allowable bearing capacity, deformation, number, length, diameter, material, safety factor, etc. of the pile which satisfy the step IX are set as design values. Those values, calculations, analysis data, etc. are printed out to certify the capability and quality of the pile, similar to the step X.

Another aspect of the present invention relates to a method of making a hole for a foundation pile such as a cast-in-situ pile, which includes the steps of making a hole in the ground by a drilling machine, pressing the surrounding ground in the bored hole to deform the surrounding ground into an arbitrary configuration, and compacting the bottom of the ground in the hole with pressure.

With reference to FIGS. 31 to 34, the drilling machine according to the present invention will be described. The machine corresponds to the embodiment shown in FIGS. 9 and 10 which has the vertical pressing board 13.

A ground presser S' is provided in the end of the casing 1, for pressing the ground within the bored hole to compact it. The ground presser S' comprises a horizontal presser S'1 for pressing the surrounding ground of the bored hole and a vertical presser S'2 for pressing the bottom ground of the hole.

A plurality of horizontal cylinders 3 are disposed in the vertical direction related to the horizontal presser S'1, or a single horizontal cylinder 3 may be positioned depending upon its length along the axial direction of a pressing frame 5. A plurality of the horizontal pressers S'1 may be disposed along the axial direction of a casing 1 across the entire length of the casing 1 as well as at the end portion of the casing 1.

The vertical presser S'2 is fitted in a vertical pressing chamber 12 of the lower double-pipe portion of the horizontal presser S'1 so as to slide vertically along a ring-shaped vertical pressing frame 8. A vertical pressing board 13 at the bottom portion of the vertical pressing frame 8 is connected to one or more vertical cylinders 4 vertically attached in the vertical pressing chamber 12, and the movement of the vertical cylinder 4 allows the vertical pressing frame 8 to move up and down in the chamber 12. The vertical pressing board 13 is almost the same in outer diameter as the diameter of the bored hole. The vertical pressing frame 8 and the vertical pressing chamber 12 are divided into multisections in the radial direction for each of hydraulic cylinders so that those sections work individually. The illustration of the multisections is omitted.

Reference numerals 24*a*, 24*b* denote pressure meters or pressure sensors for determining the pressure of oil (or fluid) delivered to the horizontal cylinder 3 and the vertical cylinder 4. Those sensors are disposed close to a manifold 22 and an electromagnetic valve or in a pressed amount measuring unit D to convert the results of measurement into electric signals and transmit them to the pressed amount measuring unit D.

Reference numerals 25*a*, 25*b* denote flow meters for determining the amount of oil (or fluid) delivered to the horizontal cylinder 3 and the vertical cylinder 4. Those meters are disposed close to a manifold 22 and an electromagnetic valve or in the pressed amount measuring unit D to convert them into electric signals and transmit them to the pressed amount measuring unit D.

A position sensor 26*a* determines the displacement of the pressing frame 5 pressing the surrounding ground of the hole. The position sensor 26*a* may be an LVDT type displacement gage, for example. A plurality of the displacement gages are attached to each of the radially divided sections of the pressing frame 5 so as to determine the displacement of each of the sections. When a plurality of pressed portions are disposed along the axial direction as will be mentioned below, those sensors are attached to each of the pressed portions.

A position sensor 26*b* determines the displacement of the vertical frame 8 pressing the bottom ground of the bored hole and it may be an LVDT type displacement gage similar to the above.

The pressed amount measuring unit D is almost the same as the pile bearing capacity analyzing/operating unit K in FIG. 3. The unit D receives signals transmitted from the flow meters 25*a*, 25*b*, position sensors 26*a*, 26*b* and the displacement gage 27 to analyze the pressing force and the deformation of the ground when it is pressed, etc.

Figure 35:
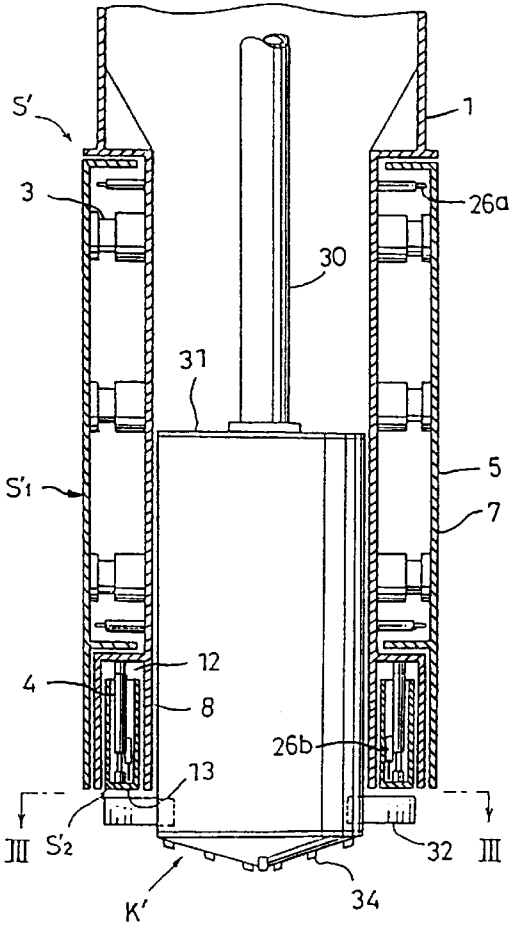
FIG. 35 is a sectional view showing a combination of the ground presser according to the present invention and a drilling machine.
Figure 36:
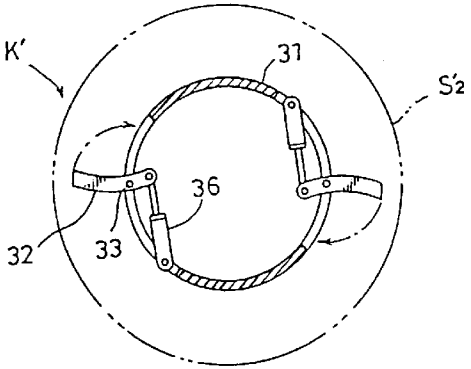
FIG. 36 is a sectional view along the line III—III of FIG. 35.
Figure 36A:
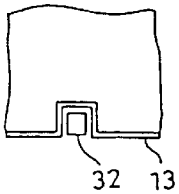
FIG. 36*a* is a partial side view of FIG. 36.

FIGS. 35, 36 and 36*a* show an embodiment of a drilling machine K' for setting up the casing 1 while making a hole in the ground.

Figure 37:
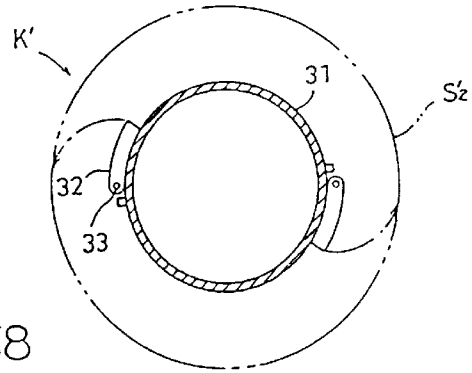
FIG. 37 is a partial side view showing a modification of the drilling machine.
Figure 38:
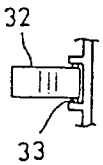
FIG. 38 is a partial side view of the drilling machine of FIG. 37.

The drilling machine K' such as an earth drilling machine is provided with a leading cutter 34 on the bottom end face of an excavating bucket 13. The bottom face of the excavating bucket 31 is formed with an opening through which soil excavated by the leading edge 34 come into the excavating bucket 31. A plurality of cutters 32 of fanwise edges are attached to the side wall of the excavating bucket 31 for free opening or closing so as to making a hole in the ground under the ring-shaped ground presser S'. The opening or closing operation is controlled by a cylinder 36. As shown in FIGS. 37 and 38, the forward and reverse rotation of an rotation shaft 30 (which has an inner aperture for conducting mortar, mud water or the like), namely, the forward and reverse rotation of the excavating bucket 31 controls the opening or closing of the fanwise edge cutters 32.

Figure 39:
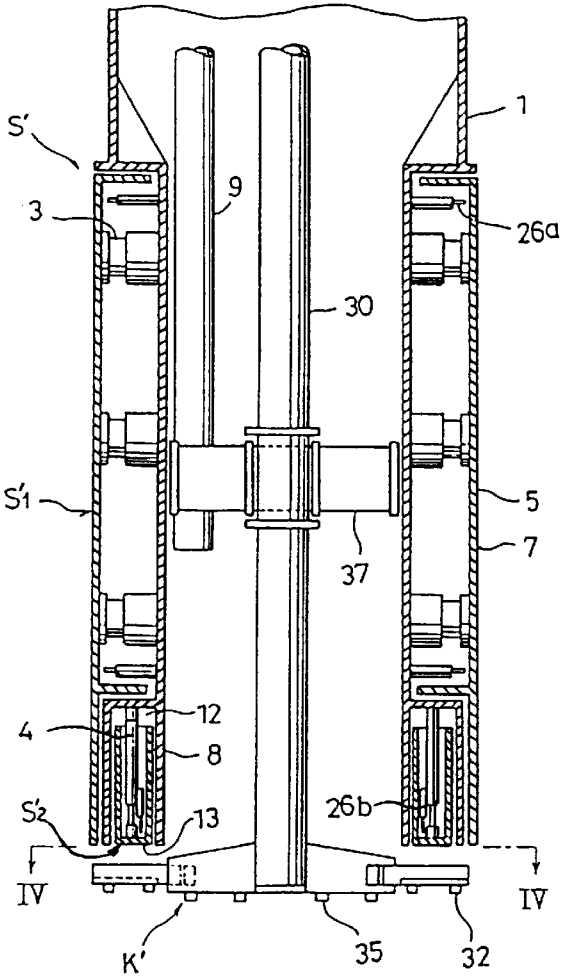
FIG. 39 is a sectional view showing a combination of the ground presser according to the present invention and the drilling machine.
Figure 40:
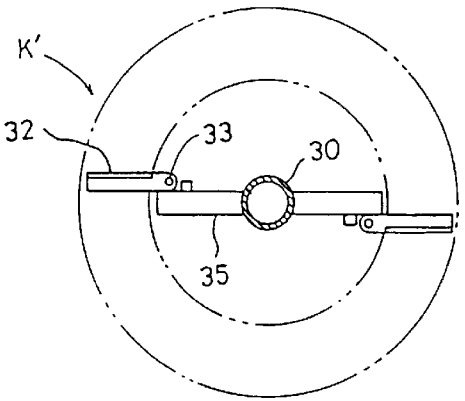
FIG. 40 is a sectional view along the line IV—IV of FIG. 39.

FIGS. 39 and 40 show an embodiment of another drilling machine for setting up the casing 1.

A drilling machine K' is an earth auger machine, a reverse machine or the like for making a hole in the ground, which includes a hollow rotation shaft 30 (having an inner aperture for conducting mortar, mud water or the like), a 2-bladed or 4-bladed leading cutter 35 and the fanwise edge cutter 32 attached to the leading cutter 35 with a pin 33. The fanwise edge cutter 32 is opened or closed in accordance with the forward and reverse rotational direction of the rotation shaft 30. A steady rest 37 keeps the drilling machine K' at the center in the casing 1.

Then, a method of constructing a pile according to the present invention will be described.

As shown in FIGS. 35 and 39, the drilling machine K' including the casing 1 within it makes a hole to set up the casing 1 in the bored hole. The horizontal presser S'1 provided in the casing 1 presses the surrounding ground of the bored hole to deform the surrounding ground into a tapered configuration. A method according to the present invention using the drilling machine K' of FIG. 35 will be described with reference to FIG. 41.

The casing 1 is set up on the ground including the drilling machine K' such as an earth drilling machine, grabbed by a power jack J, a casing driver or the like. The casing 1 has its upper portion of the rotation shaft 30 connected to a decelerating motor (not shown).

When the drilling machine K' is rotated, the excavating bucket 31 excavates the ground under the casing 1 to set the casing 1 in a bored hole a by manipulating the power jack J or the like. If the casing 1 is set up to a predetermined length, or if the length L of the ground presser S' provided at the end portion of the casing 1 is set up, the horizontal cylinder 3 within the horizontal presser S'1 works, so that the pressing frame 5 protrudes in the outer peripheral direction from the casing 1 to press the surrounding ground b.

In this case, the pressing force of the horizontal cylinder 3 is determined by the pressure sensor 24*a* similar to the case of the aforementioned aspect of the invention (the determined value X), and the protrusion (displacement) of the horizontal cylinder 3 or the horizontal displacement of the pressing frame 5, namely, the deformation of the surrounding ground b are measured by the position sensor 26*a* (the determined value=Y). The protrusion (displacement) of the horizontal cylinder 3 may be determined by the flow meter 25*a*. Each of the determined values X, Y are converted into electric signals and transmitted to the pressed amount measuring unit D on the ground.

An output unit Ka, which is electrically connected to the pressed amount measuring unit D, may immediately present the determined values X, Y just at the construction site so as to certificate the capability and quality of a pile.

According to the present invention, the surrounding ground b is pressed so that the surrounding ground b is deformed into an arbitrary configuration such as a tapered configuration. Accordingly, the pressing force (X) and the deformation (Y) of the surrounding ground due to the pressing are measured and decided by the pressed amount measurement unit D in accordance with preset values. The operation of the horizontal cylinder 3 is controlled by the pressed amount measuring unit D. With regard to the pressing force (X), for example, the pressing is performed to an extent corresponding to the earth pressure at rest at the current depth, or in a range below the passive earth pressure. With regard to the deformation of the surrounding ground b, the pressing is performed in agreement with an arbitrary configuration of a cast-in-situ pile to be constructed. For example, when the ground is deformed into a configuration t tapered in the depthwise direction, the protrusion of each of a plurality of the horizontal cylinders 3 provided in the upper and lower portions of the horizontal presser S'1 is so changed that the upper horizontal cylinder protrudes more. When the ground is deformed into a configuration inverse to the configuration t, the protrusion of each of the cylinders 3 is so changed that the lower horizontal cylinder 3 protrudes more.

After the wall of the bored hole is deformed by pressing the surrounding ground of the bored hole in accordance with a predetermined pressing, the hole is deepened having a unit length L by the drilling machine K'. The casing 1 is set up in the bored hole, and the surrounding ground b of the hole is pressed and measuring operation is performed similar to the above. These steps are repeated to a predetermined depth. After that, the surrounding ground b is compacted and deformed into a specific configuration. For example, a hole, whose surrounding ground b having a configuration t where the diameter of the hole becomes smaller with the increased depth of the hole, is made as shown in FIG. 41(*c*).

Figures 41A, 41B, 41C, 41D, 41E:
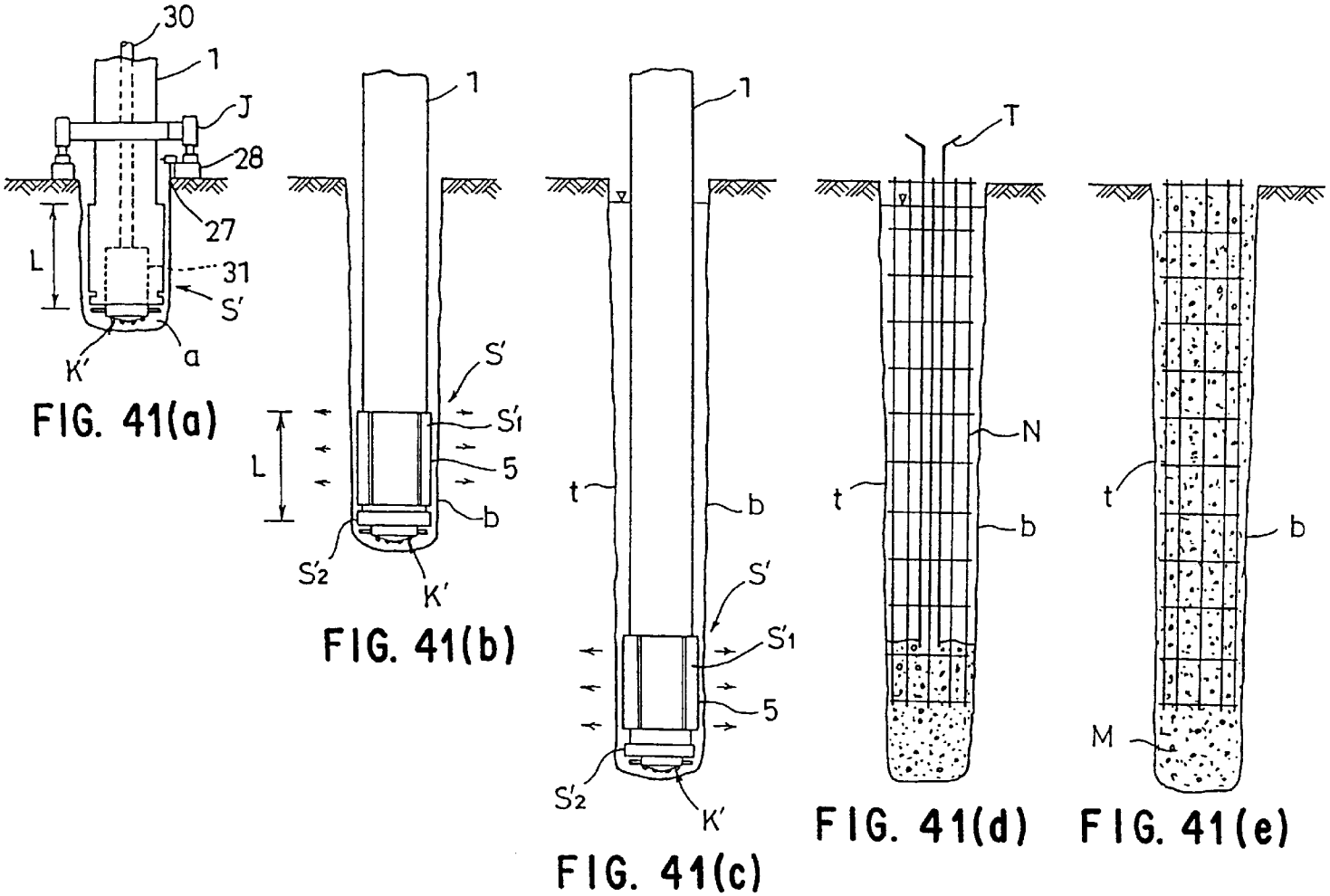
FIGS. 41(*a–e*) are sectional views presented for explaining steps of a method of making a hole for a foundation pile according to the present invention.

After the surrounding ground is deformed into a specific configuration by pressing, or after the pressing operation against the surrounding ground of the bored hole a is performed, the bottom ground of the hole is pressed and compacted by the vertical presser S'2 and the bottom face of the drilling machine K' as shown in FIG. 41(*c*).

While the surrounding ground of the bored hole is pressed by the pressing frame 5 protruding in the radial direction due to the movement of the horizontal cylinder 3, the vertical cylinder 4 within the vertical presser S'2 works to put the vertical frame 8 down. In this case, as shown in the FIGS. 36 and 36*a*, the excavating bucket 31 of the drilling machine K' is in the leading position in the casing 1 with the fanwise edge cutter 32 being opened under the vertical pressing frame 8. As the vertical pressing frame 8 descends, the vertical pressing board 13 comes to engage with the fanwise edge cutter 32. The downward pressing force, or the downward pressure, of the vertical cylinder 4 is transmitted to the excavated bucket 31, and the bottom ground of the bored hole is pressed and compacted by the bottom face of the vertical pressing board 13 and the bottom face of the excavating bucket 31. Accordingly, the surrounding ground is pressed and compacted using as reaction force the friction resistance obtained by pressing the surrounding ground b. The pressing force of the vertical cylinder 4 is measured by the pressure sensor 24*b*, and further, the displacement of the vertical pressing board 13, or the deformation of the bottom ground of the bored hole, is measured by the position sensor 26*b* or the like and transmitted to the pressed amount measuring unit D.

In pressing the surrounding ground at the bottom of the bored hole, if the lower cylinder of a plurality of horizontal cylinders 3 for pushing the pressing frames 5 moves more than the upper cylinder, the configuration of the wall of the bored hole reversely tapered, so that a cast-in-situ pile having a larger diameter at the bottom can be constructed. In the foregoing, the bottom ground of the bored hole is pressed using the friction force caused by pressing the surrounding ground b as reaction force, but the upper portion of the casing 1 may be fixed by a machine on the ground. Also, in pressing the surrounding ground b and the bottom ground of the bored hole, the combination of pressing and release of pressing such as pressing—release from pressing—pressing may be repeated several times.

Further, in the foregoing, the surrounding ground b is pressed and deformed while the casing 1 is set up in the hole. Alternatively, a hole may be firstly made to a predetermined depth by the drilling machine K' to set up the casing 1 to the depth, and the pressing and the measurement of the bottom ground, the surround ground b may be pressed and deformed from the lowermost portion of the bored hole to the upper portion while the casing 1 is pulled up. Additionally, the pressing and deformation of the surrounding ground b according to the present invention can be performed by setting up the casing in a hole "a" bored in advance. In this case, a drilling machine such as a reverse circulation drill machine can be used.

After the pressing of the surrounding ground b, the deforming the surrounding ground into a configuration, and the measurement and the pressing the bottom ground are all completed, the casing 1 and the drilling machine K' is pulled up. Then as shown in FIGS. 41(*d*) and 41(*e*), a conventional rebar cage N and a tremie T are suspended and put down into the bottom portion of the bored hole "a" and ready-mixed concrete is injected so that a cast-in-situ pile M having an arbitrary configuration such as a tapered side wall can be constructed. Alternatively, an injection pipe or the like is inserted into the bored hole "a" to fill the bored hole "a" with curing agent such as bottom consolidation cement slurry, periphery consolidation mortar, and then a prefabricated pile made of concrete, steel pipe or the like may be put in the hole. Eventually, a foundation pile, which has an arbitrary configuration such as a tapered wall, using a prefabricated pile can be constructed.

Figures 42A, 42B, 42C, 42D, 42E, 42F, 42G:
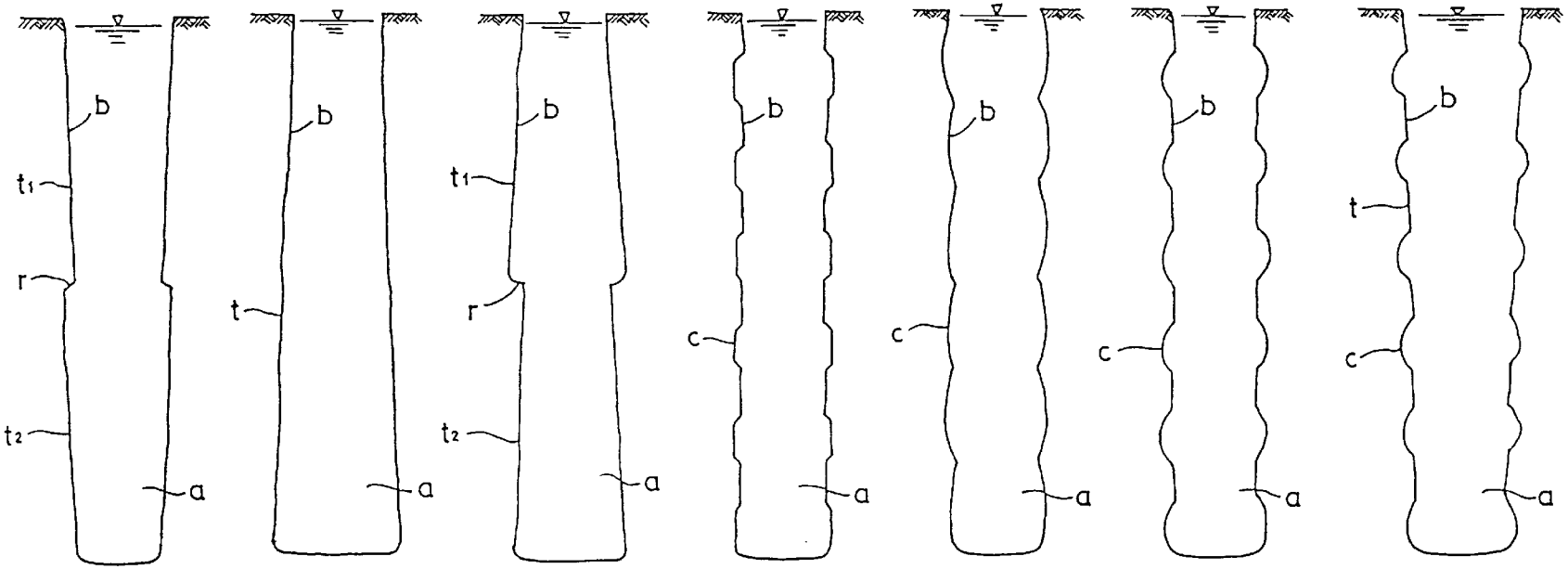
FIGS. 42(*a–g*) are sectional views showing various shapes of holes formed by the method of making a hole for a foundation pile according to the present invention.

When the length of a cast-in-situ pile to be constructed is rather long, a tapered configuration t1 is formed to a predetermined depth as shown in FIG. 42(1) allowing the axial force loaded on the pile. At the depth, the diameter of the hole is made large to the diameter of the upper portion of the pile (a shaped part), then the portion lower than the depth may have a tapered configuration t2. In this case, pull-out resistance of the pile is increased at the shaped part. As has been described, when the surrounding ground of the bored hole is tapered, the inclination is desirably a few percent, although the rate depends on the soil type of the ground, so that a large shaft bearing capacity can be obtained.

When the surrounding ground is pressed and deformed into a tapered configuration t inverse to the above, the surrounding ground b turns to a configuration shown in FIGS. 42(2) and 42(3), so that a cast-in-situ pile having a large pull-out resistance which works as a kind of anchor pile. The inclination of the tapered configuration t of the surrounding ground b may be appropriately changed depending upon the type of the ground such as clayey ground and sandy ground, or the hardness of the ground.

In the present invention, the surrounding ground b has an arbitrary configuration, and configurations except for those of FIGS. 42(4) to (7) will be explained later.

In the foregoing, an apparatus including the horizontal presser S'1 which has a specific length L and is provided at the end portion of the casing 1 is used. However, when a plurality of the horizontal pressers S'1 are disposed along the axial direction of the casing 1, a hole may be made with a depth corresponding to the extension of the plurality of the horizontal pressers S'1 and thereafter the pressing and the measurement may be performed. When the horizontal presser S'1 extends across the entire length of the casing 1, the pressing and the measurement may be carried out after a hole corresponding to the entire length of a cast-in-situ pile to be constructed is made.

Further, another embodiment of the present invention will be described.

Figure 43:
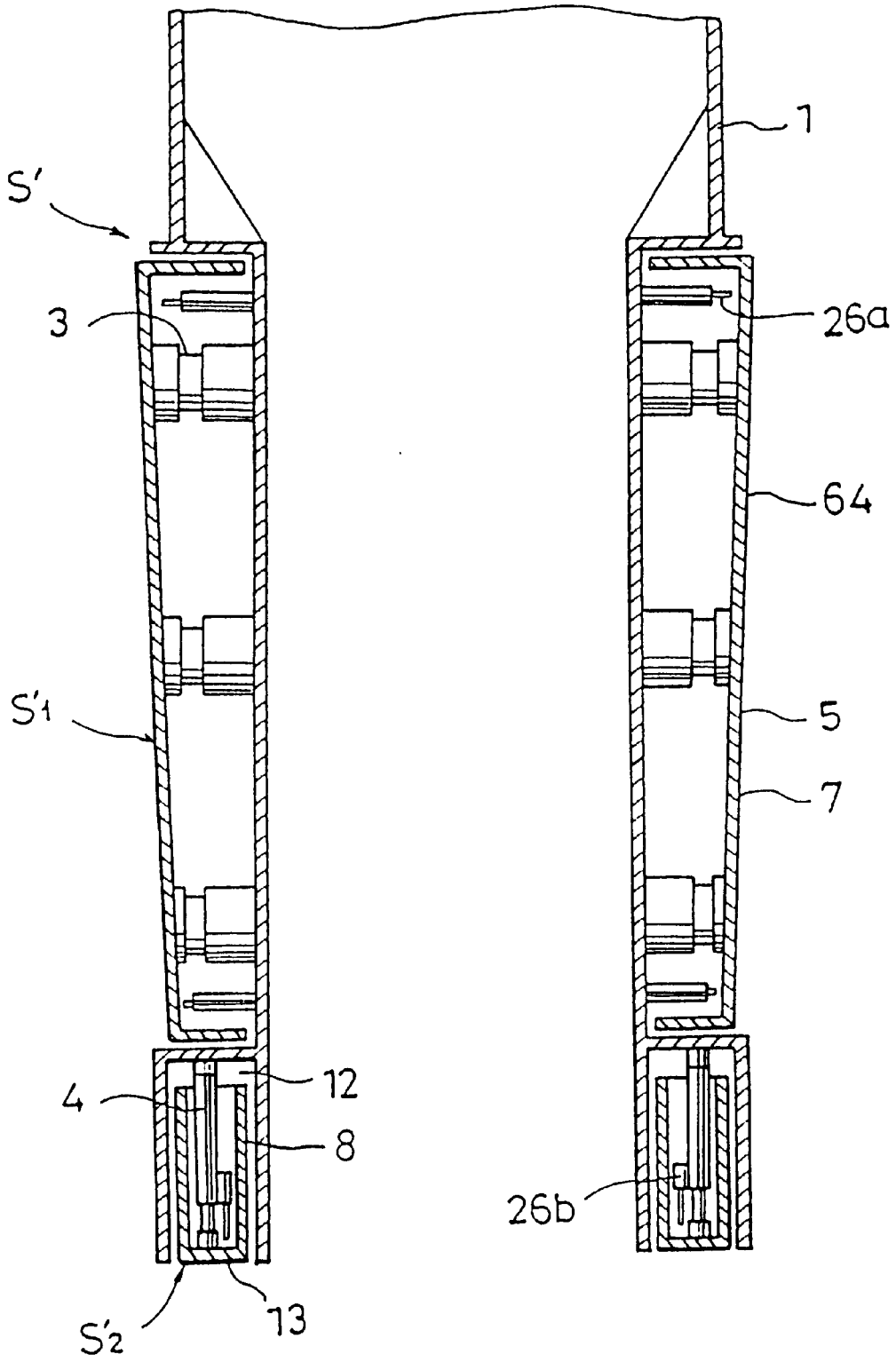
FIG. 43 is a sectional view showing another embodiment of the ground presser.

FIG. 43 shows another (i.e., the second type) embodiment of the horizontal presser S'1. The cylindrical pressing face 7 of the pressing frame 5 divided into multisections has a tapered face 64. In the aforementioned embodiment, the expansion of each of the horizontal cylinders 3 disposed in the upper and lower portion is regulated so that the surrounding ground b of the bored hole is pressed and deformed into a tapered configuration t. In the horizontal presser S'1 according to this embodiment, the surrounding ground b having a tapered configuration t shown in FIGS. 41(*d*) and 42(1) can be made simply by unifying the expansion of each of the horizontal cylinders 3 and pressing the ground.

The tapered configuration increases the circumferential friction force of a cast-in-situ pile to be constructed and also decreases negative friction force. It is also possible to attain a tapered configuration suitable for the distribution of the horizontal force applied to the upper portion of a foundation pile and the bending moment, so that a cast-in-situ pile can be economically constructed.

Figure 44:
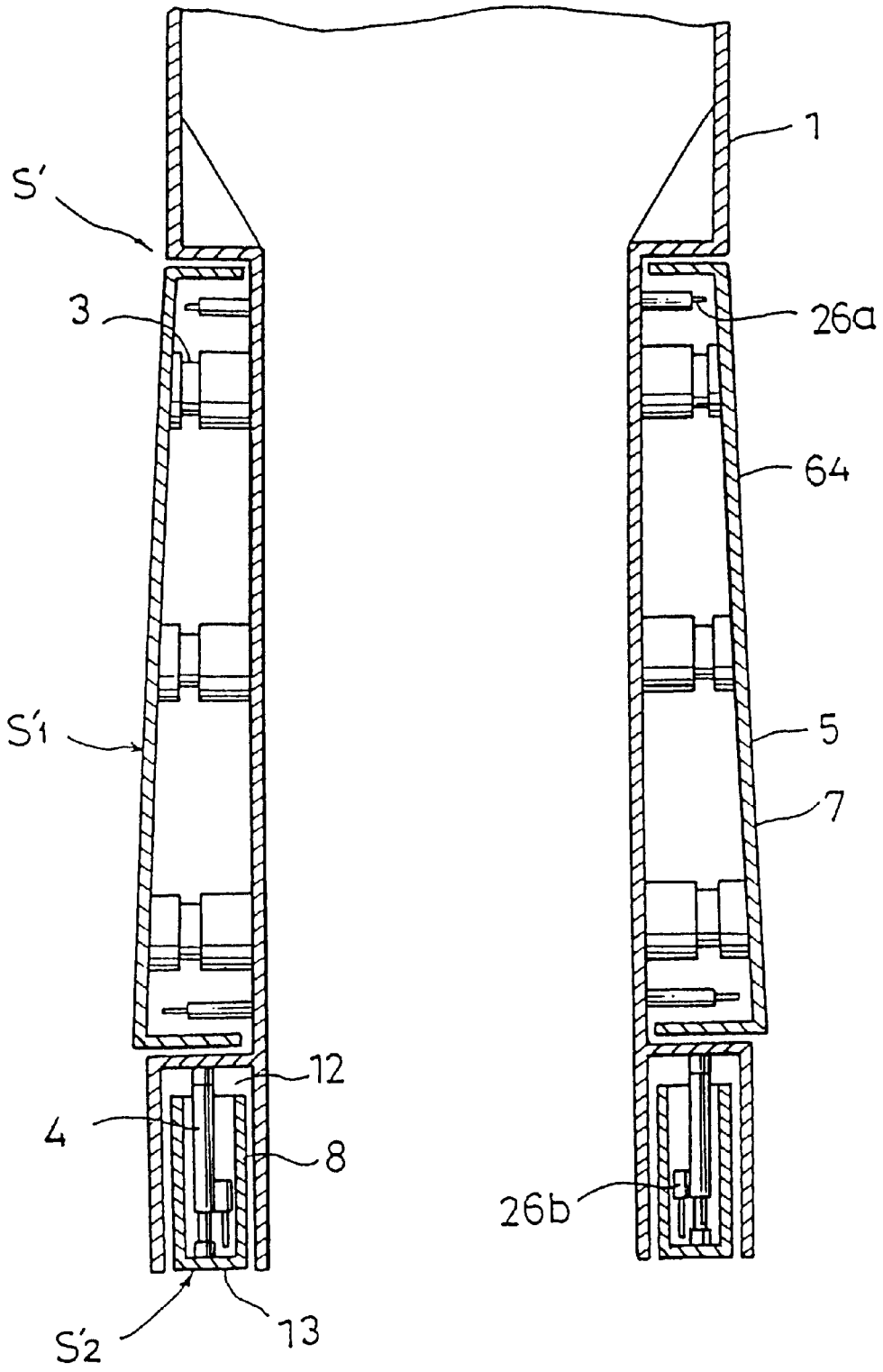
FIG. 44 is a sectional view showing still another embodiment of the ground presser.

The taper of the pressing face 7 in the aforementioned embodiment is inverse to the taper shown in FIG. 44, having a tapered face 64 whose diameter is larger in the lower portion. In the horizontal presser S'1 according to the present invention, the surrounding ground b having a tapered configuration t shown in FIGS. 42(2) and 42(3) can be made by unifying the expansion of the horizontal cylinder 3 and simply pressing the ground.

In this case, the upside-down tapered configuration allows the pull-out resistance of a cast-in-situ pile to be constructed to increase and also allows the pile to have a function of an anchor pile which prevents a structure or the like from falling down.

Figure 45:
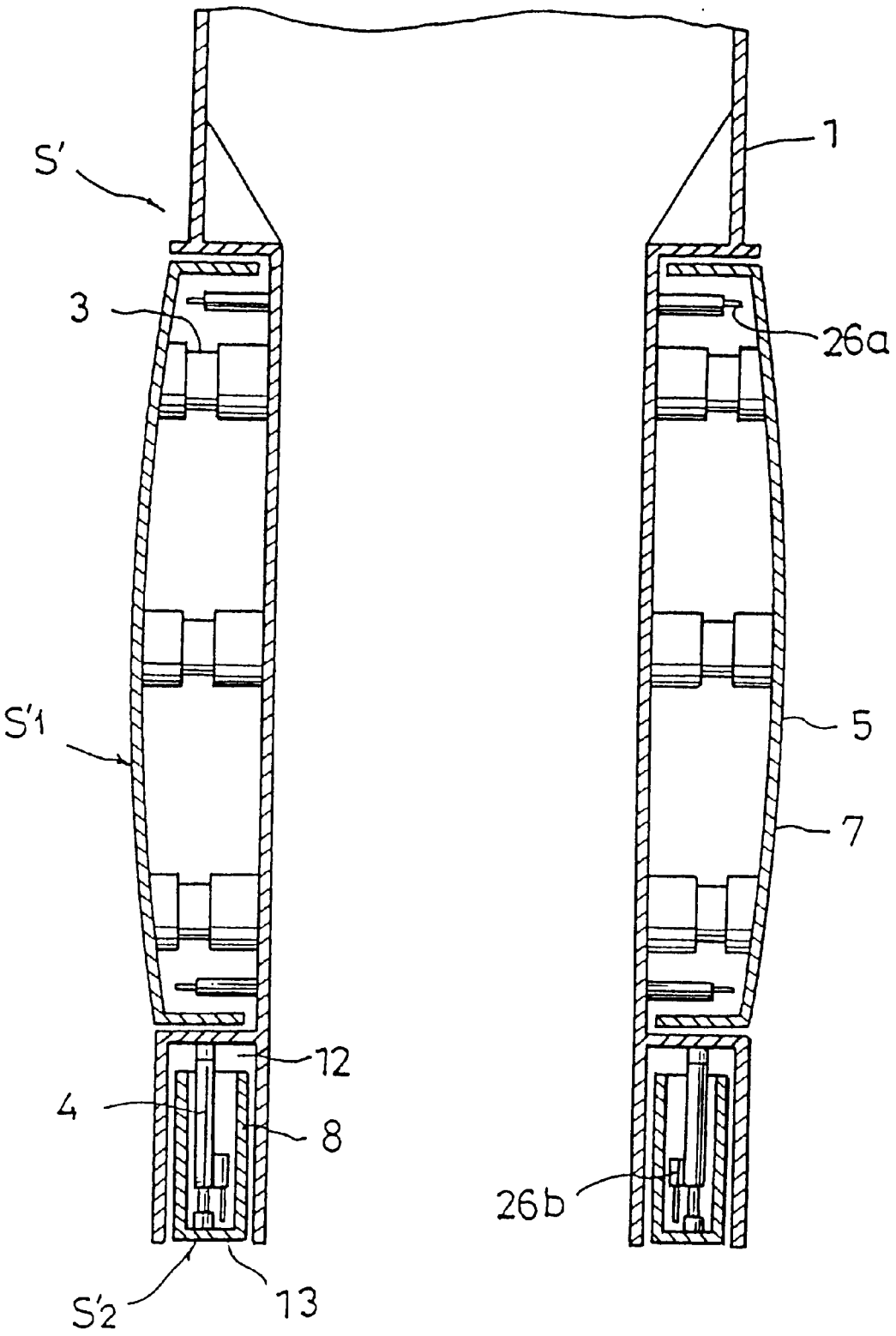
FIG. 45 is a sectional view showing yet another embodiment of the ground presser.

Referring to FIG. 45, the cylindrical pressing face 7 of the pressing frame 5 is substituted for the pressing face 7 having a circular cross section and swelled in its center portion. In this case, the surrounding ground of the bored hole is irregular as shown in FIG. 42(5), so that the shaft friction resistance in the vertical direction is increased.

Figure 46:
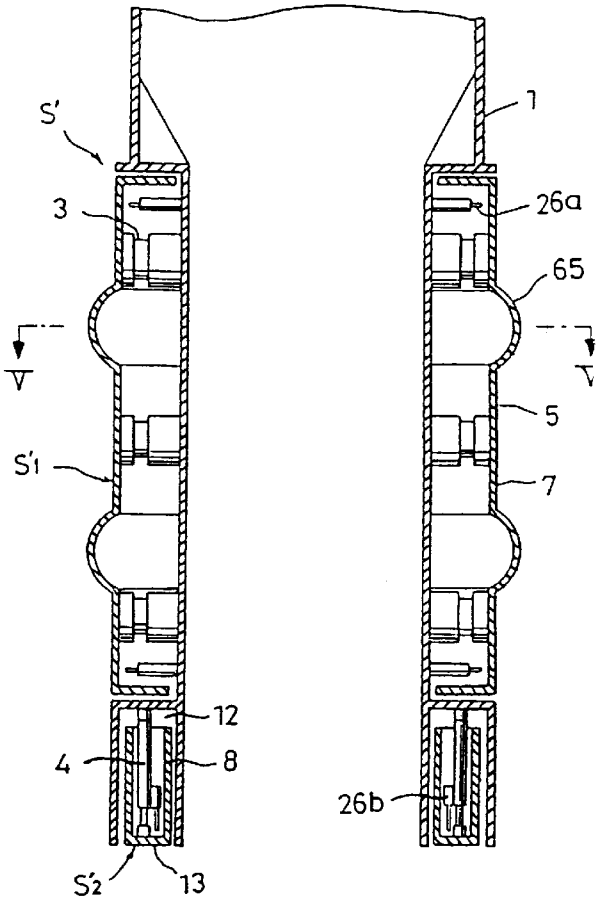
FIG. 46 is a sectional view showing further another embodiment of the ground presser.
Figure 47:
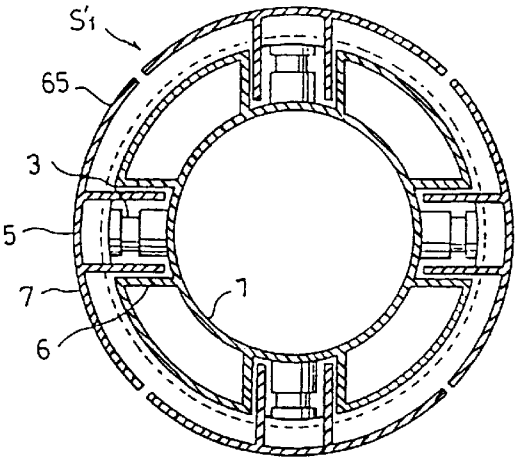
FIG. 47 is a sectional view along the line V—V of FIG. 46.
Figure 48:
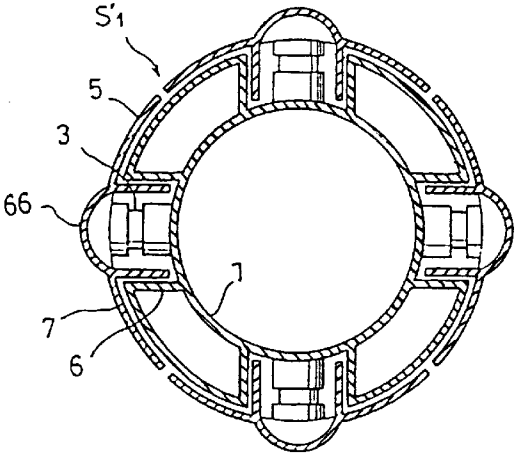
FIG. 48 is a sectional view showing a modification of the ground presser.

As shown in FIGS. 46 and 47, one or more ring-shaped convex portions 65 are formed on the pressing face 7 in the vertical direction (along the axial direction of the casing 1). The resultant surrounding ground b has its side wall concave portions c as shown in FIG. 42(6), so that the friction force on the peripheral surface of the bored hole is increased with regard to the vertical direction. Instead of the ring-shaped convex portions 65 shown in FIG. 47, a plurality of trapezoidal convex portions 66 may be provided as shown in FIG. 48. Each of the convex portions 65, 66 is an arc in its cross section.

Figure 49:
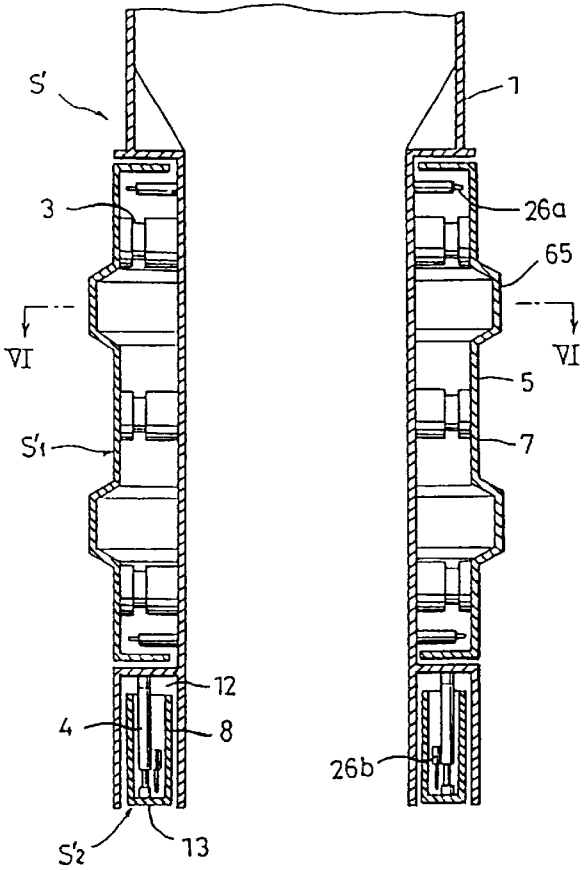
FIG. 49 is a sectional view yet another embodiment of the ground presser.
Figure 50:
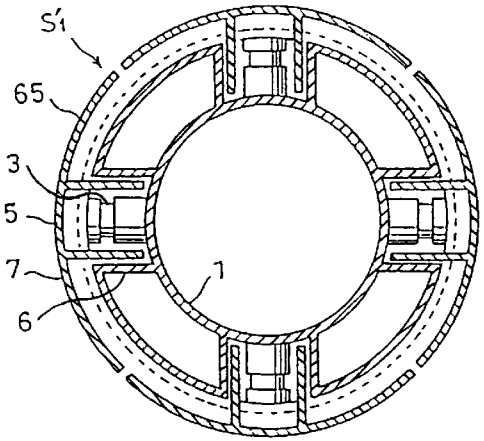
FIG. 50 is a sectional view along the line VI—VI of FIG. 49.
Figure 51:
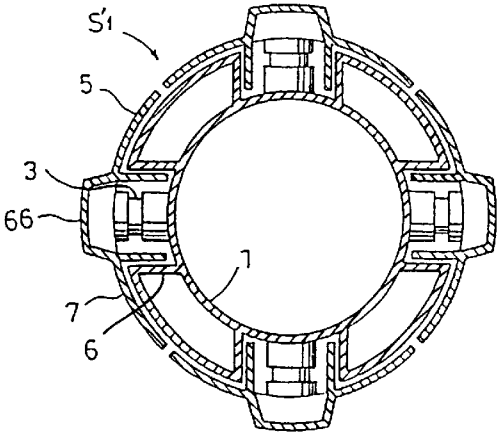
FIG. 51 is a sectional view showing a modification of the ground presser.

As shown in FIGS. 49 to 51, each of the convex portions 65, 66 is a U-shape in its cross section unlike the corresponding portions in the aforementioned embodiment. FIG. 42(4) shows the surrounding ground of the bored hole. With this configuration of the surrounding ground, the friction force on the peripheral surface of the wall of the hole is increased with regard to the vertical direction similar to the above.

In the above two embodiments, regulating the expansion of the horizontal cylinders 3 in the upper and lower portions results in the surrounding ground provided with the ring-shaped concave portion c on the hole wall having a tapered configuration t as shown in FIG. 42(7), so that a cast-in-situ pile having much larger circumferential friction resistance can be made.

Figure 52:
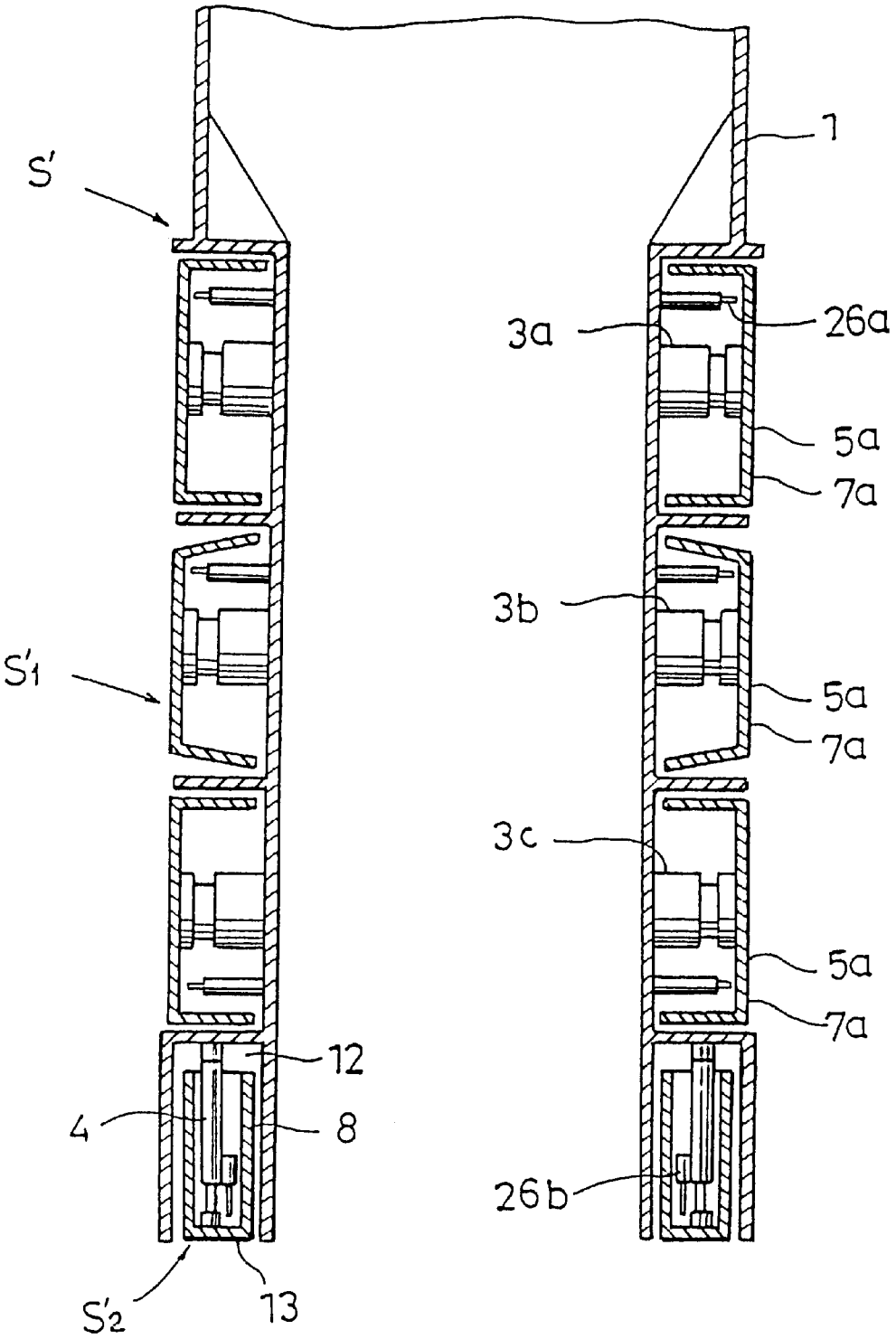
FIG. 52 is a sectional view showing still another embodiment of the ground presser.

An embodiment shown in FIG. 52 has a pressing frame 5 divided into sections 5*a*, 5*b*, 5*c* disposed in the vertical direction within the horizontal presser S'1. If the expansion of each of horizontal cylinders 3*a*, 3*b*, 3*c* for moving each of the pressing frames 5*a*, 5*b*, 5*c* is regulated in pressing, and each of pressing faces 7*a*, 7*b*, 7*c* is an arc or a U-shape in cross section, all the aforementioned embodiments can be implemented as a single device.

Figure 54:
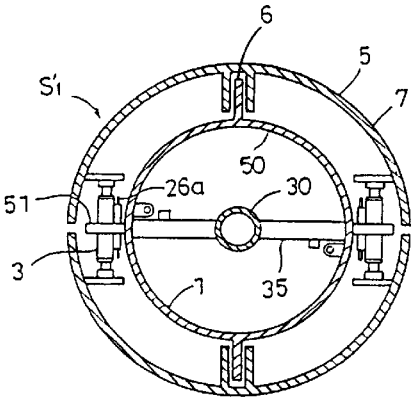
FIG. 54 is a sectional view along the line VII—VII of FIG. 53.
Figure 53:
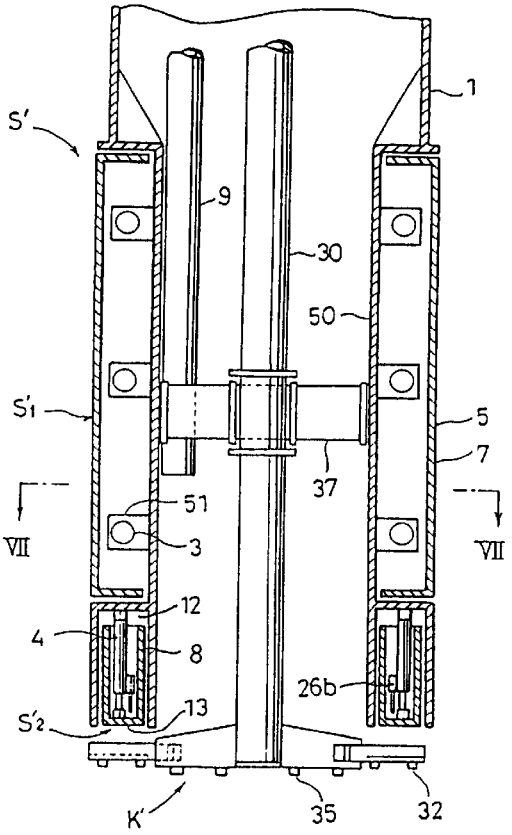
FIG. 53 is a sectional view showing a combination of yet another embodiment of the ground presser and the drilling machine of FIG. 39.

FIGS. 53 and 54 show another embodiment of the horizontal presser S'1. A base plate 51 is positioned in an inner pipe portion 50 of a double-pipe structure of the casing 1. A plurality of horizontal cylinders 3 are attached to the base plate 51. The multisections (d.g. two sections) of the pressing frame 5 protrude along the guide plate 6 in the horizontal direction by the movement of the horizontal cylinders 3 to press the surrounding ground b.

Figure 55:
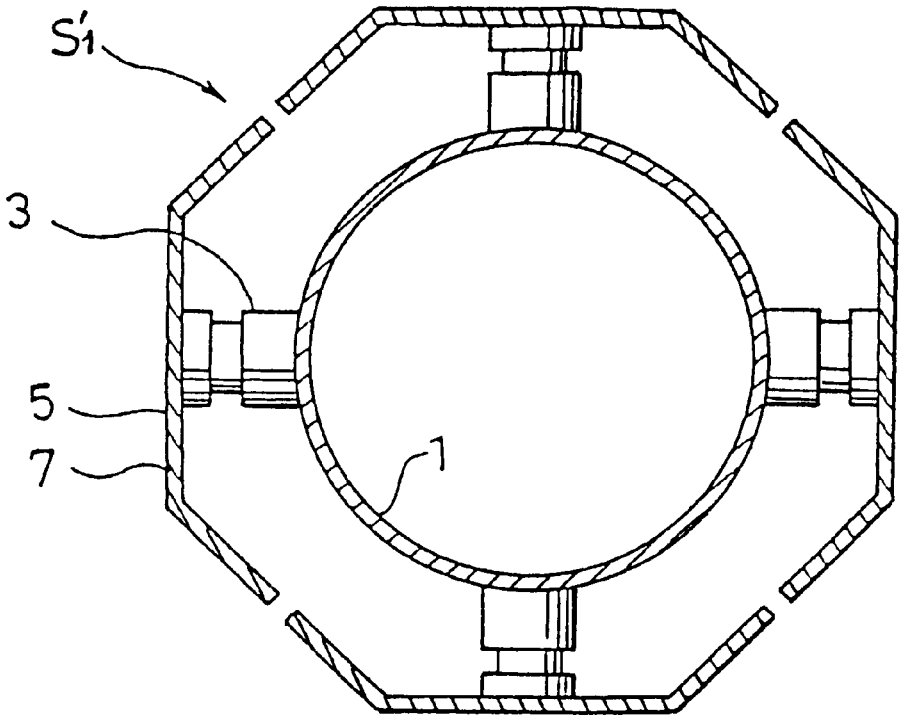
FIG. 55 is a sectional view showing further another embodiment of the ground presser.

In the embodiments shown in FIGS. 31 to 52, the pressing face 7 of the pressing frame 5 is almost circular in cross section. In this embodiment, the pressing face 7 is rectangular as shown in FIG. 55. With an apparatus according to this embodiment, a cast-in-situ pile having a rectangular cross section and a rectangular wall can be made by pressing the surrounding ground of the bored hole.

Figure 31:
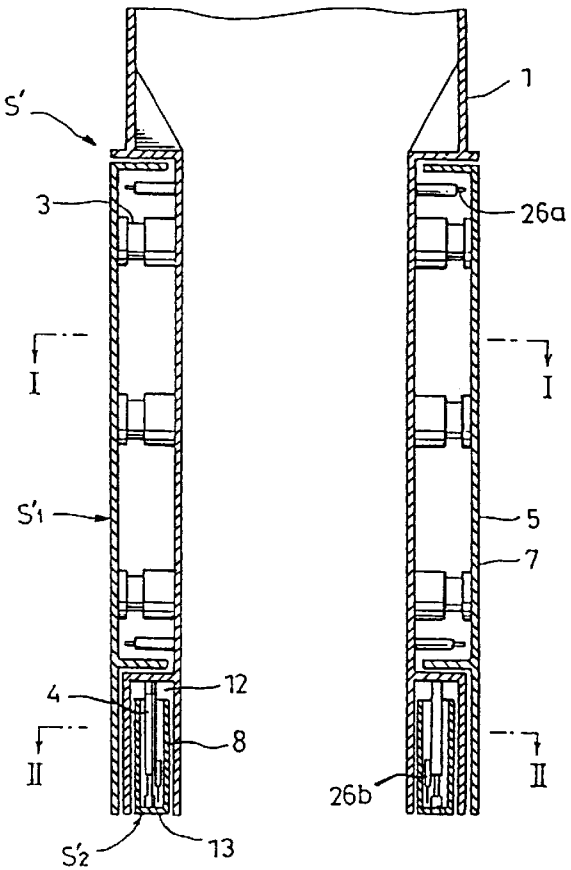
FIG. 31 is a sectional view of an embodiment of a ground presser according to the present invention.
Figure 32:
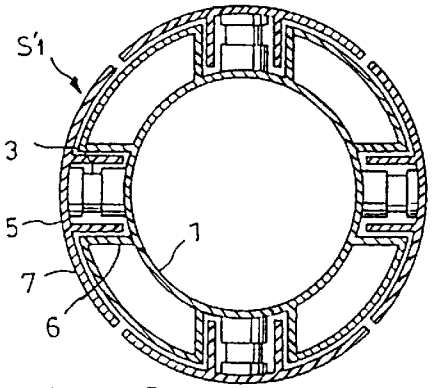
FIG. 32 is a sectional view along the line I—I of FIG. 31.
Figure 33:
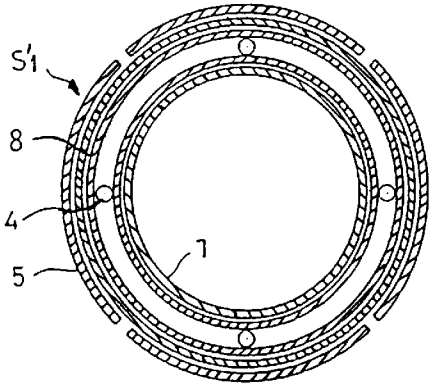
FIG. 33 is a sectional view along the line II—II of FIG. 31.
Figure 34:
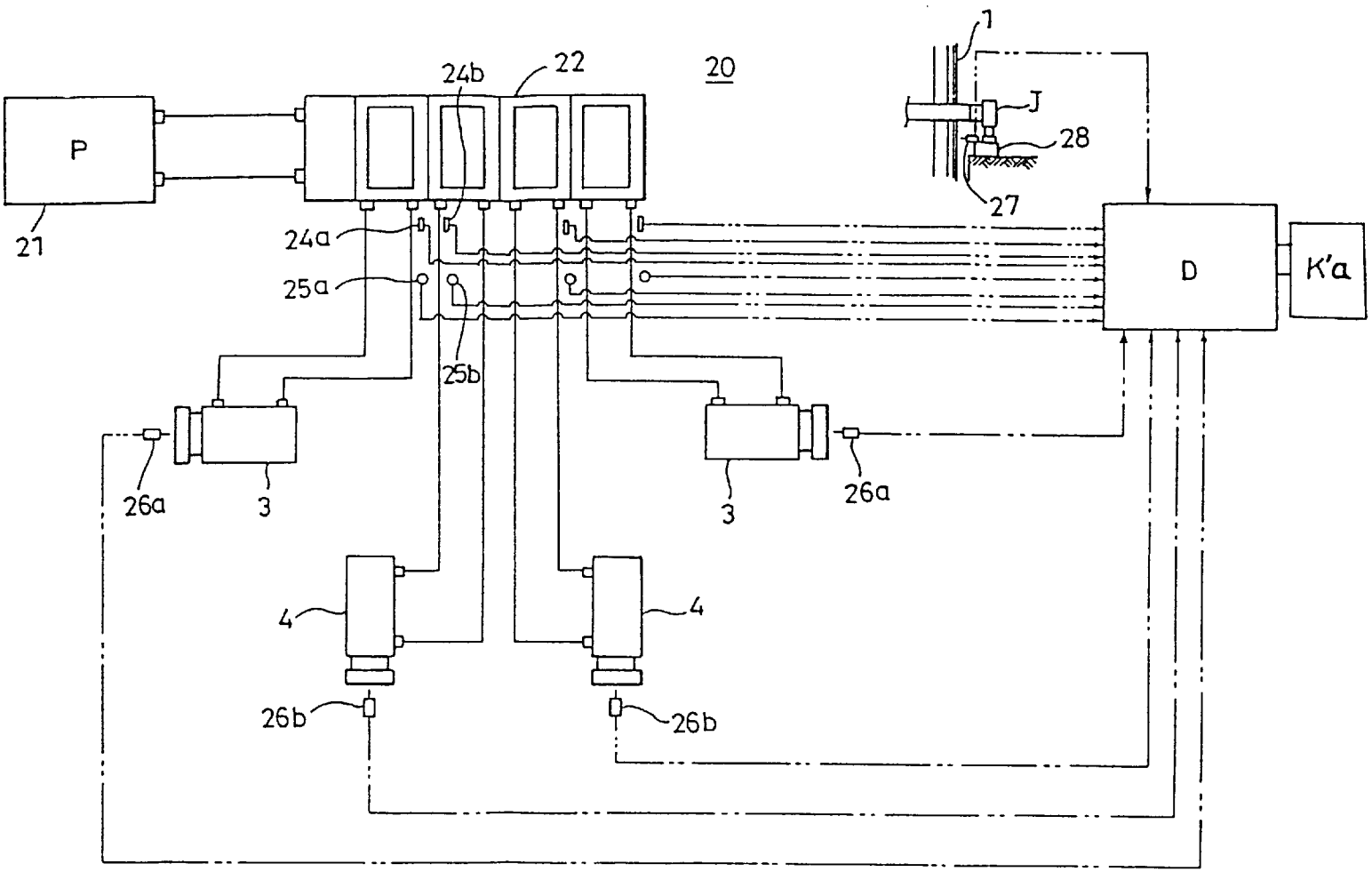
FIG. 34 is a circuit diagram of a hydraulic control circuit used in the ground presser of FIG. 31.
Figure 56:
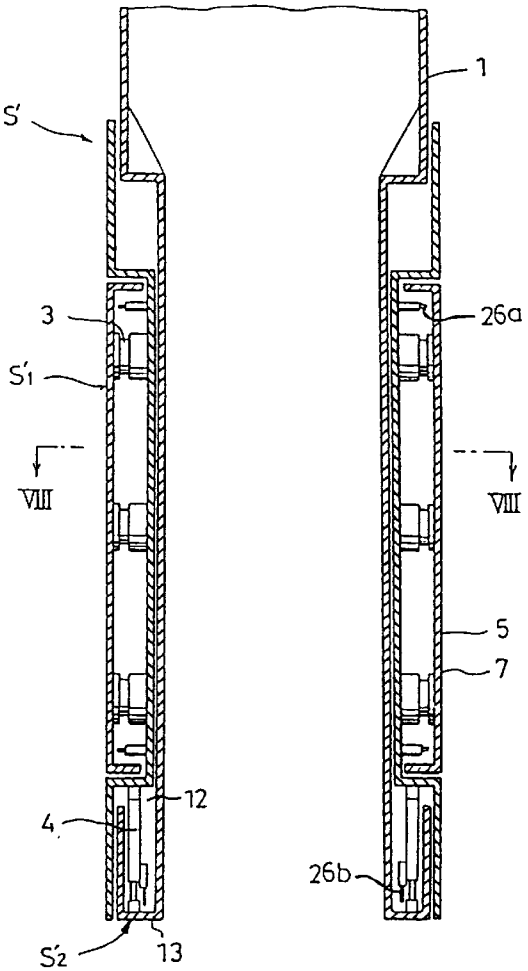
FIG. 56 is a sectional view showing still further another embodiment of the ground presser.
Figure 57:
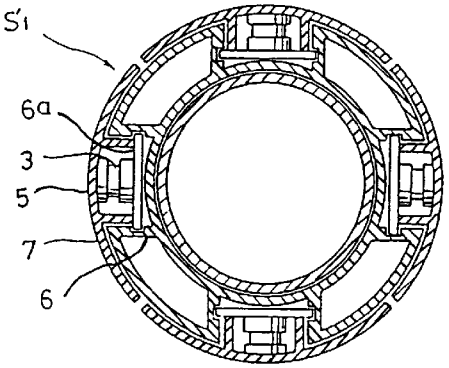
FIG. 57 is a sectional view along the line VIII—VIII of FIG. 56.

FIGS. 56 and 57 show still another embodiment of the horizontal presser S'1, and an apparatus according to the embodiment is almost the same as that of the embodiment shown in FIG. 31. The pressing frame can be moved by the movement of the vertical cylinder 4. A slide plate 6*a* to which the root of the horizontal cylinder 3 is fixed is movably supported by the guide plate 6, and the pressing frame 5 moves in the vertical direction. When the pressing frame 5 is vertically moved pressing the surrounding ground of the bored hole, the friction force of the surrounding ground and the friction resistance on the peripheral surface of the bored hole can be measured under a constant pressing force (the pressing face 7 is roughly made). In this case, the upper portion of the casing 1 is fixed by a machine such as a power jack J on the ground.

The measurement of the shaft friction force will be described in detail.

In this embodiment, the measurement of the shaft friction force and resistance force of the surrounding ground are performed similar to the first embodiment when the surrounding ground of the bored hole is pressed using the ground presser S', as required.

The upper portion of the casing 1 is fixed by a machine such as a power jack J on the ground while the horizontal presser S'1 presses the surrounding ground b of the bored hole at a specific depth in the ground to be measured, or while the horizontal cylinder 3 works and the suroundinng ground b is pressed by the pressing frame 5. When the horizontal cylinder 4 works, the pressing frame 5 is slightly moved along the direction of the inner axis of the bored hole while the pressing frame 5 is continuing to press. Accordingly, by measureing the force prodiced by the vertical cylinder 4, namely, the moving force of the pressing frame 5, the shaft friction force of the surrounding ground of the bored hole under a constant pressing force (X), or the friction resistance (F), can be measured by the pressed amount measureing unit D.

The pressing force (X) of the horizontal cylinder 3 is measuured by the pressure sensor 24*a*, and the force of the vertical cylinder 4, or the moving force (F), is measured by the pressure sensor 24*b*. Further, the displacement of the pressing frame 5 is measured by the position sensor 26*b* and the like. These measured data are all transmitted to the pressed amount measuring unit D on the ground. Eventually, the output unit Ka immediately presents the capability and quality of the pile just at the construction.

The measurement of the shaft friction force may be performed for the entire length of the surrounding ground in the bored hole. Further, even if the side wall of the surrounding ground b is vertical, tapered or of any arbitorary configuration, the measuurement can be performed. In the case where the side wall of the bored hole is tapered or provided with the concave portions c, a conventional method can not measure nor estimate the shaft friction force, while this method is effective. The shaft friction force can be measured by moving the pressing frame 5 in the direction corresponding to the inner axis of the bored hole, and the measurement may be done by rotating the casing 1 using a casing driver or the like which grabs the upper portion of the casing 1.

Figure 58:
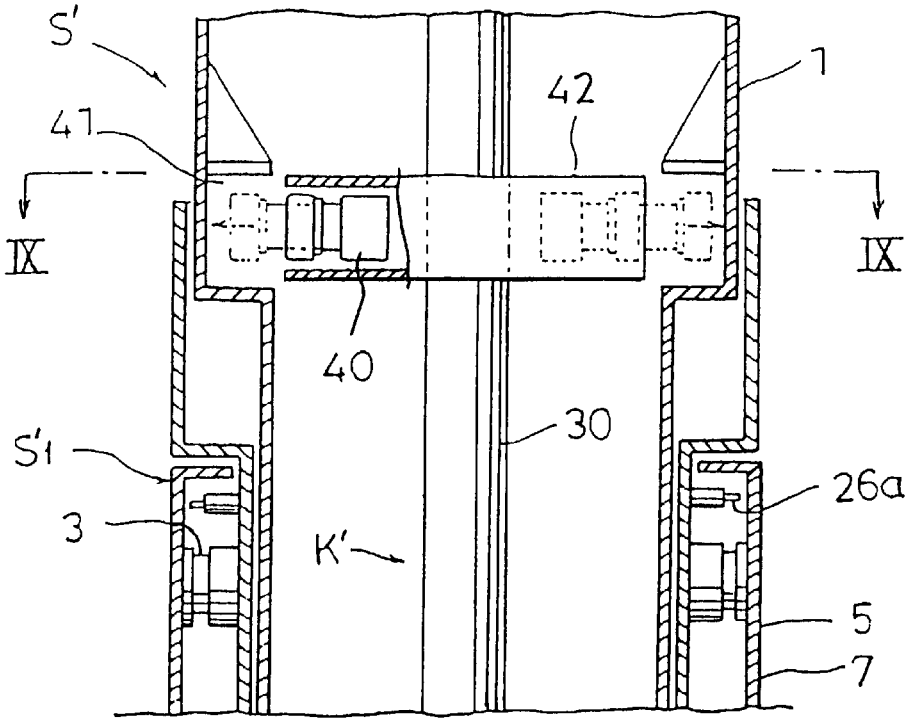
FIG. 58 is a sectional view showing a combination of still another embodiment of the ground presser and the drilling machine.
Figure 59:
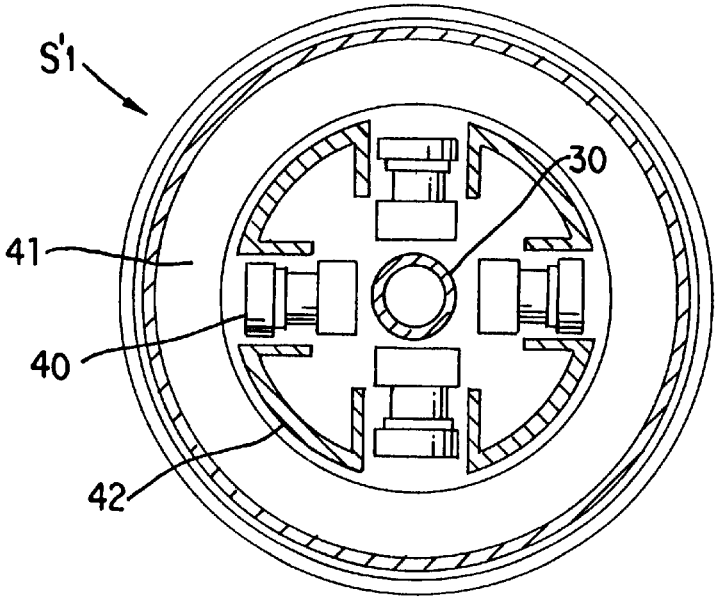
FIG. 59 is a sectional view along the line IX—IX of FIG. 58.

FIGS. 58 and 59 show another (i.e., the tenth type) embodiment for a method of pressing the bottom ground of a bored hole and the apparatus therefore. In the above construction method, when the vertical pressing frame 8 is put down to press the ground, the bottom face of the vertical pressing board 13 comes in contact with the fanwise cutter 32 attached to the end portion of the drilling machine K', the pressing force of the vertical cylinder 4 is transmitted to the drilling machine, and the bottom ground is pressed by the bottom face at the end portion of the drilling machine. However, in this embodiment, a cylinder 40 attached to a rotation shaft 30 of the drilling machine K' protrudes in the horizontal direction to come in contact with a ring-shaped portion 41 provided on the inner wall of the casing 1. When a vertical cylinder 4 (not shown in FIGS. 58 and 59) works while the pressing frame 5 in the tenth embodiment presses the wall of the bored hole, the body of the casing 1 descends and accordingly the drilling machine K in contact with the casing 1 also descends so that the bottom face of the drilling machine K presses the bottom ground of the bored hole. Reference numeral 42 denotes a contact frame holding the cylinder 40. A pressure sensor 24*c*, and a position sensor 26*c* may be attached to the cylinder 40.

Figure 60:
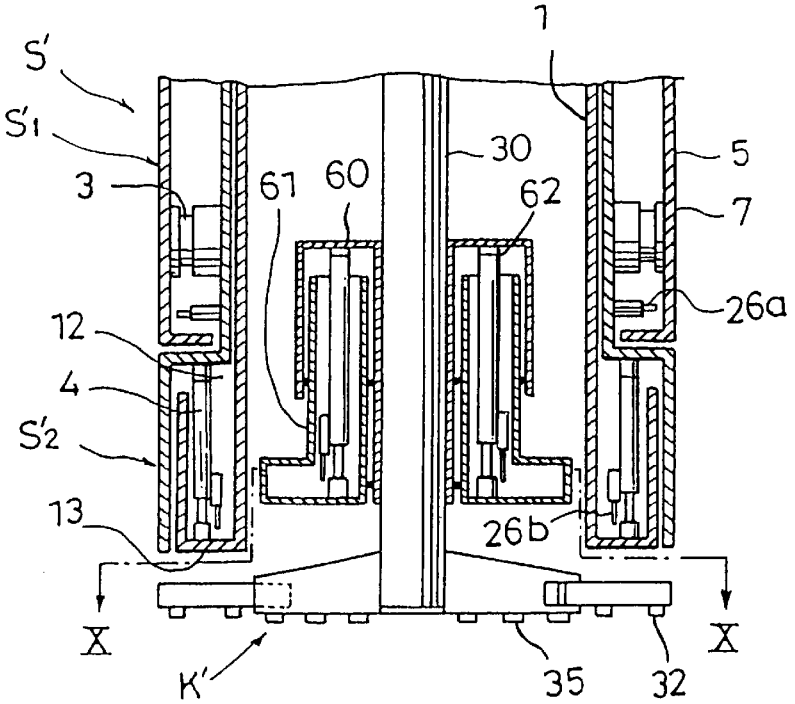
FIG. 60 is a sectional view of a combination of further another embodiment of the ground presser and the drilling machine.
Figure 62:
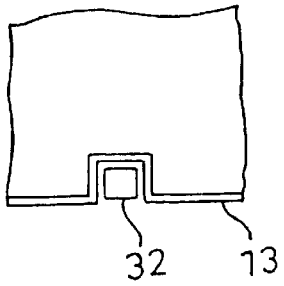
FIG. 62 is a partial side view of FIG. 61.
Figure 61:
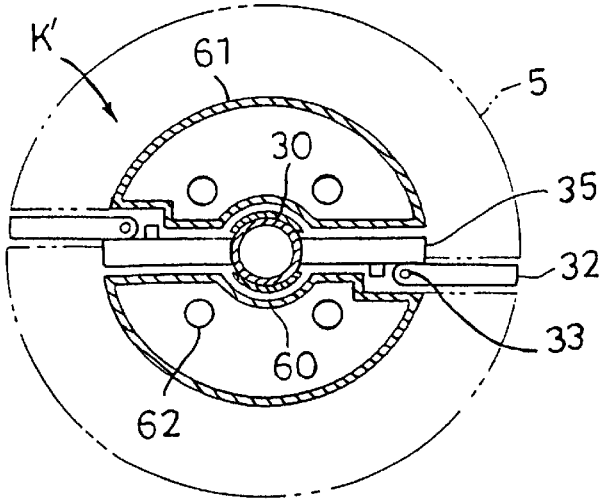
FIG. 61 is a sectional view along the line X—X of FIG. 60.

FIGS. 60 to 62 show another (i.e., the eleventh type) embodiment of the drilling machine K. A moving frame 61 is fitted in a ring chamber 60 having a U-shaped cross section provided close to the upper portion of the leading cutter 35 so that the moving frame 61 can be vertically moved. In pressing the bottom ground, the moving frame 61 descends among a plurality of the leading cutters 35, so that the bottom face of the moving frame 61 and the leading cutter 35 can cooperatively press the ground.

Reference numeral 62 denotes a moving cylinder to move the moving frame 61. When the bottom ground is pressed only by the leading cutter 35 without using this apparatus, the leading cutters 35 are rotated one after another to press the ground.

Figure 63:
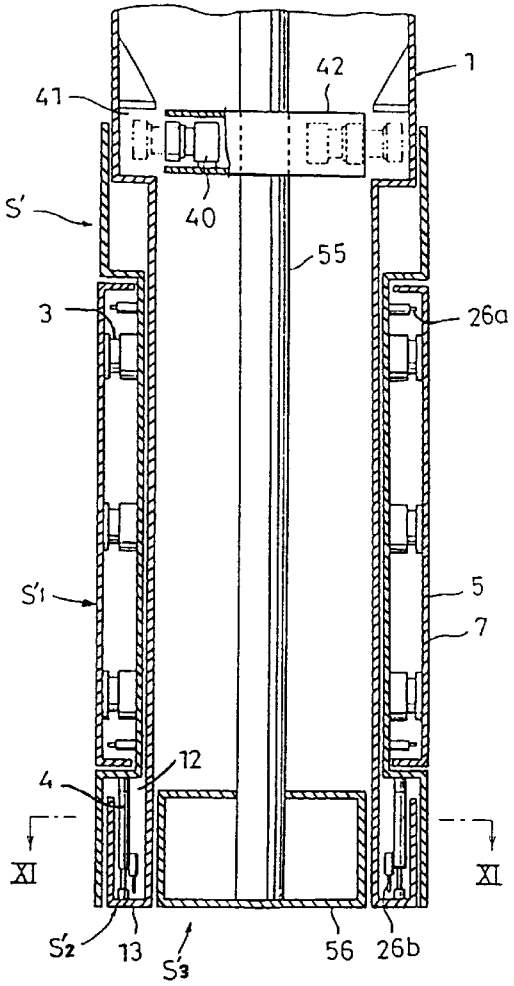
FIG. 63 is a sectional view showing a combination of yet another embodiment of the ground presser and another presser.
Figure 64:
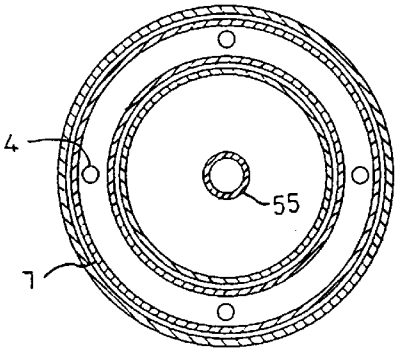
FIG. 64 is a sectional view along the line XI—XI of FIG. 63.

In the aforementioned embodiment, the end portion of the drilling machine K' which is used for making a hole directly press the bottom ground of the bored hole. However, as shown in FIGS. 63 to 64, a hole is made by the drilling machine K', and the casing 1 is set up in the hole while it presses the surrounding ground of the bored hole. When the ground presser S' reaches a predetermined depth, the drilling machine K' is pulled up on the ground from the casing 1. After that, a presser S'3 for pressing the bottom ground as shown in the figure is suspended and put down to the end portion in the casing 1. Then, the cylinder 40 attached to a hollow shaft 55 comes in contact with the contact portion 41. Further, the vertical cylinder 4 works so that a vertical pressing face 56 presses the bottom ground of the bored hole.

The above embodiments are selectively employed, and they can be combined in use.

What is claimed is:

1. A method of making a hole for a foundation pile such as a cast-in-situ pile, comprising the steps of:

boring a hole with a drilling machine;

setting up in said hole a casing provided with a horizontal pressing device on an outer peripheral portion thereof; and pressing surrounding ground of said bored hole with said horizontal pressing device for outward displacement a controlled amount over a contiguous surface of vertically adjacent sections by application of pressure responsive to a feedback of an amount of displacement of said surrounding ground in each of said vertically adjacent sections to deform said surrounding ground a controlled amount, said contiguous surface substantially covering an interior vertical surface of said hole, said application of pressure to each of said vertically adjacent sections being discontinued when an amount of said pressure reaches a predetermined value, said predetermined value being selected to provide a desired compactness of said surrounding ground following displacement thereof.

2. A method according to claim 1 wherein the arbitrary shape of the wall of the bored hole is tapered in a direction going deeper into the bored hole.

3. A method according to claim 1, wherein the arbitrary shape of the wall of the bored hole has at least one irregular portion on a surface of the wall of the bored hole.

4. A method of making a hole for a foundation pile such as a cast-in-situ pile, comprising the steps of:

boring a hole with a drilling machine;

setting up in said hole a casing provided with a vertical pressing device having an annular pressure surface circumferentially disposed about said drilling machine on an outer peripheral portion of a lower end of said casing; and pressing bottom ground of the bored hole with both said vertical pressing device and a bottom face of the drilling machine when the casing reaches a predetermined depth, said vertical pressing device imparting downward movement to said bottom face, said step of pressing being carried out without removal of said drilling machine from said hole following said step of boring.

5. A method for making a hole for a foundation pile, comprising the steps of:

(a) boring a hole to an initial predetermined depth, at which time said boring is terminated;

(b) applying horizontal pressure over a vertical portion of predetermined height of an inner circumferential surface of said hole, said vertical portion being substantially equal to said predetermined depth;

(c) resuming said boring to increase a depth of said hole a distance substantially equal to said initial predetermined depth at which time said boring is again terminated; and (d) applying horizontal pressure over a subsequent vertical portion of an inner circumferential surface of said hole vertically adjacent to said vertical portion pressed in a preceding step of applying horizontal pressure, said subsequent vertical portion being about equal in height to said predetermined height of said vertical portion, said horizontal pressure applied in at least one of steps (b) and (d) being discontinued when an amount of said pressure reaches a predetermined value, said predetermined value being selected to provide a desired compactness of said surrounding ground following displacement thereof.

6. A method for making a hole for a foundation pile, comprising the steps of:

(a) boring a hole to an initial predetermined depth, at which time said boring is terminated;

(b) applying horizontal pressure over a vertical portion of predetermined height of an inner circumferential surface of said hole, said vertical portion being substantially equal to said predetermined depth;

(c) resuming said boring to increase a depth of said hole a distance substantially equal to said initial predetermined depth at which time said boring is again terminated; and (d) applying horizontal pressure over a subsequent vertical portion of an inner circumferential surface of said hole vertically adjacent to said vertical portion pressed in a preceding step of applying horizontal pressure, said subsequent vertical portion being about equal in height to said predetermined height of said vertical portion, said horizontal pressure applied in at least one of steps (b) and (d) is non-uniformly applied, increasing in the vertical direction, whereby said hole is enlarged and vertically tapered over said vertical portion and said subsequent vertical portion to which said horizontal pressure is respectively applied.

7. The method according to claim 5, wherein:

said horizontal pressure applied in steps (b) and (d) is individually applied over a plurality of radially divided sectors, each of said plurality of radially divided sectors being individually monitored for an amount of displacement of ground surrounding an interior surface of said hole adjacent with each of said plurality of radially divided sectors, and an amount of individual pressure being applied in response thereto, to each of said plurality of said radially divided sectors, to displace said ground surrounding said interior surface of said hole adjacent with each of said plurality of radially divided sectors a controlled amount.

8. The method according to claim 7, wherein:

said ground surrounding said interior surface of said hole adjacent with each of said plurality of radially divided sectors is displaced substantially the same amount, whereby said hole is enlarged coaxially.

9. A method for making a hole for a foundation pile, comprising the steps of:

(a) boring a hole to an initial predetermined depth, at which time said boring is terminated;

(b) applying horizontal pressure over a vertical portion of predetermined height of an inner circumferential surface of said hole;

(c) resuming said boring to increase a depth of said hole a distance substantially equal to said initial predetermined depth at which time said boring is again terminated;

(d) applying horizontal pressure over a subsequent vertical portion of an inner circumferential surface of said hole vertically adjacent to a vertical portion pressed in a preceding step of applying horizontal pressure, said subsequent vertical portion being substantially equal in height to said predetermined height, said horizontal pressure applied in at least one of steps (b) and (d) being discontinued when an amount of said pressure reaches a predetermined value, said predetermined value being selected to provide a desired compactness of said surrounding ground following displacement thereof;

(e) applying vertical pressure over a circumferential annular surface area within said hole, and over a central circular area surrounded by, and adjacent to, said circumferential annular surface area.

* * * * *